US009402478B2

(12) United States Patent
Hasegawa et al.

(10) Patent No.: US 9,402,478 B2
(45) Date of Patent: Aug. 2, 2016

(54) ROCKING CHAIR AND SPRING UNIT USED THEREIN

(71) Applicant: ITOKI CORPORATION, Osaka-shi, Osaka (JP)

(72) Inventors: Masashi Hasegawa, Osaka (JP); Kohei Wada, Osaka (JP); Hiroyuki Ito, Osaka (JP); Seitaro Komoto, Osaka (JP); Shunsuke Kondo, Osaka (JP)

(73) Assignee: ITOKI CORPORATION, Osaka-shi, Osaka (JP)

( * ) Notice: Subject to any disclaimer, the term of this patent is extended or adjusted under 35 U.S.C. 154(b) by 20 days.

(21) Appl. No.: 14/155,748

(22) Filed: Jan. 15, 2014

(65) Prior Publication Data

US 2014/0125104 A1 May 8, 2014

Related U.S. Application Data

(63) Continuation of application No. PCT/JP2012/068095, filed on Jul. 17, 2012.

(30) Foreign Application Priority Data

| | | |
|---|---|---|
| Jul. 15, 2011 | (JP) | 2011-157063 |
| Jul. 15, 2011 | (JP) | 2011-157065 |
| Jul. 15, 2011 | (JP) | 2011-157067 |
| Nov. 16, 2011 | (JP) | 2011-250621 |

(51) Int. Cl.
*A47C 1/023* (2006.01)
*A47C 1/032* (2006.01)

(52) U.S. Cl.
CPC ..... *A47C 1/023* (2013.01); *A47C 1/03238* (2013.01); *A47C 1/03255* (2013.01); *A47C 1/03266* (2013.01); *A47C 1/03272* (2013.01); *A47C 1/03283* (2013.01)

(58) Field of Classification Search
CPC ..... A47C 7/462
USPC ..... 297/303.4, 303.5
See application file for complete search history.

(56) References Cited

U.S. PATENT DOCUMENTS 5,207,479 A * 5/1993 Wickman et al. ..... 297/303.4
5,328,237 A 7/1994 Yamaguchi et al.

(Continued)

FOREIGN PATENT DOCUMENTS

GB 2 252 723 A 8/1992
JP 46-8447 B2 3/1971

(Continued)

OTHER PUBLICATIONS

A Japanese Office Action (with English-language translation) dated Feb. 25, 2015 that issued in Japanese patent application No. 2011-157065.

(Continued)

*Primary Examiner* — Timothy J Brindley
(74) *Attorney, Agent, or Firm* — Drinker Biddle & Reath LLP

(57) ABSTRACT

A rocking chair includes a seat, a backrest that is tiltable rearward, a locking spring portion that imparts resistance to the rearward tilting of the backrest, and a resilience adjustment member that changes the degree of resistance of the spring portion to the rearward tilting of the backrest. The resilience adjustment member is a cam that is rotationally operable by a person seated on a seat and the position in which rocking load due to the rearward tilting of the backrest is applied to the spring portion is changed by the cam, so that moment applied to the spring portion changes and the degree of resistance of the spring portion is adjusted.

6 Claims, 35 Drawing Sheets

(56) References Cited

U.S. PATENT DOCUMENTS

| | | | | |
|---|---|---|---|---|
| 5,725,276 | A * | 3/1998 | Ginat | 297/289 |
| 5,979,984 | A * | 11/1999 | DeKraker et al. | 297/300.5 |
| 8,714,645 | B2 * | 5/2014 | Cvek | 297/301.4 |
| 8,899,680 | B2 * | 12/2014 | Meier et al. | 297/300.5 |
| 2002/0171278 | A1 * | 11/2002 | Stulik et al. | 297/302.4 |
| 2004/0140702 | A1 * | 7/2004 | Daeschle et al. | 297/300.5 |
| 2004/0174057 | A1 * | 9/2004 | Elzenbeck | 297/300.5 |
| 2007/0228801 | A1 * | 10/2007 | Matern | 297/463.1 |
| 2008/0001453 | A1 * | 1/2008 | Rutman | 297/300.4 |
| 2009/0302655 | A1 * | 12/2009 | Gorgi | 297/303.1 |
| 2013/0234485 | A1 * | 9/2013 | Gorgi et al. | 297/303.2 |
| 2014/0239688 | A1 * | 8/2014 | Cvek | 297/311 |
| 2014/0300164 | A1 * | 10/2014 | Oda | 297/354.1 |
| 2015/0123441 | A1 * | 5/2015 | Duke | 297/300.4 |
| 2015/0216302 | A1 * | 8/2015 | Voigt et al. | 297/173 |

FOREIGN PATENT DOCUMENTS

| | | | |
|---|---|---|---|
| JP | 47-49543 | B2 | 12/1972 |
| JP | 7-77567 | B2 | 3/1993 |
| JP | 6-261818 | A | 9/1994 |
| JP | H07-313282 | A | 12/1995 |
| JP | 2519167 | B2 | 7/1996 |
| JP | 10-179312 | A | 7/1998 |
| JP | 11-169254 | A | 6/1999 |
| JP | A-2002-119364 | | 4/2002 |
| JP | 2002-142897 | A | 5/2002 |
| JP | A-2003-024175 | | 1/2003 |
| JP | 2008-080090 | A | 4/2008 |
| JP | 4185754 | B2 | 11/2008 |
| JP | 4220191 | B2 | 2/2009 |
| JP | 2009-112728 | A | 5/2009 |
| JP | A-2009-201763 | | 9/2009 |
| JP | 2010-516433 | A | 5/2010 |
| JP | 2011-024750 | A | 2/2011 |
| JP | A-2011-092392 | | 5/2011 |
| JP | A-2011-136013 | | 7/2011 |

OTHER PUBLICATIONS

Notification of Reasons for Refusal issued Sep. 24, 2015 in corresponding Japanese Patent Application No. 2011-250621 (4 pages) with an English Translation (8 pages).

A Japanese Office Action (with English-language translation) dated Sep. 2, 2015 that issued in Japanese patent application No. 2011-250616.

* cited by examiner

FIG. 1B
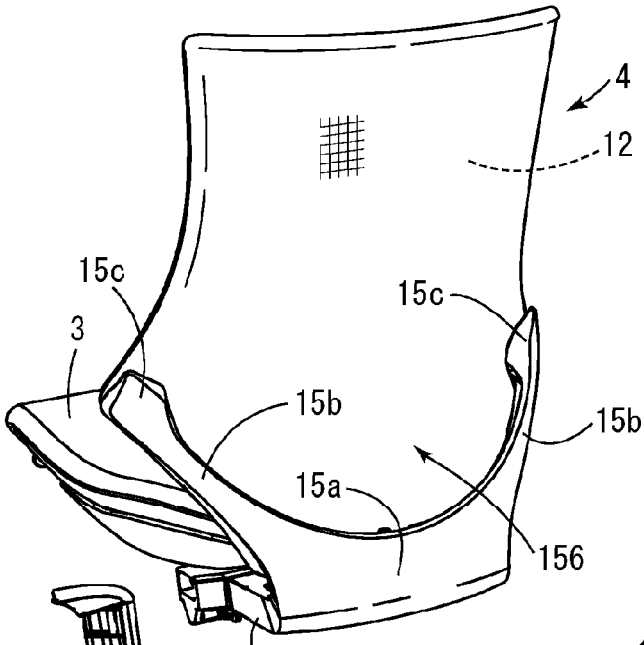
FIG. 1A
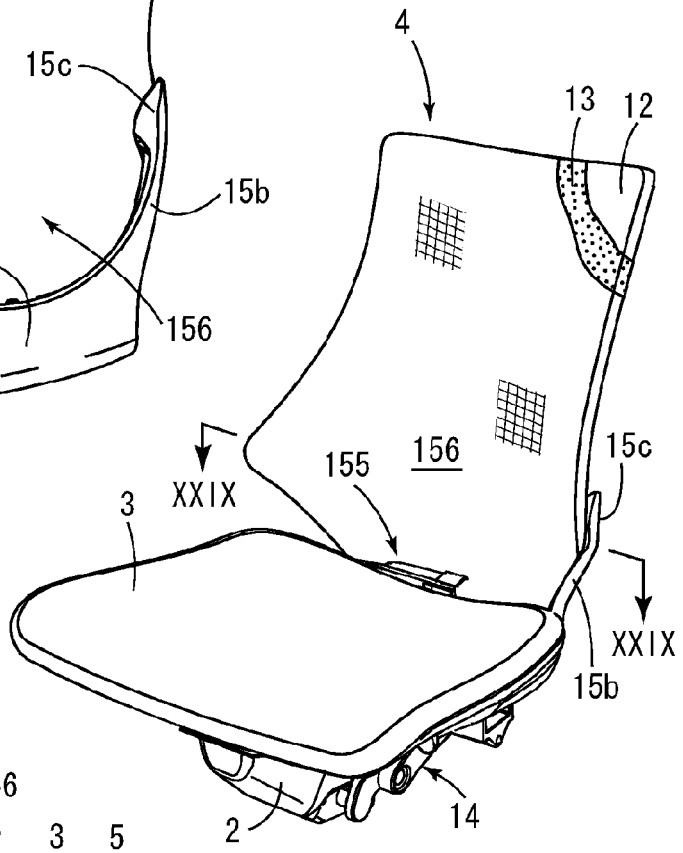
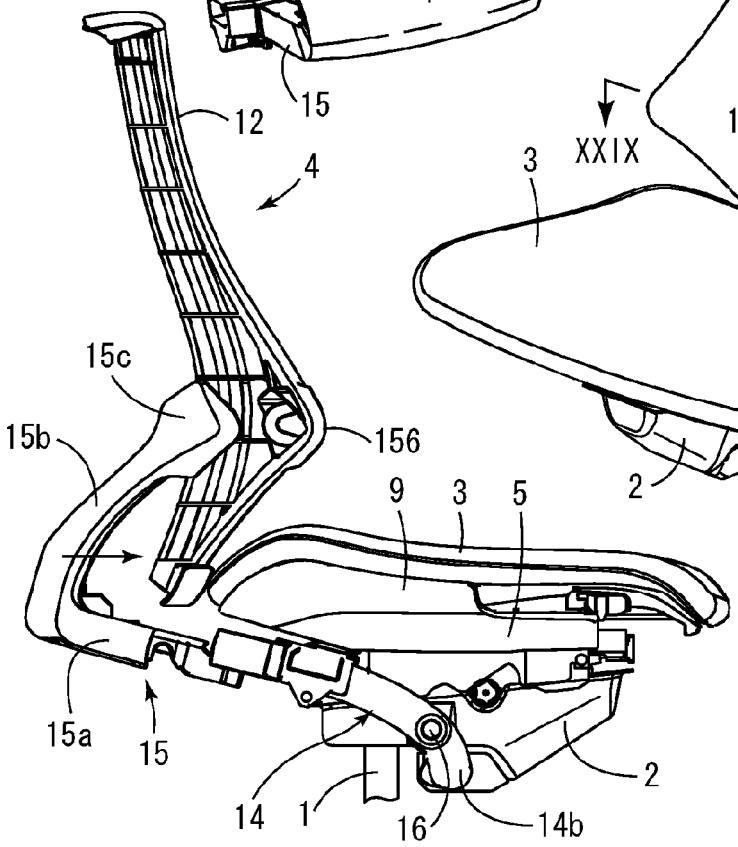
FIG. 1C

FIG. 2A
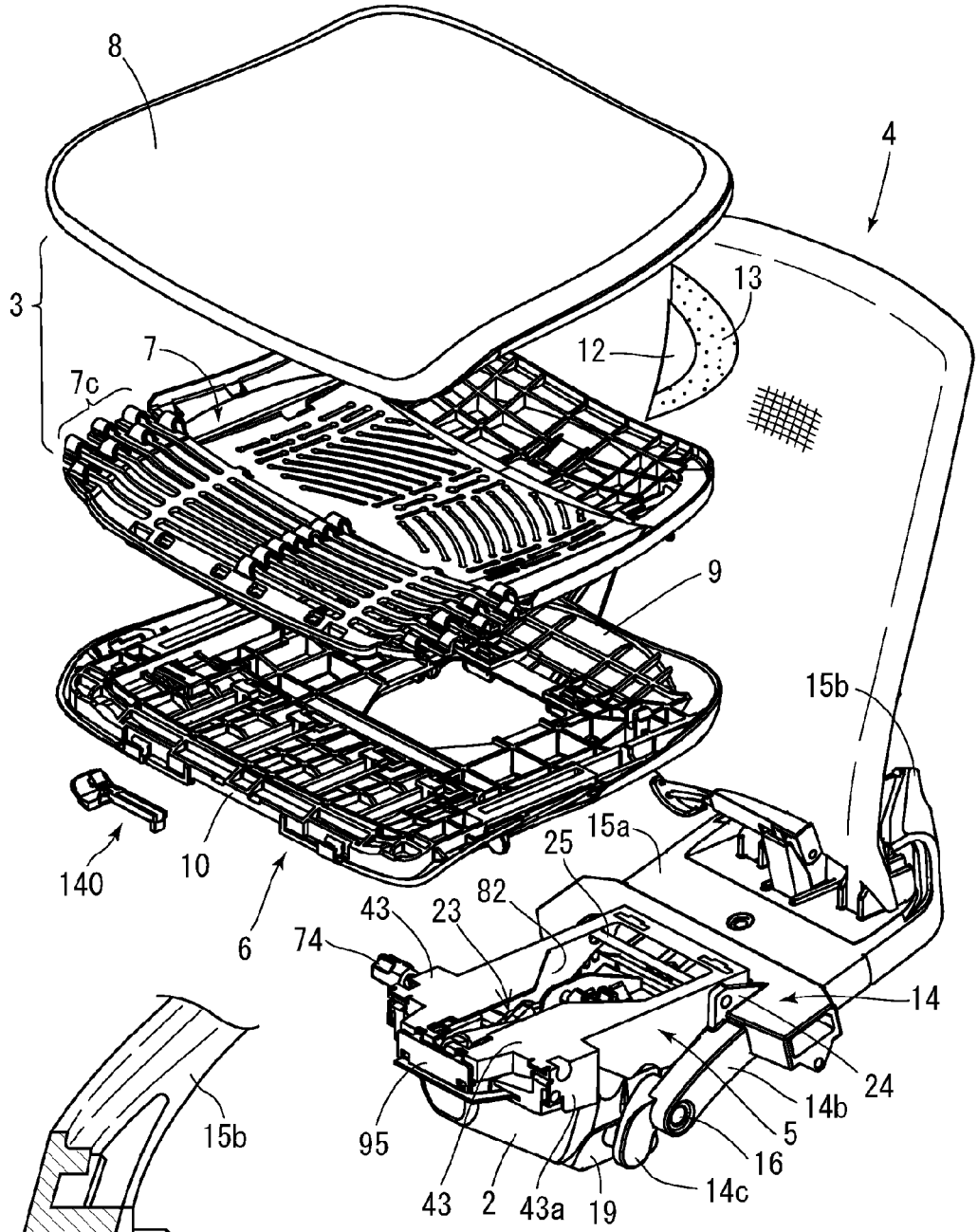
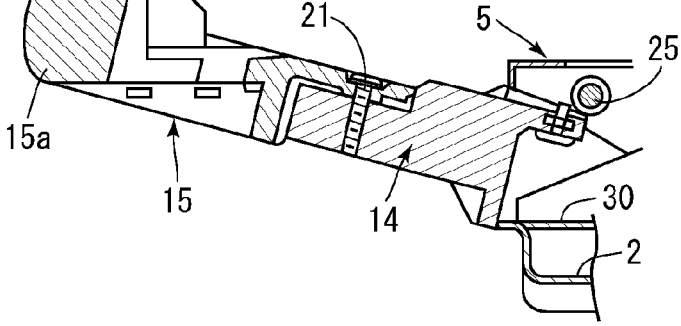
FIG. 2B

FIG. 6A
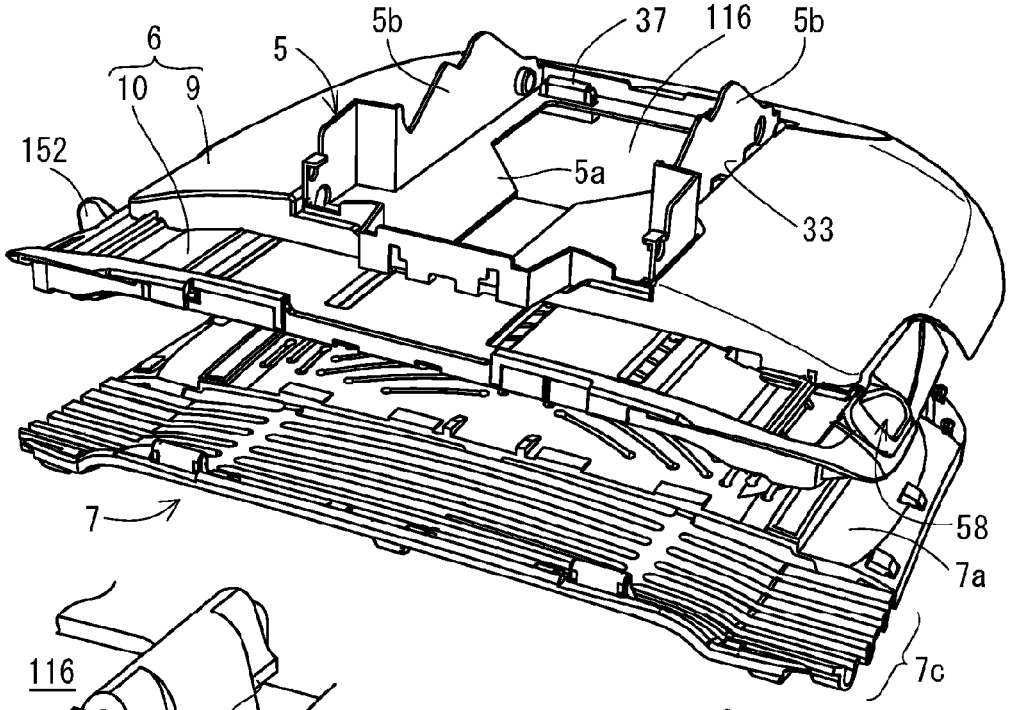
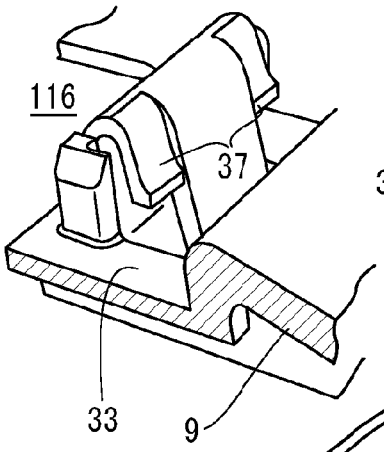
FIG. 6C
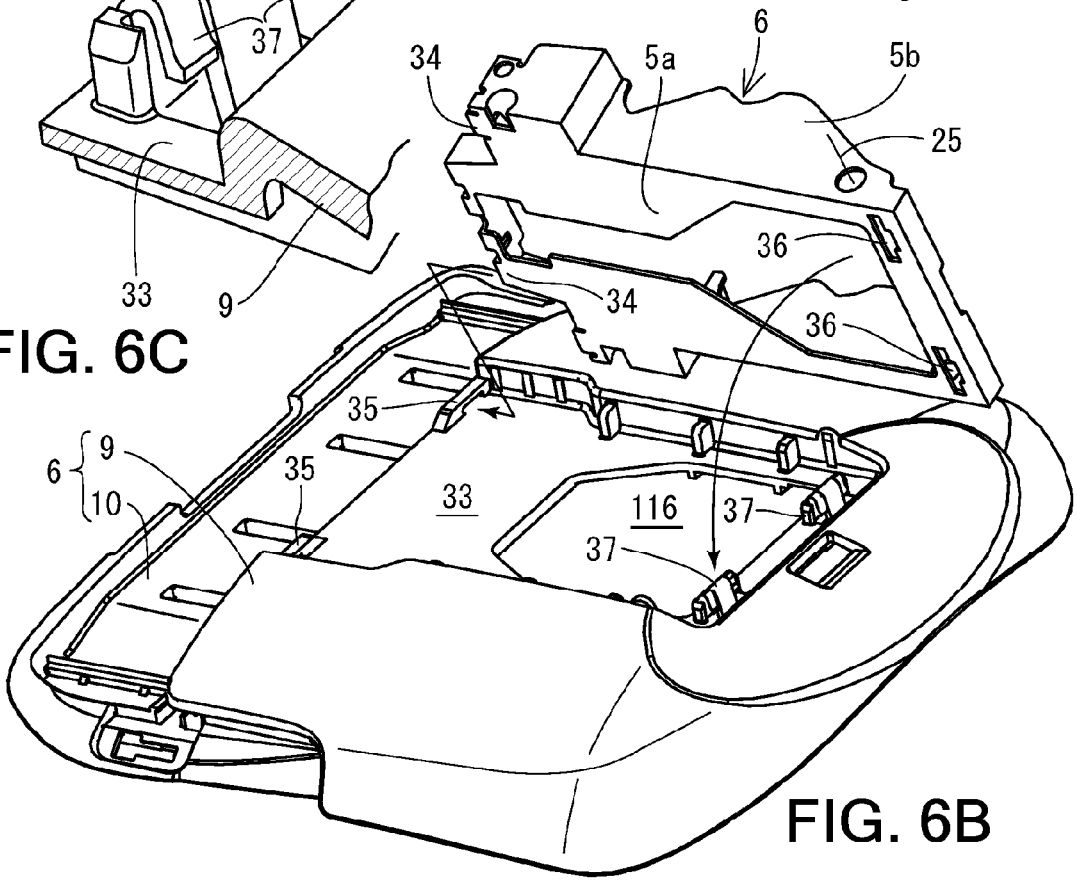
FIG. 6B

FIG. 8A
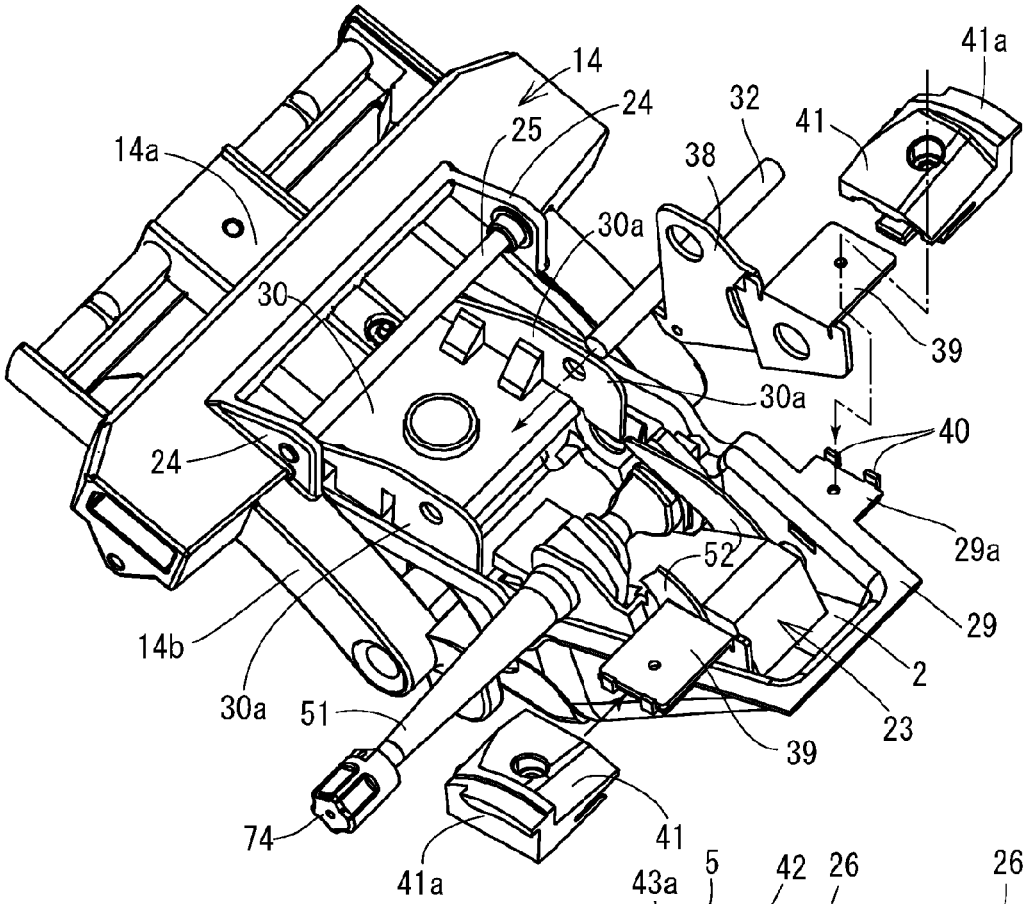
FIG. 8B
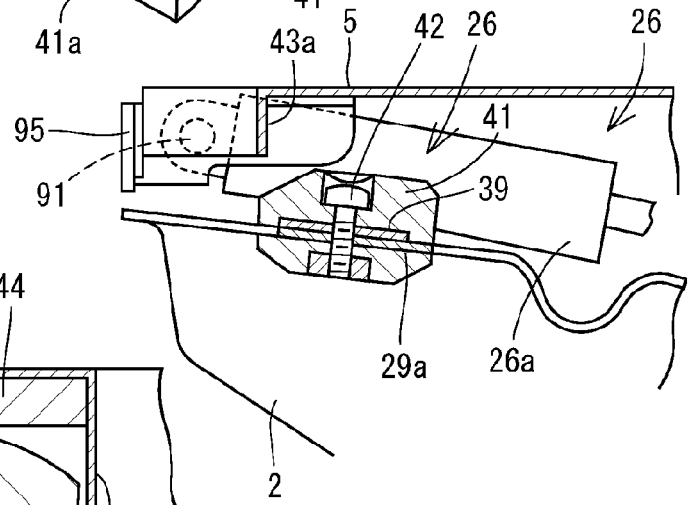
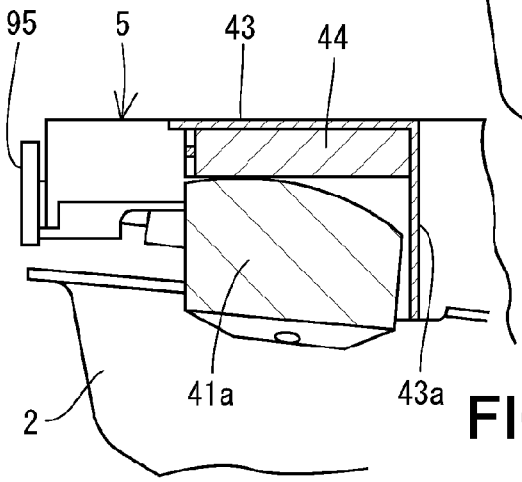
FIG. 8C

FIG. 12A
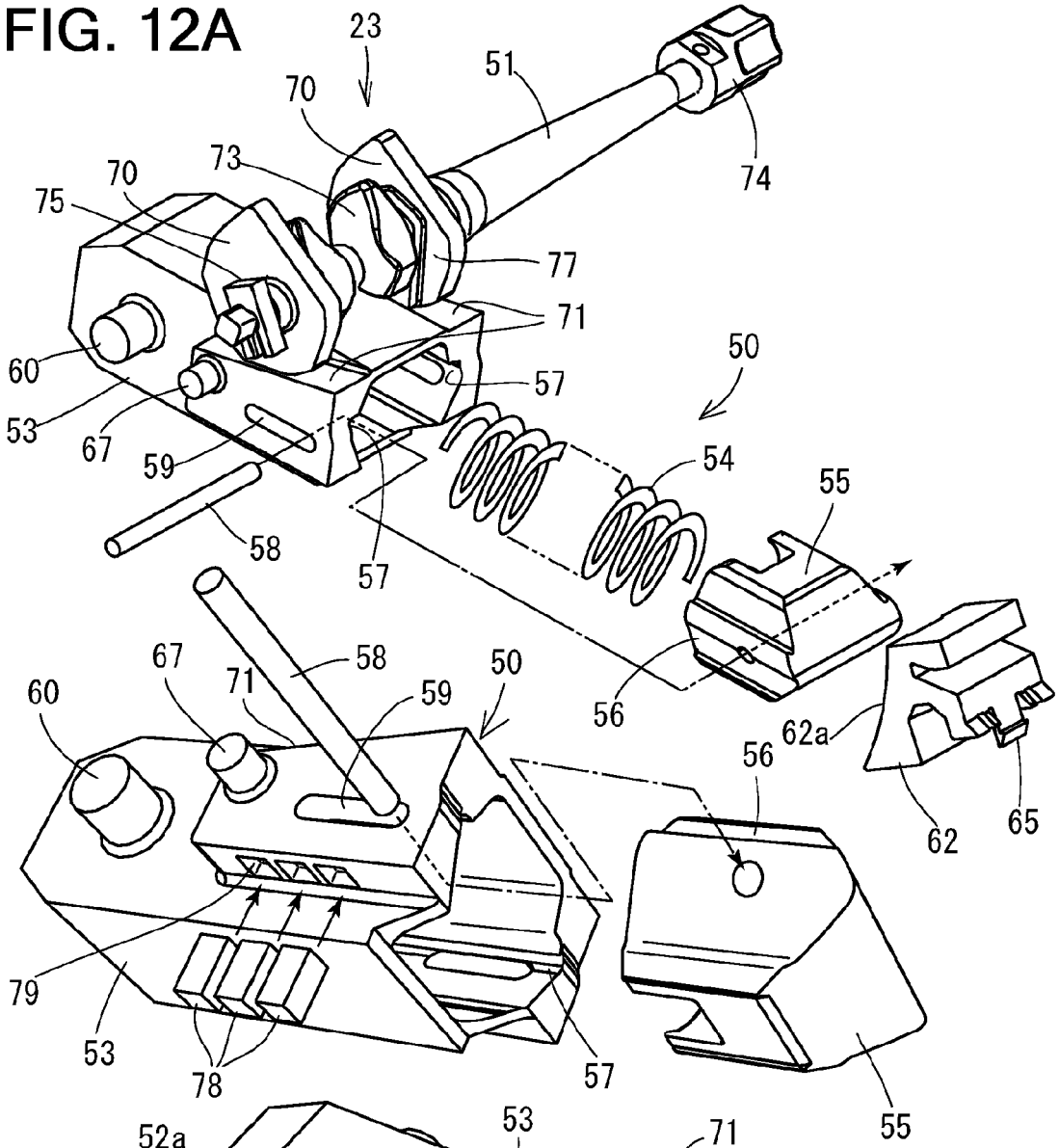
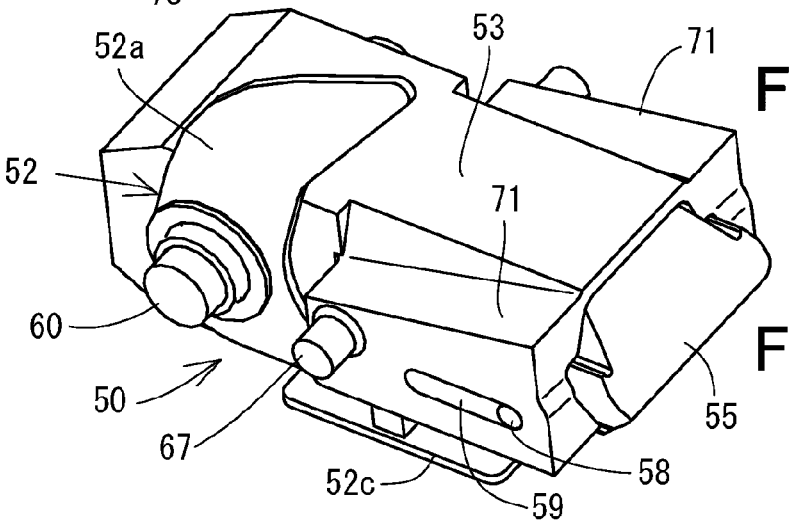
FIG. 12B
FIG. 12C

FIG. 14A
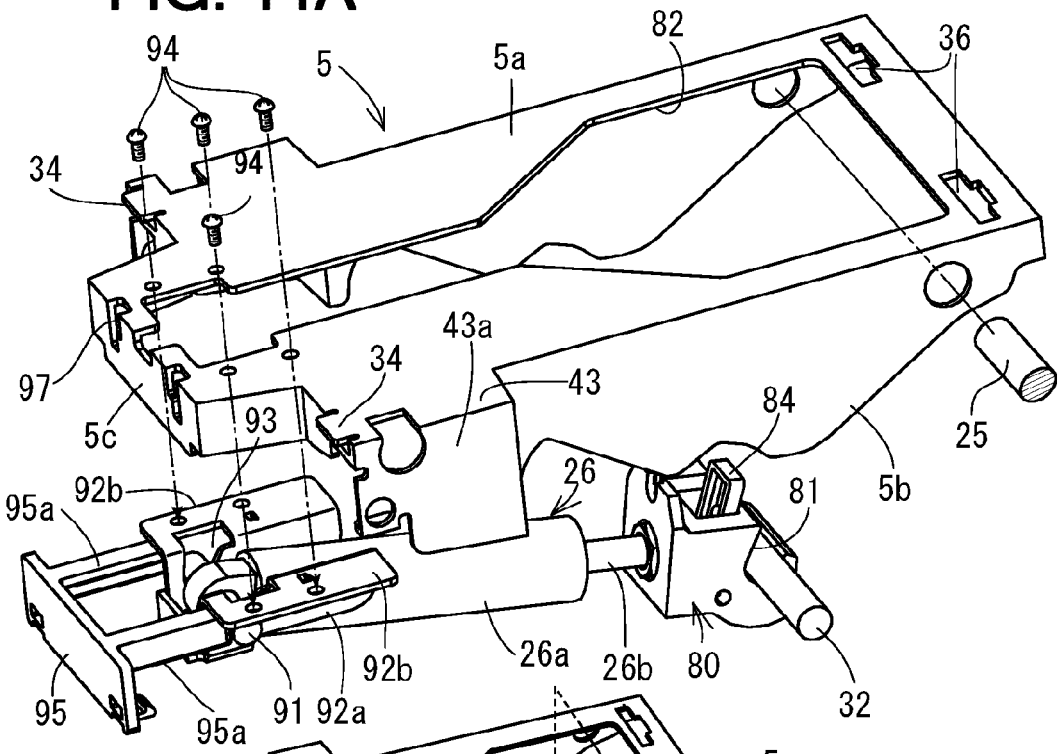
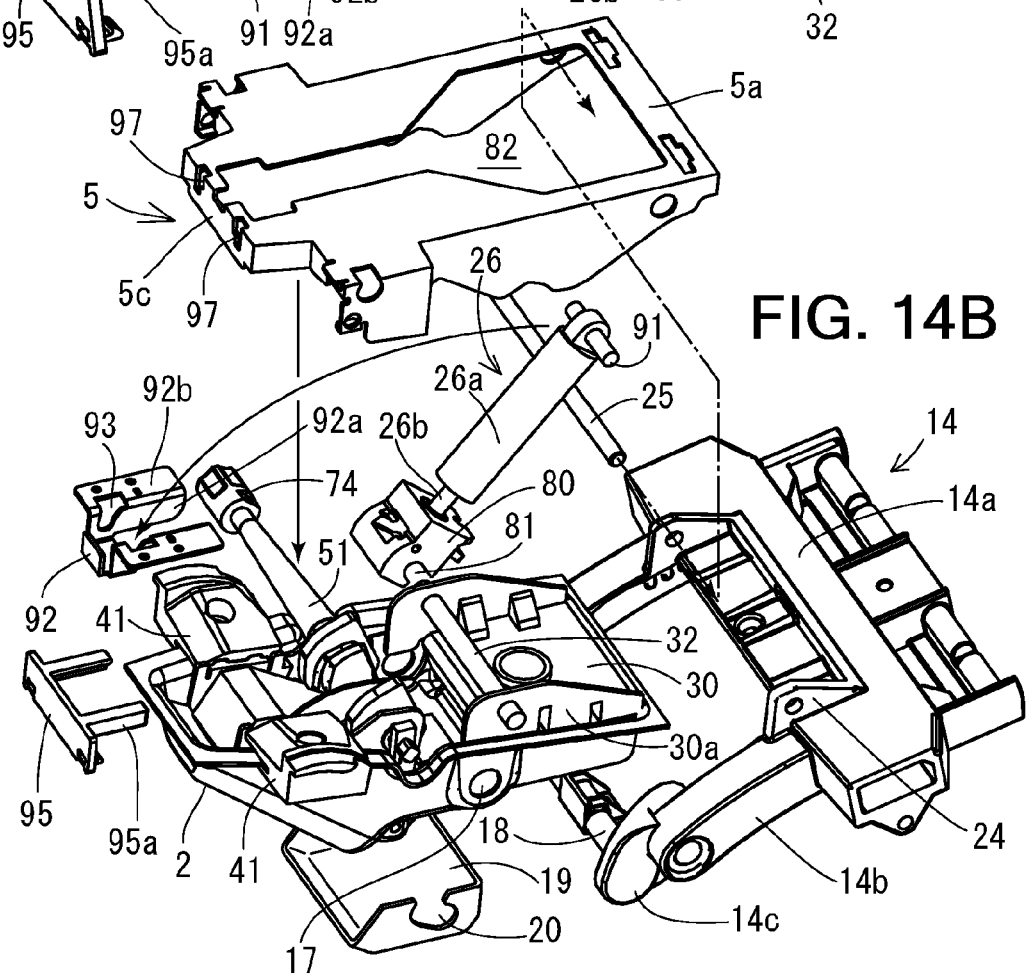
FIG. 14B

FIG. 16A
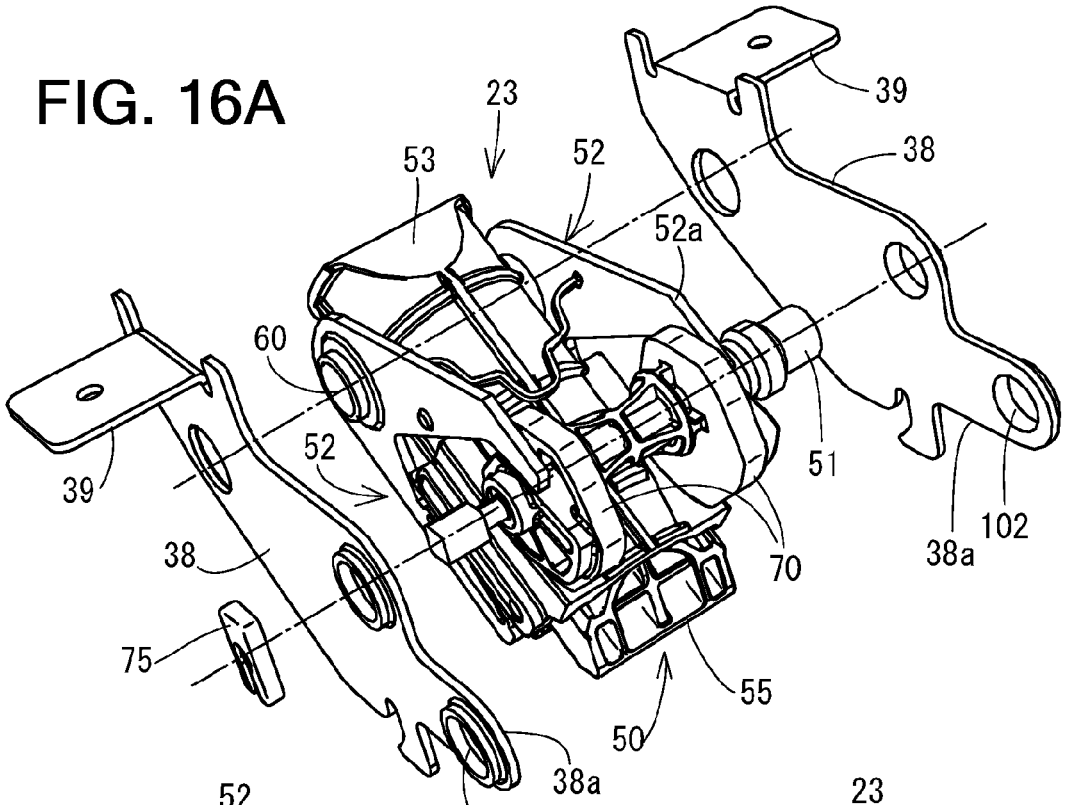
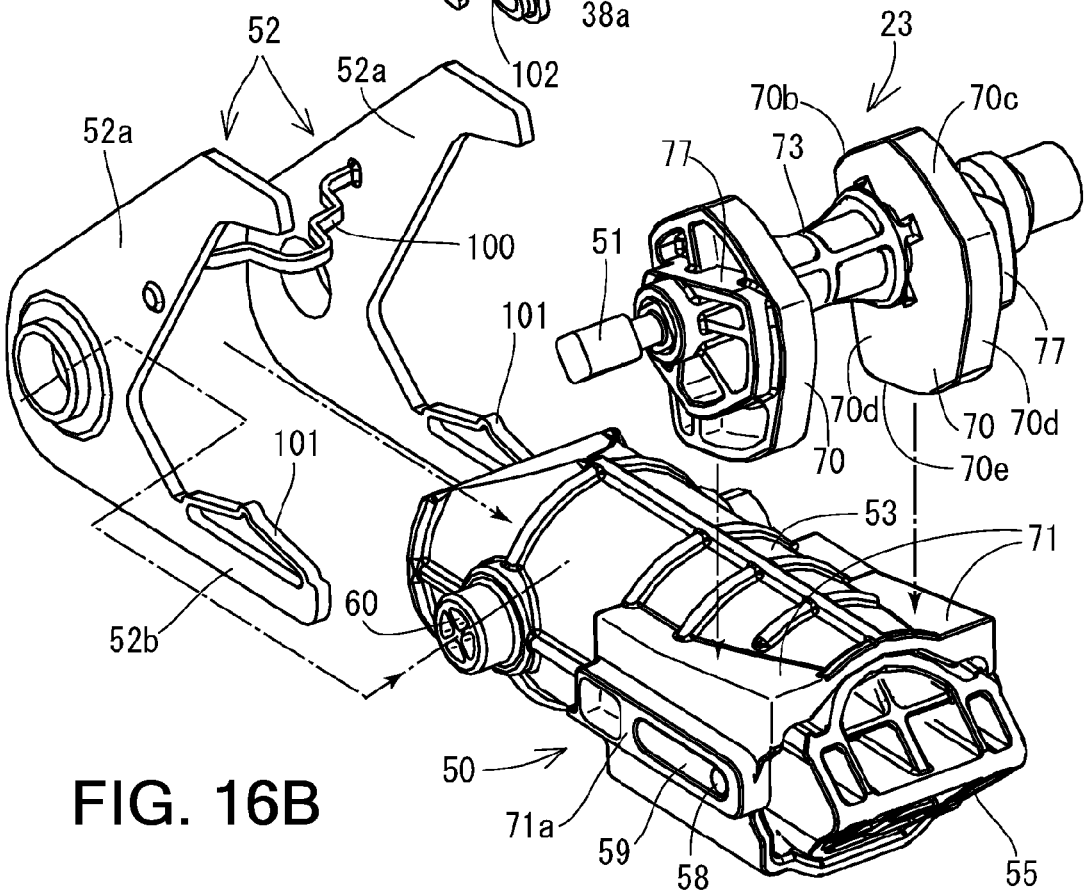
FIG. 16B

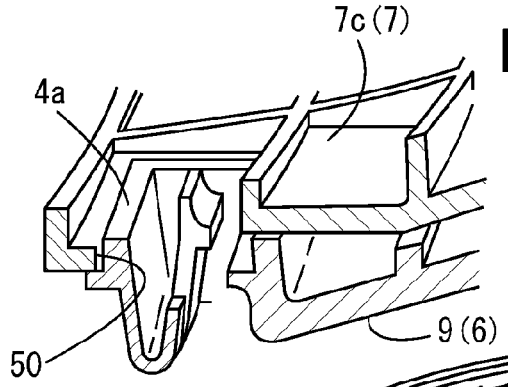
FIG. 20B
FIG. 20A
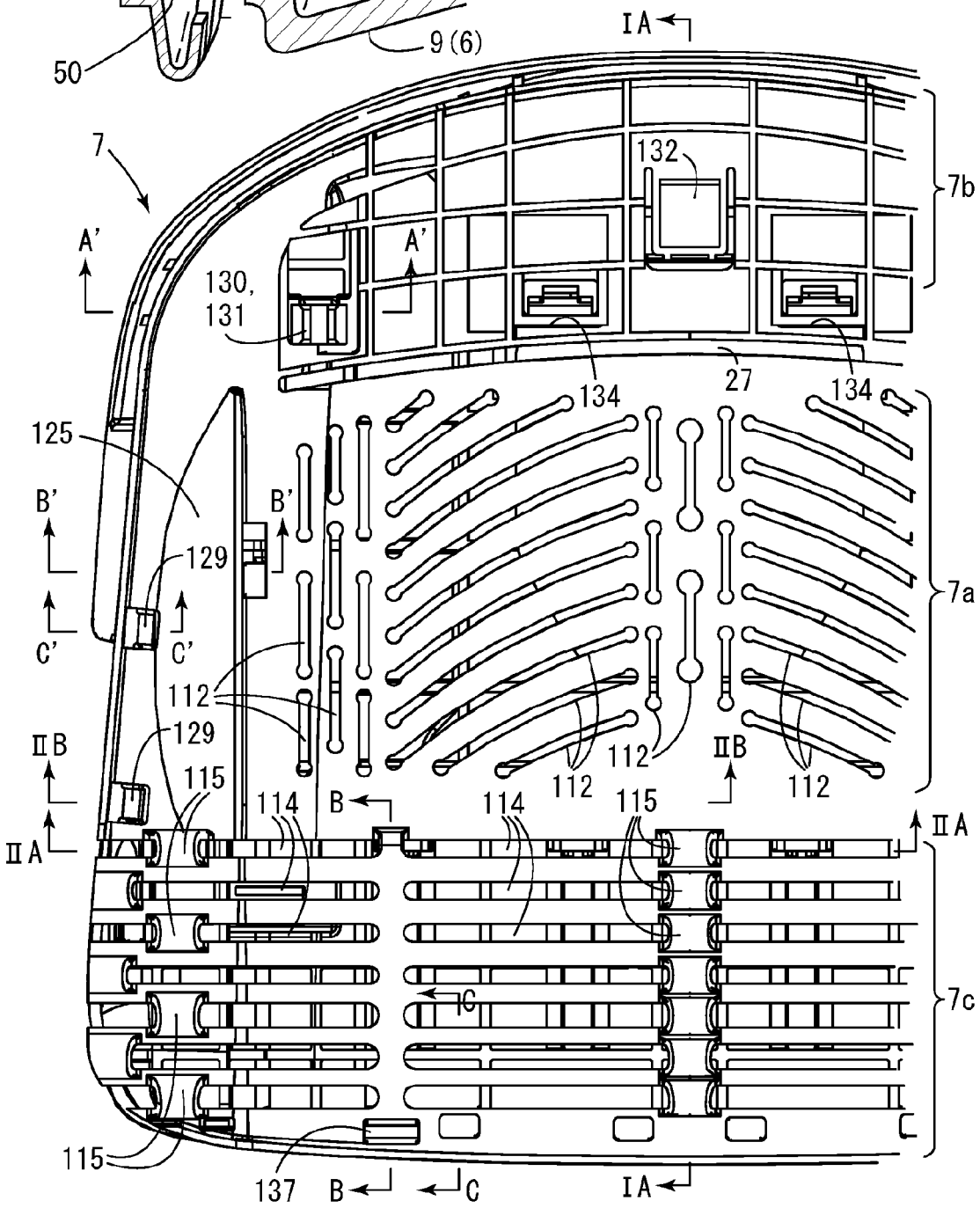

3
7a
8
7c
115
113
7b
9 (6)
132
133
16
5b
5a
5
10a
(10, 6)
114
10a (10)
7c
(7)
137
138
134
7

3
8
115
117
118
10a
(10, 7)
9 (6)
7c
33
121
122

3
8
7a
116
33
(6) 9
119
120a
125
120
119a
122
121
10b

FIG. 23A
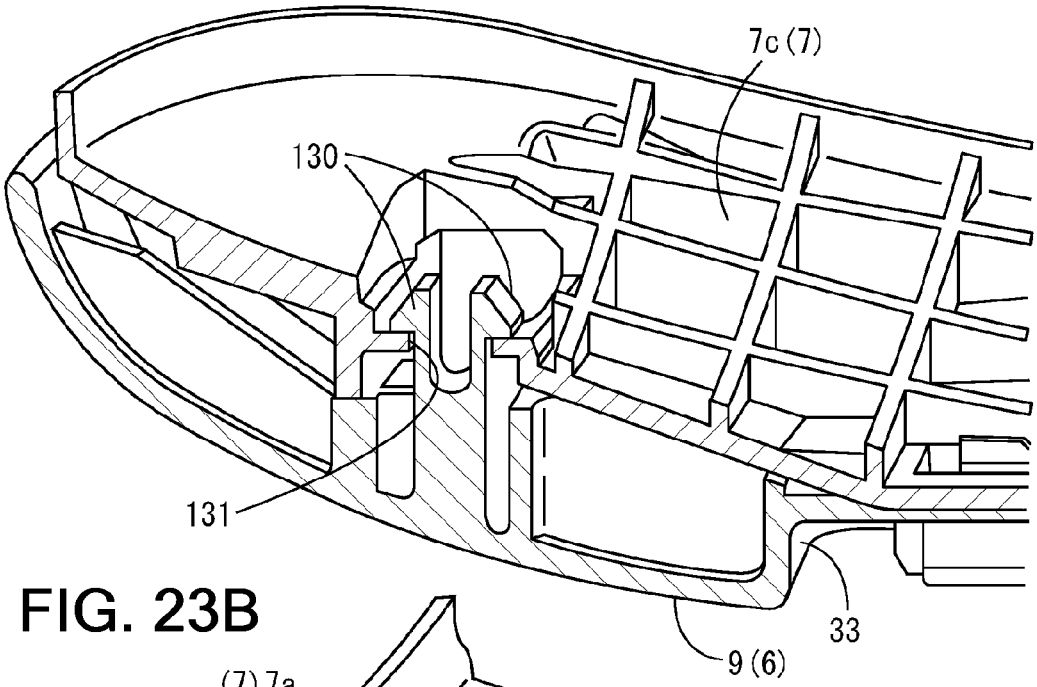
FIG. 23B
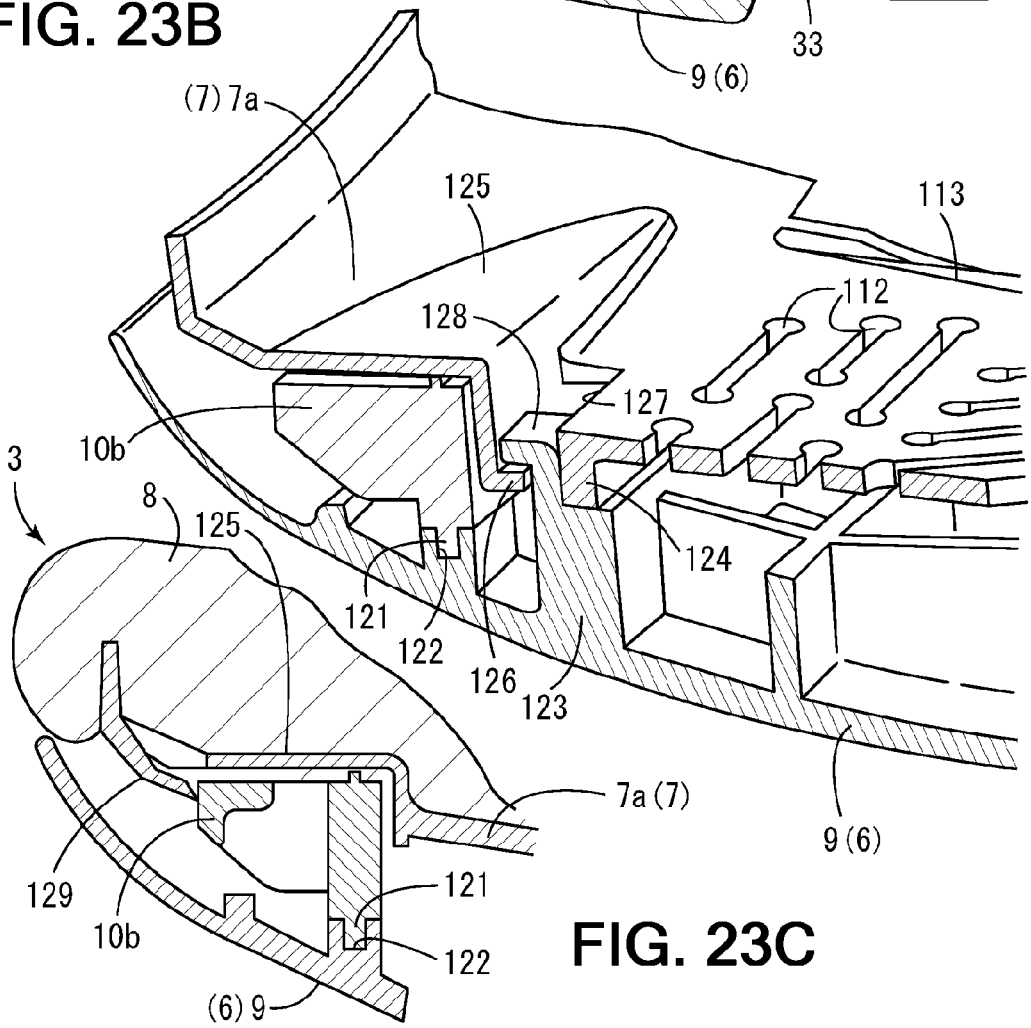
FIG. 23C

FIG. 25A
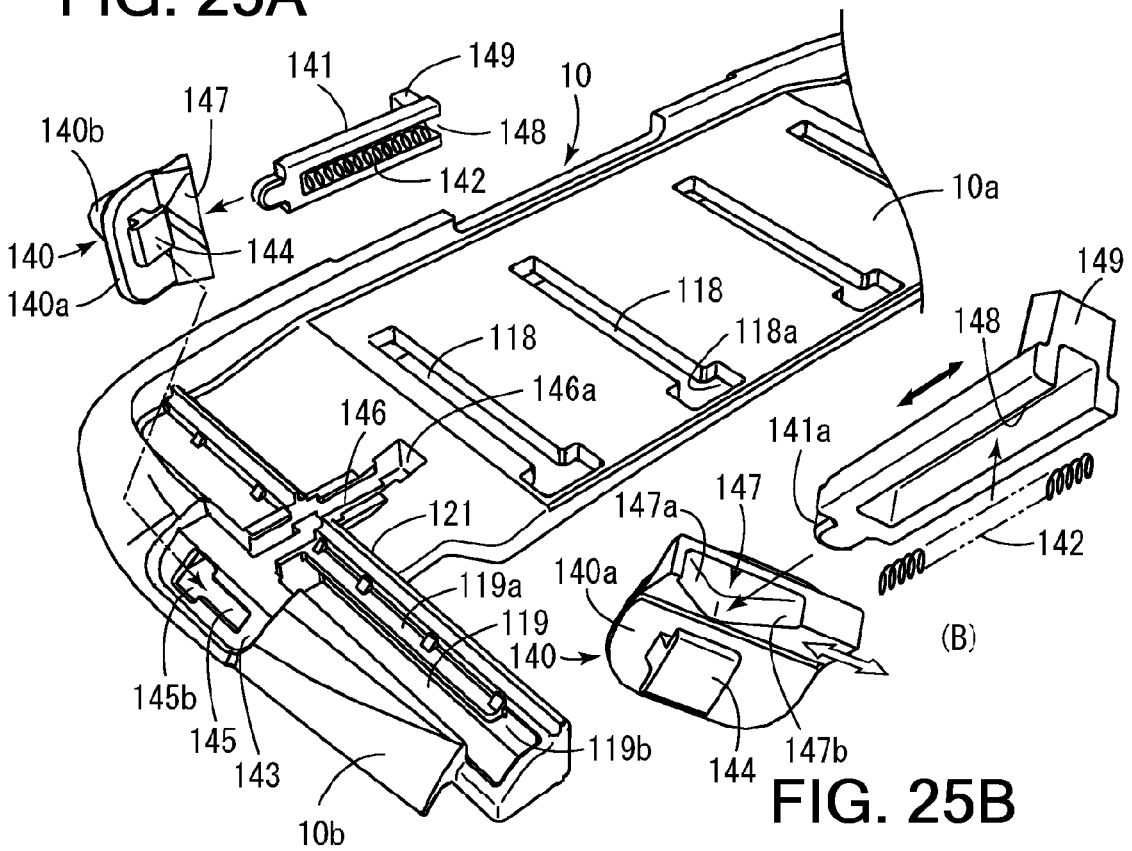
FIG. 25B
FIG. 25C
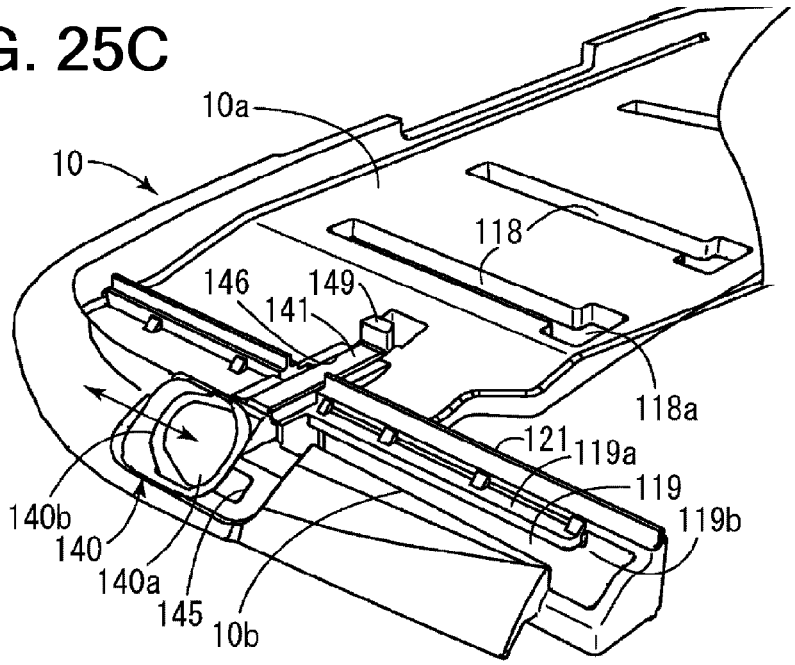

FIG. 28C
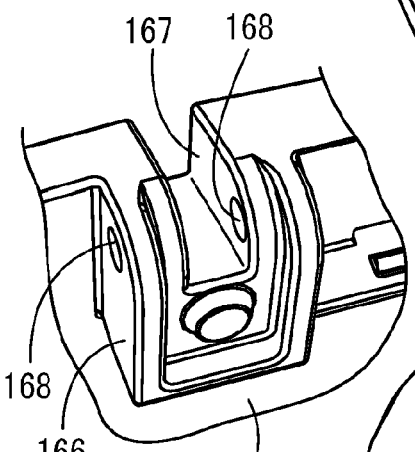
FIG. 28A
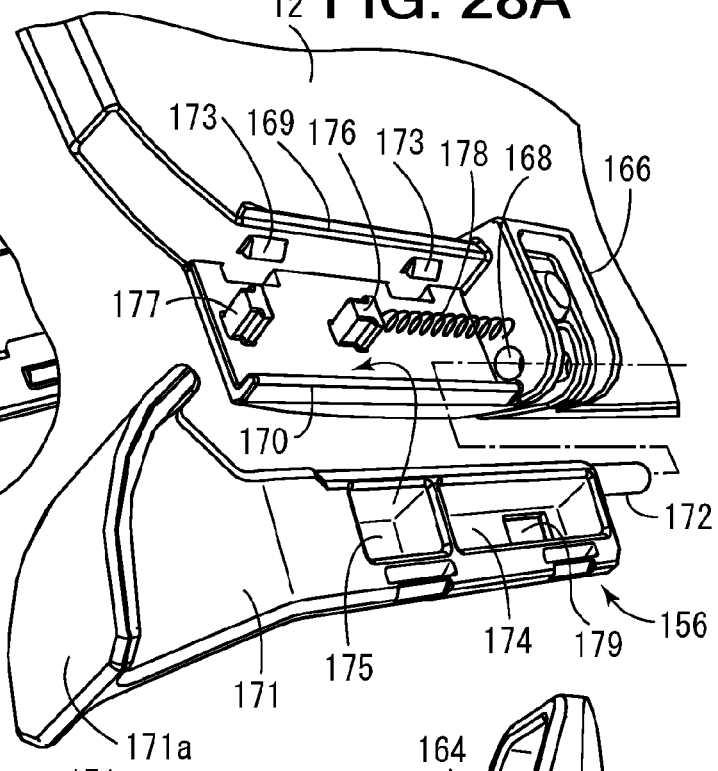
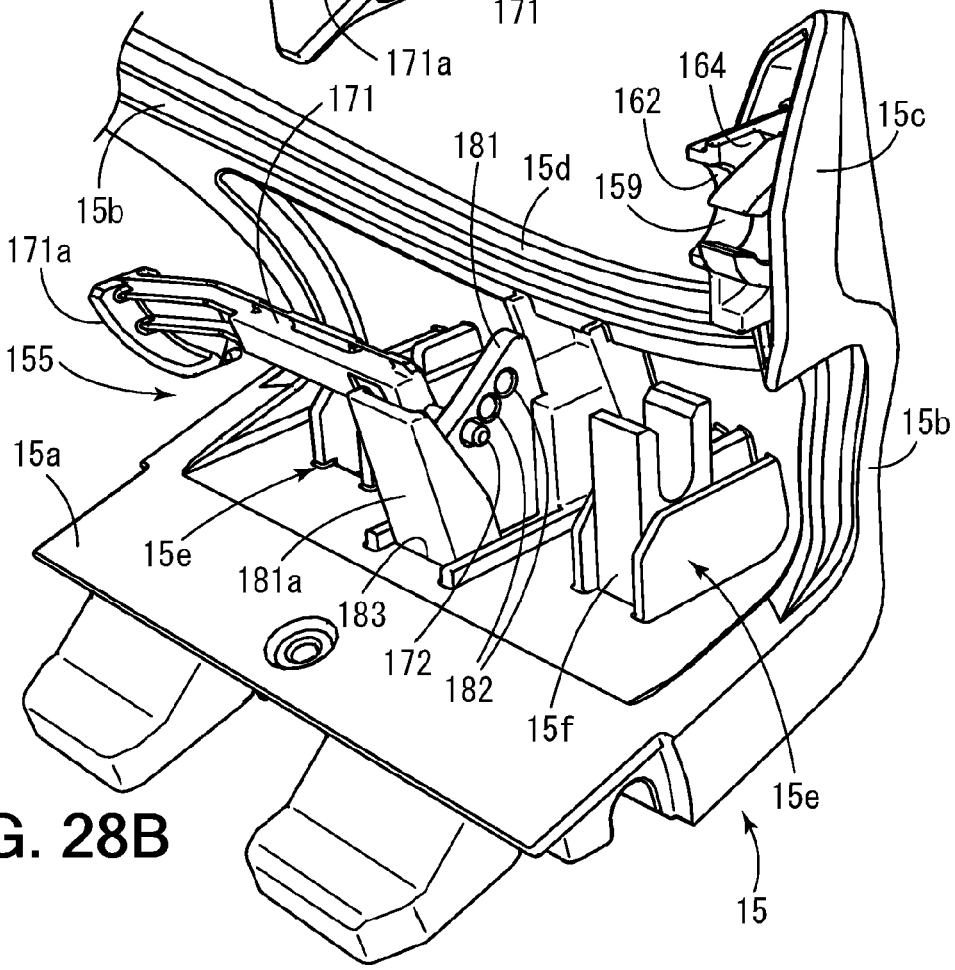
FIG. 28B

ROCKING CHAIR AND SPRING UNIT USED THEREIN

CROSS REFERENCE TO RELATED APPLICATION

This application is a continuation of PCT application No. PCT/JP2012/068095, which was filed on Jul. 17, 2012 based on Japanese Patent Application Nos. 2011-157063 filed on Jul. 15, 2011, 2011-157065 filed on Jul. 15, 2011, 2011-157067 filed on Jul. 15, 2011, and 2011-250621 filed on Nov. 16, 2011, the contents of which are incorporated herein by reference. Also, all the references cited herein are incorporated as a whole.

BACKGROUND OF THE INVENTION

1. Technical Field

The present invention relates to a rocking chair in which a backrest tilts rearwards against a spring portion and, more particularly, to a rocking chair in which the magnitude of resistance of a spring portion to a rearward tilting of the backrest can be adjusted. Furthermore, the present invention includes a spring unit used in the rocking chair.

2. Background Art

A rocking chair includes a spring means that imparts resistance to a rearward tilting of a backrest. However, generally, a resilience adjustment means is provided for changing the magnitude (i.e., magnitude of a reaction force of the backrest acting on a body during rocking) of resistance of the spring means to the rearward tilting of the backrest. A compression coil spring is often used as a spring means. Meanwhile, the resilience adjustment device includes a stepless type using a rotary screw and a step type using a cam or lever.

A mechanism for changing the magnitude of resistance of a spring means is roughly divided into a type of changing the magnitude of initial pressing to the spring means and a type of changing the magnitude of moment acting on the spring means. The former type is disclosed in PTL 1 and PTL 2. In PTL 1 and PTL 2, a compression coil spring is supported by a movable spring mount, the movable spring mount is supported by a peripheral surface cam and an initial elastic force of the compression coil spring is changed by rotating the peripheral surface cam.

On the other hand, PTL 3 discloses a configuration in which a compression coil spring is fitted into two extendable spring mounts and pivotably coupled to one spring mount using the one spring mount as a base and the other spring mount receives the load of rocking. The compression coil spring is pivoted by moving the other spring mount by an adjustment screw having a knob.

Load is applied to a locking spring means even when a person is not leaning against a backrest. Specifically, a pretension (preload) is applied to the spring means. The reason is that the backrest is suddenly largely inclined rearward without resistance by the leaning of a person and this is dangerous when a pretension is not applied to the spring means. Further, in the case of a synchronous type chair in which a seat is tilted rearward in conjunction with the rearward tilting of the backrest, the pretension of the locking spring also serves to hold the seat so that the seat does not tilt rearward just by seating.

PTL 1: JP-A-10-179312

PTL 2: JP-A-11-169254

PTL 3: Japanese Patent Publication No. 2519167

SUMMARY OF THE INVENTION

When a peripheral surface cam as disclosed in PTL 1 and PTL 2 is used as a resilience adjustment means (reaction force adjustment means) of a spring means, there is an advantage that it is possible to adjust the resilience at the time of rocking by one-touch manner. However, in rotating the peripheral surface cam, it is necessary to temporarily compress the coil spring in order to shift the point of action of load to an adjacent cam surface. Therefore, it is essential to enlarge the knob in order to lightly rotate the peripheral surface cam.

On the other hand, in the case of employing a method in which moment is changed by pivoting the spring as in PTL 3, a force required for operating the resilience adjustment is reduced but it is impossible to change the posture of the coil spring unless the adjustment screw is rotated several times, as compared to a case of supporting the coil spring by a cam. Accordingly, there is a problem that an adjustment operation is cumbersome.

The present invention has been made in consideration of such a situation and an object thereof is to provide an improved resilience adjustment mechanism. Further, the present application discloses many improvements and it is also an object of the invention to provide such improvements.

A chair of the present invention includes, as a basic configuration, a seat, a backrest that is tiltable rearward, a locking spring portion that imparts resistance to the rearward tilting of the backrest and a resilience adjustment member that changes the degree of resistance of the spring portion to the rearward tilting of the backrest. Further, the present invention can be variously deployed using the basic configuration as a base. First, a first invention is intended to form a broader concept. In the present invention, the resilience adjustment member is a cam that can be rotationally operated by a person seated and the position in which rocking load due to the rearward tilting of the backrest is applied to the spring portion is changed by the cam, so that moment applied to the spring portion changes and the degree of resistance of the spring portion is adjusted.

The first invention can be variously deployed. In a second invention as a deployment example of the first invention, the rocking chair includes a base that is provided at an upper end of a leg and a back frame that is connected to the base so as to be tiltable rearward. A pushing part is provided at a front end portion of the back frame that is located across a tilting center and on the opposite side of the backrest, the pushing part being brought into contact with the spring portion. The spring portion is a compression coil spring that is long in a longitudinal direction and wound around an axis thereof and attached to the base so as to be pivotable vertically about a front portion thereof and a rear end thereof is configured as a load support part that is pressed by a pressing part of the back frame. The pushing part of the back frame has a circular arc shape that is concave forward, as seen from the side, so as to allow the pivoting of the spring portion.

A third invention is a deployment example of the second invention. In the third invention, the compression coil spring is incorporated in a spring holder that is stretched in a longitudinal direction, the cam is a peripheral surface cam, a plurality of cam surfaces are formed at an outer peripheral surface of the cam and distances of the cam surfaces from an axis are different from each other and, the spring holder is provided with cam mount parts with which a plurality of cam surfaces of the peripheral surface cam is selectively brought into contact.

A fourth invention is a preferred deployment example of the third invention. In the fourth invention, the spring holder comprises two spring mounts that are fitted to each other so as to be slidable in a longitudinal direction and support the spring from one end and the other end and the two spring mounts are inseparably retained in a state where the compression coil spring is pre-compressed. The second invention can be deployed as a fifth invention. In the fifth invention, the rocking chair includes a separation prevention portion that holds the spring portion in a state of being close contact with the cam and the separation prevention portion includes an elastic part that allows the rotation of the cam.

The present invention also includes a spring unit. A sixth invention pertaining to the spring unit includes a compression coil spring and two spring mounts that support the compression coil spring from one end and the other end thereof. The two spring mounts are fitted to each other so as to be stretchable and inseparably held in a state where the compression coil spring is pre-compressed. One mount of the two spring mounts is provided with a load support part to which a rocking load of the chair is applied and the other mount thereof is provided with a connection part that is pivotably connected to a constituent member of the chair.

The present invention is intended to perform the resilience adjustment of rocking by changing moment acting on a locking spring portion but does not change an initial load (pretension) applied to the locking spring. Accordingly, it is possible to prevent or significantly suppress that an elastic restoring force of the spring portion serves as resistance to the rotation of a cam. Therefore, the cam can be operated to lightly rotate even in the case of a compact operation member. In other words, it is possible to lightly perform the resilience adjustment of the locking spring portion by a compact operation member.

However, in the case of PTL 3, when the coil spring is pivoted so that a load supporting point thereof is away from a tilt supporting point of a backrest, the moment acting on the coil spring is decreased and therefore the spring becomes a "rigid" state at the time of rocking. On the contrary, when the coil spring is pivoted so that the load supporting point thereof is close to the tilt supporting point of the backrest, the moment acting on the coil spring is increased and therefore the spring becomes a "soft" state at the time of rocking. When the resilience adjustment is performed by changing the moment in such a way, it is preferable that the coil spring has a constant elastic restoring force, irrespective of the posture thereof.

However, in PTL 3, a surface (working surface of load) which applies moment of rocking to a compression coil spring is in a straight posture, as seen from the side. Therefore, as the compression coil spring is pivoted, the entire length of the compression coil spring changes and an initial elastic force changes. To be described accurately, when the compression coil spring is pivoted so that the point of action of load thereof is away from the tilt supporting point of the backrest, the compression coil spring is stretched and an initial elastic force thereof is decreased. On the contrary, when the compression coil spring is pivoted so that the point of action of load thereof is close to the tilt supporting point of the backrest, the compression coil spring is shrunk and an initial elastic force thereof is increased. Accordingly, expansion and contraction of the compression coil spring acts to cancel the intensity change of moment.

On the other hand, in the second invention of the present application, since the pushing part of the back frame has a circular arc shape that is concave forward, as seen from the side, it is possible to pivot the compression coil spring without changing the length thereof. Therefore, it is possible to change the resilience of rocking to a proper level and also it is possible to more accurately prevent or suppress that an elastic force of the compression coil spring is applied to the cam. In the case of the second invention, it is preferable that the shape of the cam mount part is a circular arc shape of radius of curvature around a pivot support point of the compression coil spring, as seen from the side.

When the compression coil spring is incorporated in an extendable spring holder, as in the third invention, it is possible to more simply realize the posture change of the compression coil spring. In this case, when the constituent members of the spring holder are inseparably held, as in the fourth invention and the sixth invention, not only efforts of managing the members can be reduced but also assembly of the chair becomes easy. Further, since it is possible to prevent or suppress that an elastic force of the compression coil spring is applied to the cam mount part, operability of resilience adjustment can be more improved.

To be described further, although a pretension is applied to the compression coil spring even in a non-rocking state, as described above, members such as the compression coil spring and the spring mount are individually produced as a separate member and then assembled, in a prior art. Therefore, mounting or the like of a movable spring mount is performed in a state where the compression coil spring is shrunk. Accordingly, efforts of managing the components are caused and assembly of the chair is also troublesome. However, since, in the fourth invention and the sixth invention of the present application, the compression coil spring is incorporated in the spring holder in a state where a pretension is applied to the compression coil spring in advance, effort of managing the components can be reduced and assembly of the chair can be performed in an extremely simple manner.

When moment is changed by changing the posture or the like of the spring portion, the spring portion or the like is pressed by the cam surface of the cam and pivoted. However, since, in the case of a simple peripheral surface cam, the spring portion or the like can be pressed but cannot be pulled, it is necessary to maintain, by any portion, reversibility that the spring portion or the like is moved, irrespective of the direction of rotation of the cam.

With regard to this, in the case of providing the separation prevention portion by employing the fifth invention, it is possible to secure the reversibility and therefore it is possible to guarantee the function of the cam. Further, in the case of providing the elastic member in the separation prevention portion, as described in claim 5, the elastic member is temporarily deformed at the time of being shifted to an adjacent cam surface and therefore it is possible to secure a rattling click felling at the time of shifting the cam surface. This is preferable because a person can accurately grasp the adjusting state of resilience.

BRIEF DESCRIPTION OF DRAWINGS

FIGS. 1A to 1C are views showing an appearance of a chair according to a first embodiment, FIG. 1A is a perspective view thereof as seen from the front, FIG. 1B is a perspective view thereof as seen from the rear and FIG. 1C is a side view thereof.

FIG. 2A is an exploded perspective view of the entire chair and FIG. 2B is a longitudinal sectional side view of a back frame.

FIG. 6A is an exploded perspective view in a state where a seat part is turned over, FIG. 6B is an exploded perspective view of a seat outer shell and an intermediate bracket and FIG. 6C is a partial enlarged perspective view of the seat outer shell.

FIG. 8A is a partial exploded perspective view of the supporting mechanism part that centers the base, FIG. 8B is a sectional view taken along a line VIIIA-VIIIA shown in FIG. 7 and FIG. 8C is a sectional view taken along a line VIIIB-VIIIB shown in FIG. 7.

FIG. 12A is an exploded perspective view of the resilience adjustment member, FIG. 12B is an exploded perspective view of a spring holder and FIG. 12C is a perspective view of a spring unit.

FIG. 14A is an exploded perspective view of the intermediate bracket and a lock device and FIG. 14B is an exploded perspective view of the supporting mechanism part.

FIG. 16A and FIG. 16B are exploded perspective views of a resilience adjustment unit according to a second embodiment.

FIG. 20A is a plan view of essential parts and FIG. 20B is a partial sectional perspective view as seen from the side of FIG. 20A.

FIG. 23A is a sectional perspective view taken along a line A'-A' shown in FIG. 20A, FIG. 23B is a sectional perspective view taken along a line B'-B' shown in FIG. 20A and FIG. 23C is a sectional perspective view taken along a line C'-C' shown in FIG. 20A.

FIG. 25A is an exploded perspective view of the seat adjustment operating lever and a slide outer shell, FIG. 25B is an exploded perspective view of the seat adjustment operating lever and FIG. 25C is a perspective view of a portion to which the seat adjustment operating lever is mounted, as seen from the above.

FIG. 28A is an exploded perspective view of an operation tool and the backrest, FIG. 28B is a perspective view of the initial angle adjustment device and FIG. 28C is a perspective view of a lower end portion of a back inner shell.

DESCRIPTION OF EMBODIMENTS

Next, an illustrative embodiment of the present invention will be described with reference to the drawings. First, a first embodiment shown in FIG. 1 to FIG. 14 is described. While phrases of "front and rear" and "left and right" are used for specifying the direction in the following description, the phrases of the front and rear and the left and right are referenced to a seated person. The direction as seen from the front is a direction facing the seated person and therefore the left and right as seen from the front is contrary to the left and right as seen from the seated person.

(1). Outline of Chair

Figure 3:
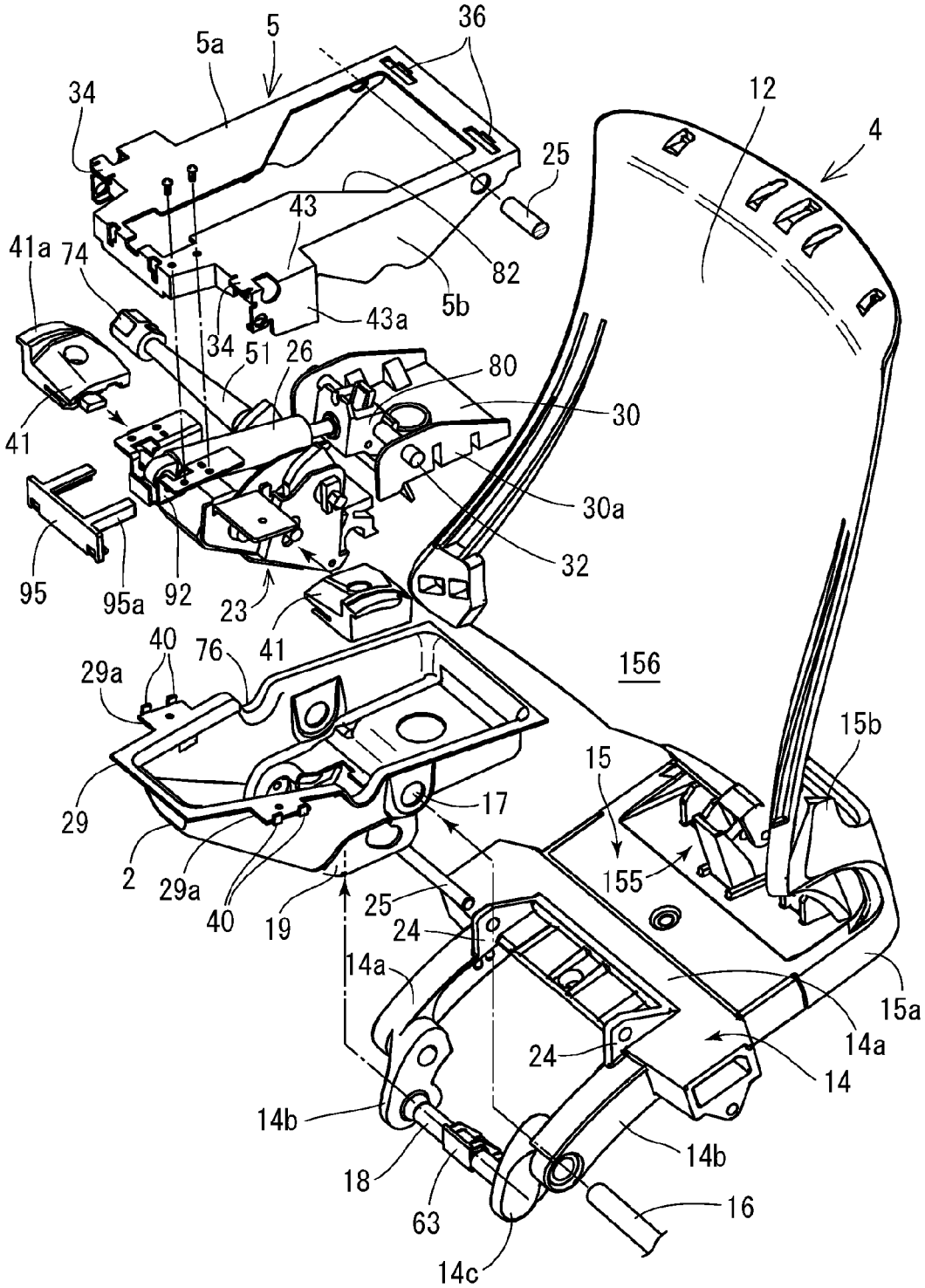
FIG. 3 is an exploded perspective view of the entire chair.

First, an outline of a chair will be described mainly with reference to FIG. 1 to FIG. 5. The present embodiment is applied to a swivel chair that is widely used in an office or the like. As shown in FIG. 1, the chair includes a leg device of which only a leg strut 1 is shown, a base 2 fixed to an upper end of the leg strut 1, a seat 3 disposed on the base 2 and a backrest 4 against which the seated person can lean. For example, as shown in FIG. 2 and FIG. 3, an intermediate bracket (seat-mount bracket) 5 made of metal plate is disposed on the base 2 and a resin seat outer shell 6 is mounted to the intermediate bracket 2.

As shown in FIG. 2, the seat 3 includes a resin seat inner shell (seat plate) 7 and a seat cushion material 8 arranged to overlap with an upper surface of the seat inner shell. The seat cushion material 8 is covered with a skin material such as a cloth from the above. In the present embodiment, the seat outer shell 6 includes a fixed outer shell 9 fixed to the intermediate bracket 5 and a slide outer shell 10 protruded forward from the fixed outer shell. The slide outer shell 10 is mounted to the fixed outer shell 9 so as to be slidable in a longitudinal direction.

Further, as shown in FIG. 2, a certain range on the front side of the seat inner shell 7 is configured as a deformation allowing part 7*c* that can be easily bent and deformed downward, as seen from the side. A front end portion of the deformation allowing part 7*c* is connected to a front end portion of the slide outer shell 10. Therefore, upon sliding the slide outer shell 10 in a longitudinal direction, the deformation allowing part 7*c* of the seat inner shell 7 is stretched forward or wound downward. As a result, it is possible to adjust the length of the seat 3 in a longitudinal direction. It should be noted that the seat outer shell 6 can be considered as a part of the seat and a seat part is configured by the seat 3 and the seat outer shell 6. The deformation allowing part 7*c* is formed with a plurality of slits that is oblong in left and right directions. Details of a structure of the seat 3 will be described later.

As shown in FIG. 1 and FIG. 2, the backrest 4 includes a resin back inner shell (back plate) 12 and a cushion material 13 arranged to overlap with an entire surface of the back inner shell. The cushion material 13 and the back inner shell 12 are completely covered by a bag-like skin material. The backrest 4 forms a lumbar support part that comes into contact with a lumbar spine of a seated person. In other words, as seen in the longitudinal sectional side view, the backrest 4 has a form curved in a forward convex shape so that the part to come into contact with the lumbar spine of the seated person is positioned at the foremost place. It goes without saying that the backrest 4 and the seat 3 can take an arbitrary form/structure.

Figure 5:
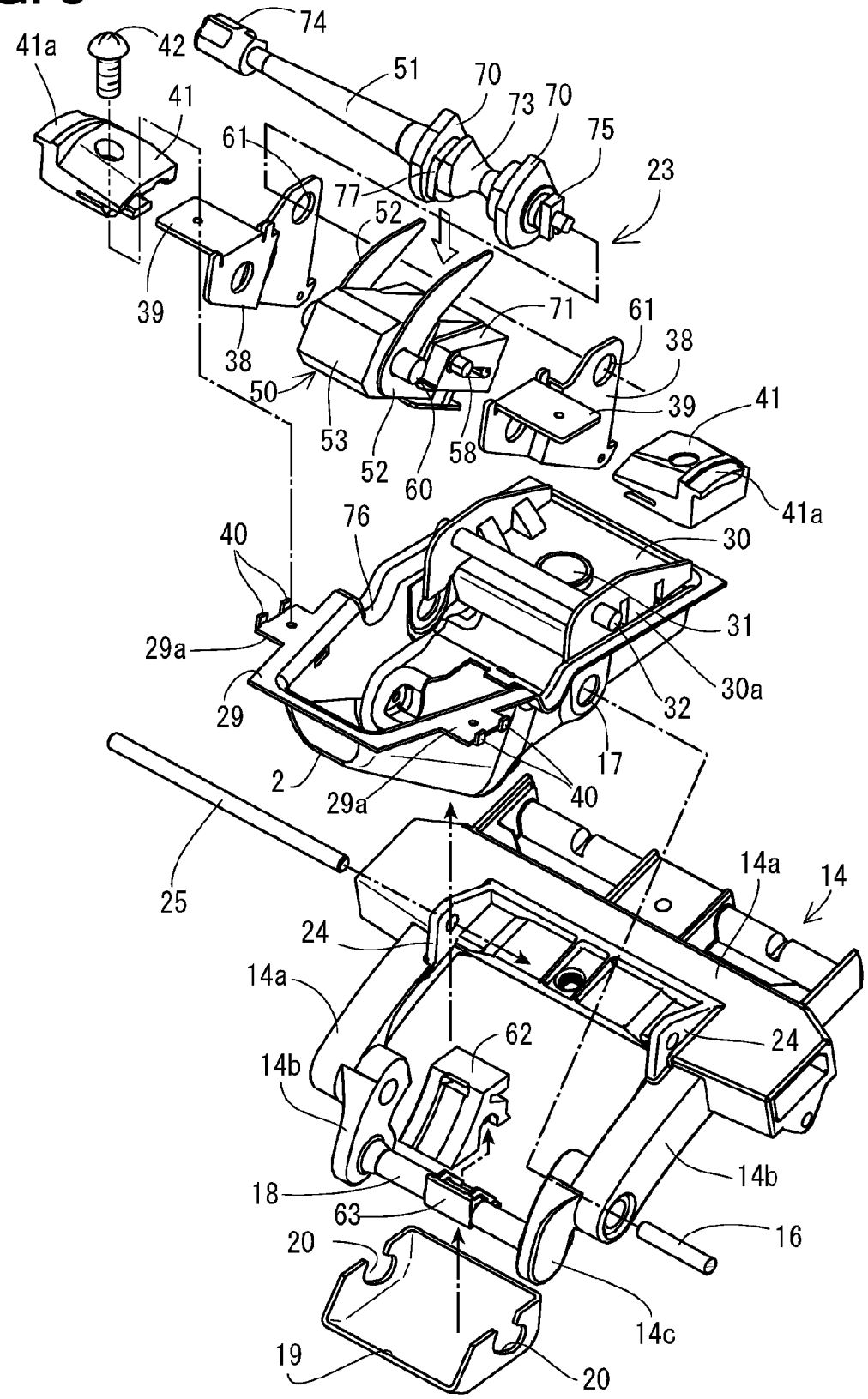
FIG. 5 is an exploded perspective view of the supporting mechanism part.

As shown in FIG. 1C and FIG. 2, a first back frame 14 is connected to the base 2 so as to be tiltable rearward. A second back frame 15 is positioned behind the first back frame 14 and fixed to the first back frame 14. The backrest 4 is mounted to the second back frame 15. The first back frame 14 is made of a resin or aluminum die-cast. As shown in FIG. 3 or FIG. 5, the first back frame 14 includes a base part 14*a* that extends laterally in the rear of the base 2 and arm parts 14*b* that extend forward from both left and right sides of the base part 14*a* at the outside positions of the base 2. Front end portions of the left and right arm parts 14*b* are connected to the base 2 by a first shaft 16 that is oblong in left and right directions. Accordingly, the backrest 4 tilts about an axis of the first shaft 16. It goes without saying that the base 2 is provided with a bearing hole 17 into which the first shaft 16 is fitted (see FIG. 3 and FIG. 5).

Figure 4A:
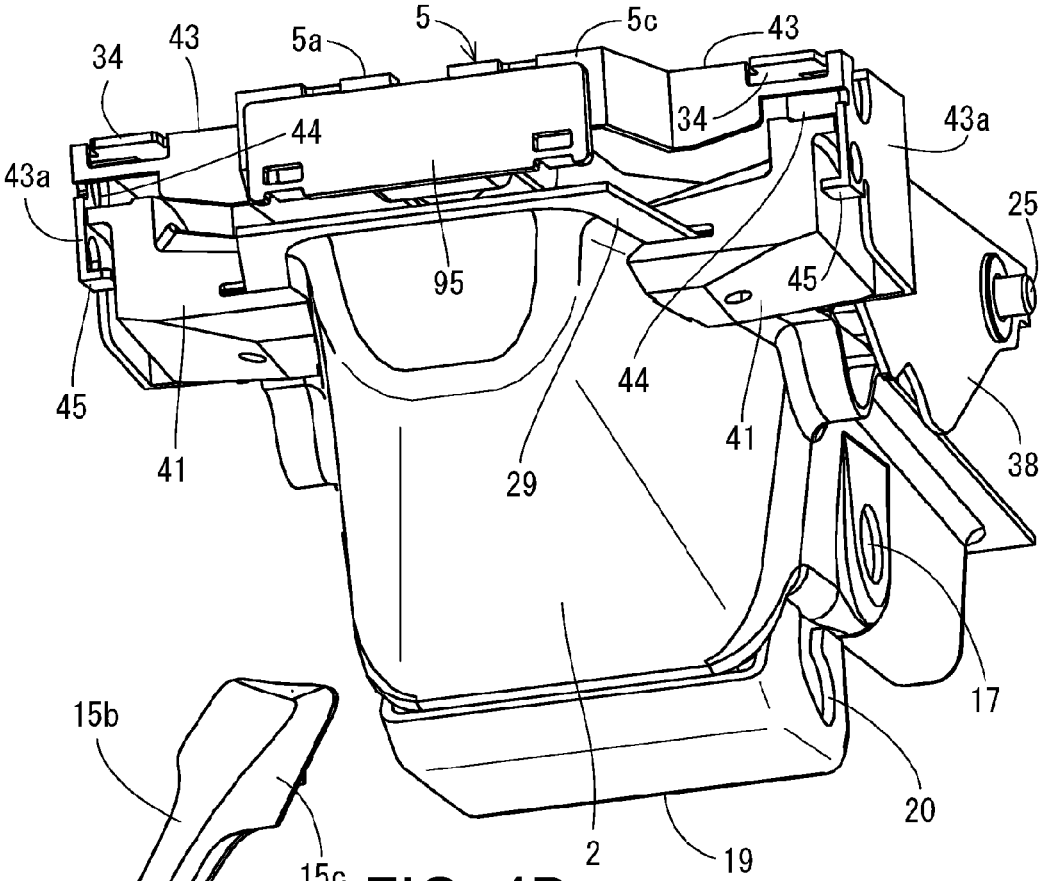
FIG. 4A is a perspective view of a supporting mechanism part as seen from the lower front and FIG. 4B is a perspective view of the supporting mechanism part as seen from the lower side.
Figure 4B:
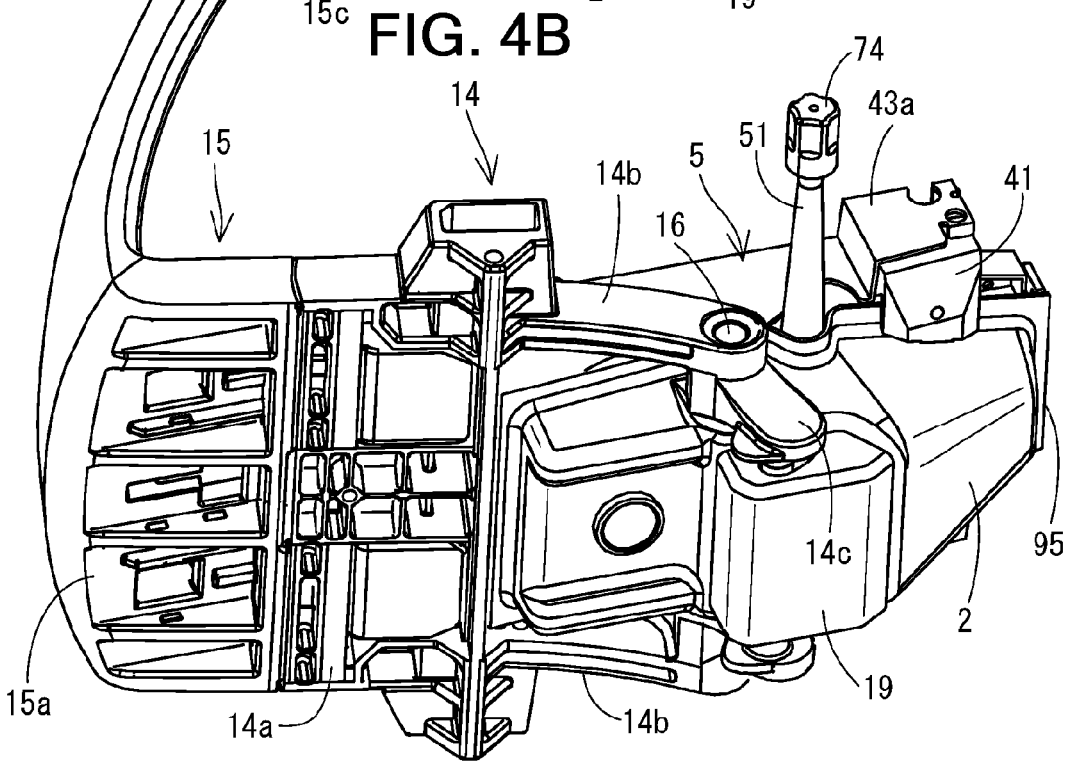

As shown in FIG. 3 and FIG. 4, front portions of the left and right arm parts 14 of the first back frame 14 are configured as crank parts 14*c* that are positioned laterally inward therefrom. The first shaft 16 extends through base end portions of the crank parts 14*c*. Further, front ends of the left and right crank parts 14*c* are integrally connected to each other by a pushing shaft 18 that is oblong in left and right directions. The pushing shaft 18 is covered by a lower cover 19 (see FIG. 5) from the below. At left and right side plates of the lower cover 19, elongate holes 20 that allow the turning of the pushing shaft 18 are opened upward.

As shown in FIG. 2B, a rear portion of the first back frame 14 and a front portion of the second back frame 15 are overlapped with each other from the above and below and fixed to each other by a screw 21. The second back frame 15 is made of a resin or aluminum die-cast and includes a base part 15*a* that extends laterally and two left and right back struts 15*b* that have a square shape and are provided in a rear end of the base part 15*a*. The backrest 4 is connected to head parts 15*c* of the back struts 15*b* in such a way that the backrest is pivotable back and forth around the height position of the lumbar support part. Pivoting postures of the backrest 4 can be changed in a plurality of steps by an initial angle adjustment mechanism, which will be described later.

The back frames 14, 14 and the backrest 4 tilt rearward about the first shaft 16. Thus, as shown in FIG. 2B, FIG. 3 and FIG. 5, a resilience adjustment unit 23 is provided in the inside of the base 2 and imparts resistance to the rearward tilting of the first back frame 14.

The chair of the present embodiment is a synchronous type chair in which the seat 3 is tilted rearward while retreating in conjunction with the rearward tilting of the backrest 4. Thus, as can be inferred from FIG. 3, a front portion of the intermediate bracket 5 is connected to a front portion of the resilience adjustment unit 23 (or a front portion of the base 2) so as to be movable rearward and a rear portion of the intermediate bracket 5 is connected to a bracket part 24 by a second shaft 25 that is oblong in left and right directions. The bracket part 24 is projected upward at the first back frame 14. Further, in the present embodiment, a locking gas cylinder 26 is provided as a lock device for holding the backrest 4 at any rearward tilting angle. The locking gas cylinder 26 is arranged over the resilience adjustment unit 23 in a posture of extending in a longitudinal direction.

(2). Base/Seat Outer Shell

Hereinafter, details of each part will be described with reference to FIG. 6 and later, in addition to the previous figures. First, the base 2 and a relationship between the base 2 and the seat outer shell 6 will be described. For example, as shown in FIG. 3 and FIG. 5, the base 2 is a box-like form that opens upward and a depth thereof becomes shallower toward the front. An outward flange 29 is formed over an entire periphery of an upper end edge of the base 2.

For example, as can be seen from FIG. 3, a bottom of the rear half of the base 2 is uplifted to have a higher portion. A grooved base bracket 30 having a bottom plate and left and right side plates 30*a* is fixed to the higher portion by welding. A bushing 31 that opens vertically is welded to the bottom plate of the base bracket 30 and the bottom plate of the base 2. An upper end of the leg strut (gas cylinder) 1 is fitted into the bushing 31 from the below. Further, a third shaft 32 that is oblong in left and right directions extends through the left and right side plates 30*a* of the base bracket 30. The locking gas cylinder 26 is supported by the third shaft 32 in such a way that the locking gas cylinder 26 cannot move forward. The third shaft 32 is mounted to the left and right side plates 30*a* of the base bracket 30.

For example, as shown in FIG. 3 and FIG. 6B, the intermediate bracket 5 has a shape close to a generally rectangular shape, as seen in a plan view and includes an upper plate 5*a* and left and right side plates 5*b*. The second shaft 25 extends through the side plates 5*b*. As shown in FIG. 2, the side plates 5*b* of the intermediate bracket 5 are located inside of the bracket part 24 of the first back frame 14.

As shown in FIG. 6B, the fixed outer shell 9 is formed with a recessed part 33 that is completely fitted into the intermediate bracket 5. While a pair of left and right forward stoppers 34 is provided on a front end of an upper surface of the intermediate bracket 5, tunnel-like receiving parts 35 are integrally formed on a front end portion of the recessed part 33 of the fixed outer shell 9. The forward stoppers 34 are fitted into the receiving parts 35 from the rear.

Further, while square-like lock holes 36 that are oblong in left and right directions are provided on a rear end portion of the upper plate 5*a* of the intermediate bracket 5, lock claws 37 are projected downward at a rear end portion of the recessed part 33 of the fixed outer shell 9 and fitted into the lock holes 36. The lock claws 37 are fitted into the lock holes 36 after being elastically deformed. In this way, the fixed outer shell 9 is mounted to the intermediate bracket 5 in such a way that the fixed outer shell 9 cannot be separated.

For example, as shown in FIG. 5, the resilience adjustment unit 23 includes a pair of left and right support brackets 38 that are fitted into a front portion of the base 2. The support brackets 38 are made of plate material and disposed inside of an inner surface of the base 2. At a front portion of the support bracket 38, wing parts 39 are projected transversely and overlapped with the outward flange 29 of the base 2 from the above. The outward flange 29 of the base 2 is formed with protruding portions 29*a* that are overlapped with the wing parts 39 of the support brackets 38. The protruding portions 29*a* are provided with stopper pieces 40 that protrude upward. The stopper pieces 40 hold the wing part 39 in such a way that the wing part is not shifted laterally.

Resin slider mounts 41 are fitted into the protruding portions 29*a* of the base 2 and the wing parts 39 of the support bracket 38 from the left and right outside. As shown in FIG. 8B, the slider mount 41, the wing part 39 and the protruding portion 29*a* are fastened together by a screw 42. For example, as shown in FIG. 3, the intermediate bracket 5 is provided with transverse protruding portions 43 that are overlapped with the slider mounts 41 from the above. As shown in FIG. 8C, a resin slider 44 is mounted to a lower surface of an outer end portion of the transverse protruding portion 43 and brought into contact with the slider mount 41 from the above (see also FIG. 4A).

As shown in FIG. 8C, an upper surface of an outer end portion 41*a* of the slider mount 41 that supports the slider 44 has a form curved in an upward convex shape, as seen from the side. Therefore, the intermediate bracket 5 (the seat 3) is smoothly moved during rocking and retreats while being tilted rearward. As shown in FIG. 4A, the transverse protruding portions 43 of the intermediate bracket 5 are provided with wall portions 43*a* that protrude downward. The wall portion 43*a* surround the slider mount 41 from the left and right outside and from the rear.

Meanwhile, as shown in FIG. 8A, an upper region of the outer end portion of the slider mount 41 is configured as protruding portions 41*a* that protrude outward in the left and right directions. As shown in FIG. 4A, stopper pieces 45 (see also FIG. 15A) are bent at the wall portions 43*a* of the intermediate bracket 5 and positioned below the protruding portions 41*a* of the slider mount 41. Accordingly, a front portion of the intermediate bracket 5 is retained so as not to be movable upward. Therefore, the intermediate bracket 5 is not separated from the base 2 even when the front portion of the seat 3 is lifted upward. While the separation preventing function of the intermediate bracket 5 and the base 2 is also performed by other members, this is not associated with the present invention and therefore a description thereof is omitted.

(3). Resilience Adjustment Mechanism

Next, a resilience adjustment mechanism will be described with a focus on the resilience adjustment unit 23. For example, as shown in FIG. 5, the resilience adjustment unit 23 includes a pair of left and right support brackets 38 described above, a spring unit 50 disposed between the left and right support brackets 38, an operation shaft 51 that is rotatably mounted to the left and right support brackets 38 and posture holding members 52 that are mounted to both left and right sides of the spring unit 50. The posture holding member 52 has a substantially L shape, as seen from the side. The posture holding member 52 is an example of a separation preventing portion described in claims.

As shown in FIG. 12, the spring unit 50 includes a cylindrical first spring mount 53 that has a substantially square shape and opens rearward, a compression coil spring 54 that is disposed inside of the first spring mount 53 and a second spring mount 55 that is slidably fitted into the first spring mount 53. A supporting member described in claim is configured by the first spring mount 53 and the second spring mount 55. Since the supporting member of the present embodiment is configured in a hollow case structure, it can be also said that a spring case is configured by both spring mounts 53, 54. Naturally, the spring holder configured by both spring mounts 53, 55 is extendable.

Since the second spring mount 55 has a substantially square shape, an interior of the first spring mount 53 also has a shape close to a substantially square shape. Further, while guide ridges 56 are provided on left and right sides of the second spring mount 55, guide grooves 57 are formed on an inner surface of the first spring mount 53. The guide ridges 56 are fitted into the guide grooves 57. On the basis of the expansion and contraction direction, the first spring mount 53 is not moved and the second spring mount 55 is moved. Accordingly, it is also possible that the first spring mount 53 is referred to as a fixed spring mount and the second spring mount 55 is referred to as a movable spring mount.

As an example of the separation preventing portion, a pin 58 that is oblong in left and right directions penetrates the first spring mount 53 and the second spring mount 55. By forming a pin insertion hole 59 of the first spring mount 53 as an elongated hole that is longitudinally long, the longitudinal sliding of the second spring mount 55 (expansion and contraction of the spring unit 50) is allowed. A front end portion of the first spring mount 53 is provided with a support shaft 60 that protrudes outward in the left and right directions. The support shaft 60 is fitted into a hole 61 provided in the support bracket 38 via a bushing. Accordingly, in the present embodiment, the support shaft 60 is configured as a connection part described in claim. Since the support bracket 38 is fixed to the base 2, the spring unit 50 is vertically pivoted about the support shaft 60.

Further, for example, as shown in FIG. 9 and FIG. 12A, a pusher 62 is mounted to the pushing shaft 18 that is provided on a front end of the first back frame 14. The pusher 62 is adapted to push the second spring mount 55. Accordingly, in the present embodiment, a leading end of the second spring mount is configured as a load receiving part described in claim. The pusher 62 is an example of a pushing part described in claim. While a rear end portion of the second spring mount 55 has a mountain shape that is convex rearward, as seen from the side, a front surface of the pusher 62 is formed as a circular arc surface 62*a* that has a radius of curvature about the support shaft 60, as seen from the side. Further, a leading end of the second spring mount 55 has a mountain shape (wedge shape), as seen from the side, so that the leading end comes into contact with the pusher 62.

Figures 9A, 9B:
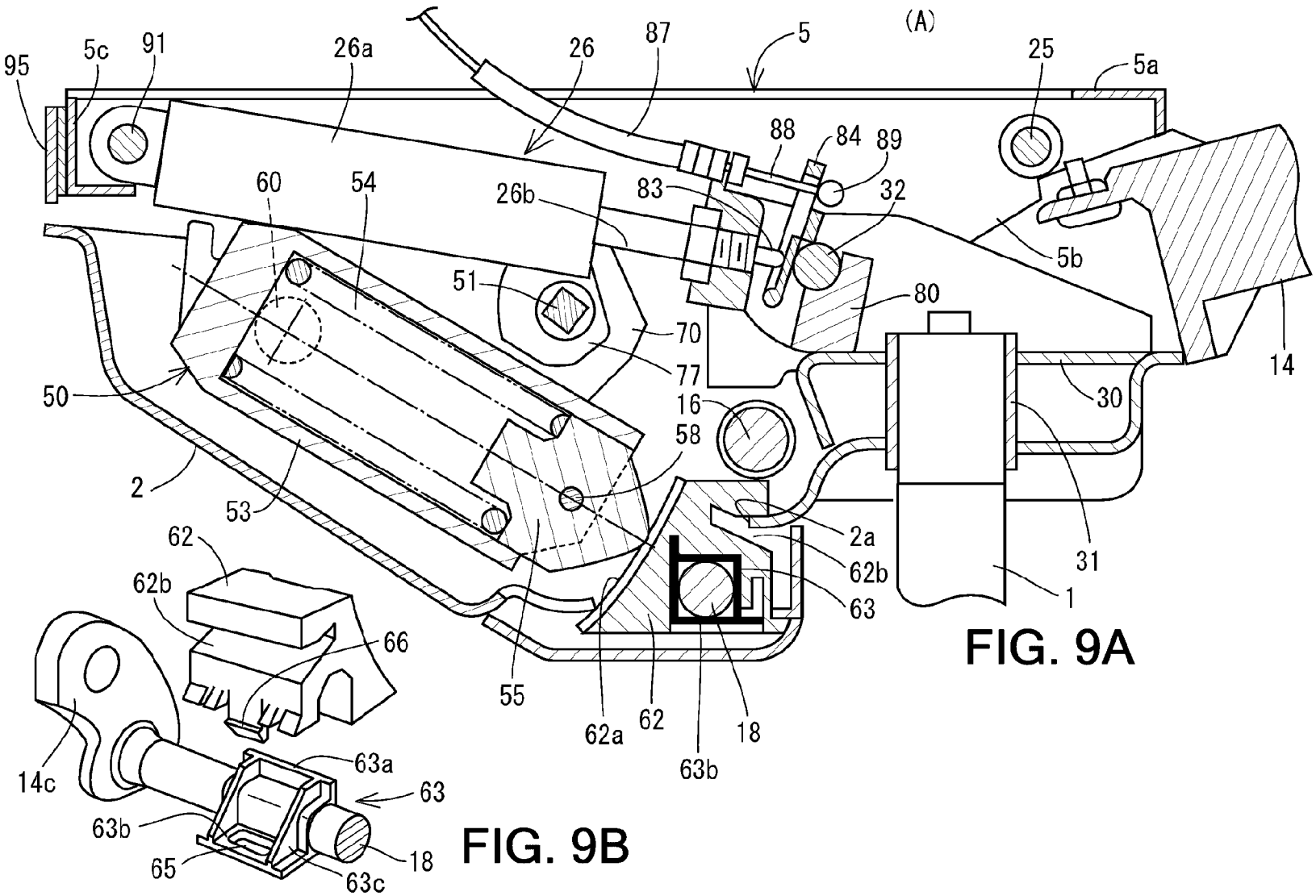
FIG. 9A is a longitudinal sectional side view of the supporting mechanism part and FIG. 9B is an exploded perspective view of a pushing shaft and a spring contact portion.

As can be easily appreciated from FIG. 9B, a positioning member 63 having a front plate 63*a*, a bottom plate 63*b* and left and right side plates 63*c* is fixed to the pushing shaft 18. The pusher 62 is formed with a recessed part 64 that is fitted into the positioning member 63 from the above. Therefore, the pusher 62 is held so as not to be laterally shifted and rotated. A longitudinal groove is formed on the front surface of the pusher 62 in order to prevent one-side hitting with the second spring mount 55. Lining material having excellent wear resistance may be mounted to the front surface of the pusher 62.

Further, as shown in FIG. 9B, while an engaging hole 65 is provided in the bottom plate 63*b* of the positioning member 63, an engaging claw 66 is formed in the pusher 62. The engaging claw 66 is fitted into the engaging hole 65. As the engaging claw 66 is caught by the engaging hole 65, the positioning member 63 is held so as not to be detached from the pushing shaft 18. At a rear surface of the pusher 62, an auxiliary groove 62*b* that opens rearward is formed over an entire lateral length thereof. Upon mounting the first back frame 14, the auxiliary groove 62*b* is intended to temporarily hold the first back frame 14 by being fitted into a forward support piece 2*a* formed in the base 2. The positioning member 63 may be formed integrally with the pushing shaft 18 or the pushing shaft 18 may be produced by a molding (die-cast or casting) and then a pushing part may be provided integrally with the pushing shaft.

Figure 13A:
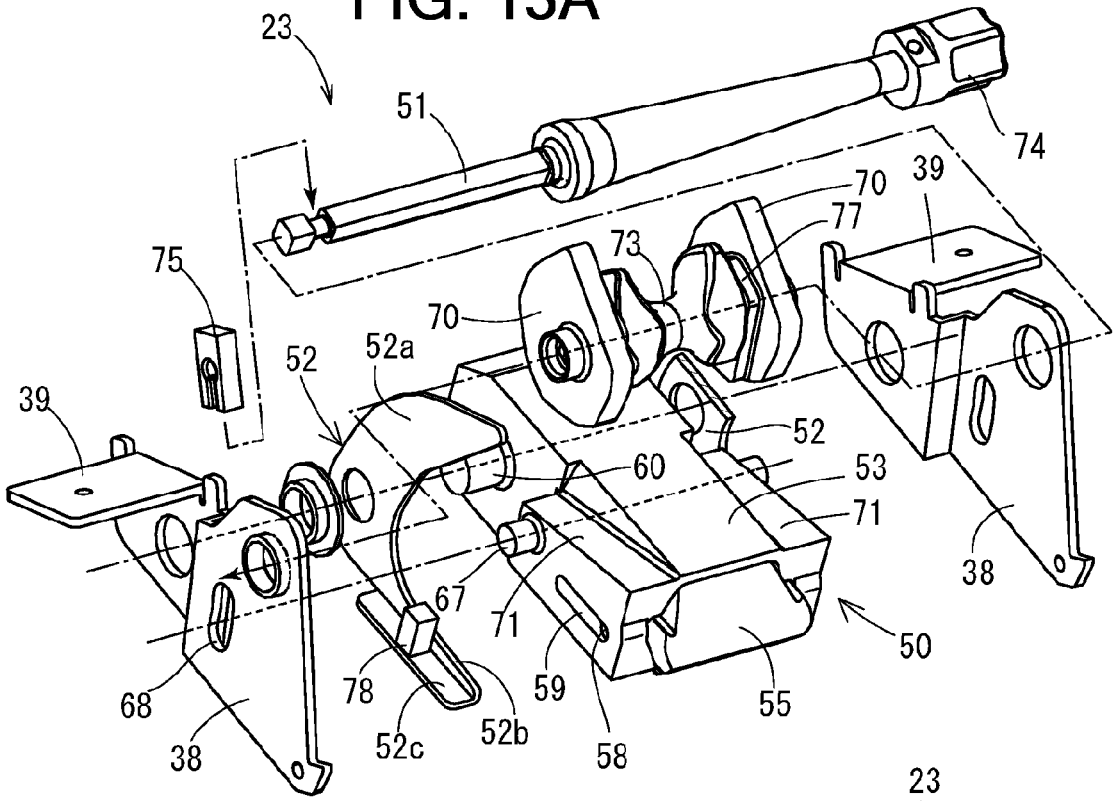
FIG. 13A and FIG. 13B are exploded perspective view of the resilience adjustment member.

For example, as shown in FIG. 13, at a region of the first spring mount 53 which is located behind the support shaft 60, a pair of left and right guide shafts 67 is projected outward in the left and right directions. On the other hand, circular arc-shaped guide holes 68 are formed at the support brackets 38. The guide shafts 67 are fitted into the guide holes 68 so as to be movable. In this way, a pivoting stroke of the spring unit 50 is restricted.

For example, as can be seen from FIG. 12, a pair of left and right peripheral surface cams 70 is fitted into the operation shaft 51. On the other hand, cam mount parts 71 are projected at both left and right sides of the first spring mount 53 configuring the spring unit 50. An outer peripheral surface of the peripheral surface cam 70 comes into contact with the cam mount part 71. As clearly shown in FIG. 10, in the present embodiment, first to fifth cam surfaces 70*a* to 70*e* are formed at the peripheral surface cam 70 in the order where distances e1 to e5 from an axis of rotation are short. Therefore, as the peripheral surface cam 70 is rotated by the operation shaft 51, a posture of the spring unit 50 changes among five postures and a spacing (span) from the first shaft 16 to the second spring mount 55 changes. As a result, it is possible to adjust the magnitude of resistance against rocking in five steps.

The left and right peripheral surface cams 70 are connected to each other via a cylindrical part and formed integrally with one cam member 73. The operation shaft 51 and the peripheral surface cams 70 are adapted to rotate integrally by inserting the square-like operation shaft 51 into the cam member 73. For example, as shown in FIG. 12 or FIG. 14, the operation shaft 51 is rotatably supported by the left and right support brackets 38. Further, one end of the operation shaft 51 protrudes outward of the base 2 and a knob 74 is mounted to the one end. Further, a retaining clip 75 is mounted to the other end of the operation shaft 51. For example, as shown in FIG. 12A, the base 2 is provided with recessed parts 76 into which the operation shaft 51 is fitted. Therefore, it is possible to decrease the height of the operation shaft 51 as low as possible.

For example, as shown in FIG. 13, a posture holding cam part 77 is formed integrally with the inside of the peripheral surface cam 70. Cam surfaces 77*a* to 77*e* are formed at an outer periphery of the posture holding cam part 77 in such a way that distances from an axis have a relationship contrary to the cam surfaces 70*a* to 70*e* of the peripheral surface cam 70. The posture holding peripheral surface cam part 77 is set to a size slightly smaller than the peripheral surface cam 70.

On the other hand, the posture holding member 52 is made of metal plate and is pivotably fitted into the support shaft 60 of the first spring mount 53. The posture holding member 52 includes an upper contact portion 52*a* that comes into contact with the posture holding cam part 77 obliquely from the above and a lower support portion 52*b* that extends rearward so as to be located below the cam mount part 71 of the posture holding member 52. A support piece 52*c* is projected outward at a lower end of the lower support portion 52*b* and three rubbers 78 are supported by the support piece 52*c*. The rubber 78 is an example of an elastic part described in claim and holes 79 for positioning the rubbers 78 is formed in the cam mount part 71. Here, the number of the rubber 78 may be one or more. Instead of the rubber 78, a coil spring may be used. Alternatively, an elastic part may be integrally provided as a part of the posture holding member 52.

The peripheral surface cam 70 and the cam mount part 71 are in a state of being sandwiched by the posture holding member 52 from the above and below. Therefore, the spring unit 50 and the peripheral surface cam 70 are retained in such a way that the spring unit 50 and the peripheral surface cam 70 cannot be separated from each other. Accordingly, the spring unit 50 is pivoted, irrespective of the rotation direction of the peripheral surface cam 70.

Figure 13B:
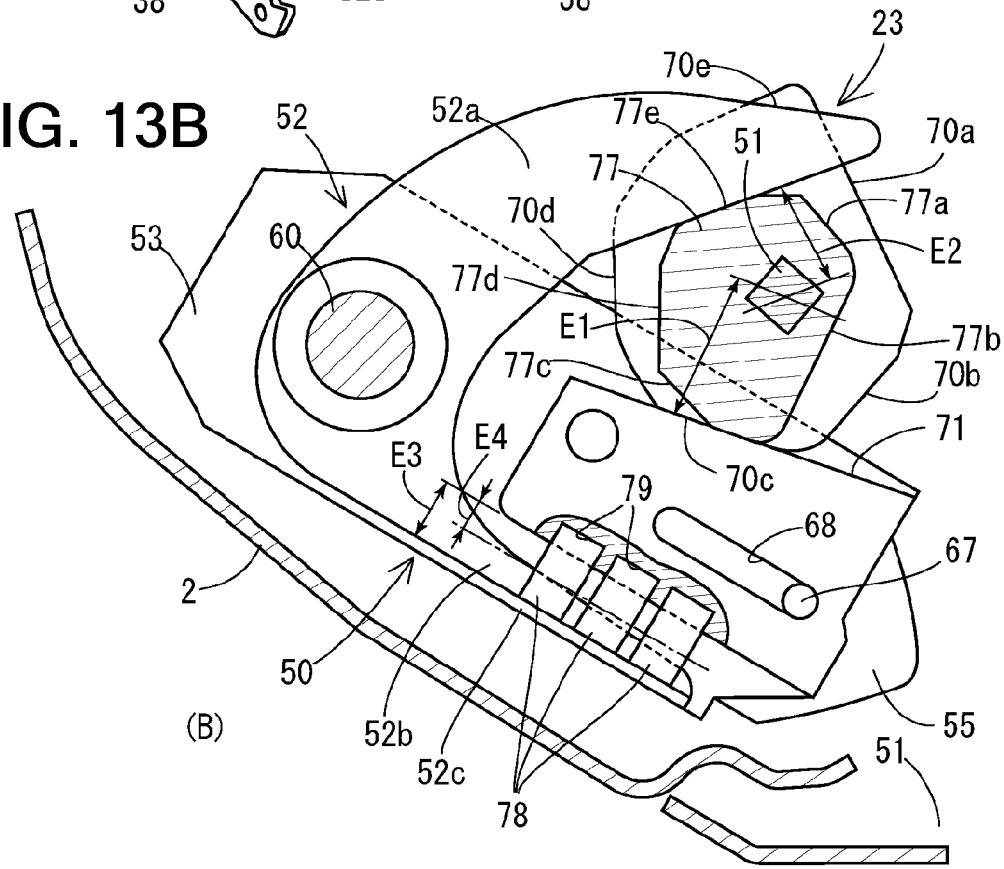

Although the peripheral surface cams 70 are shown in FIG. 13B, a spacing E1 from an axis of the operation shaft 51 to an upper surface of the cam mount part 71 changes and a spacing E2 from an axis of the operation shaft 51 to the posture holding peripheral surface cam part 77 also changes when the peripheral surface cams 70 are rotated. Further, the shape of the posture holding peripheral surface cam part 77 is set so that the dimension (E1+E2) is substantially constant even when the operation shaft 51 is rotated in any manner. As a result, a spacing dimension E3 between a lower surface of the cam mount part 71 and the support piece 52*c* of the posture holding member 52 is held substantially constant. In other words, the posture holding member 52 is also rotated in the pivot direction of the spring unit 50 when the spring unit 50 is pivoted by the rotation of the operation shaft 51. Therefore, the dimension E3 is held substantially constant, irrespective of the posture of the spring unit 50.

Then, in a state where any one of the cam surfaces 70*a* to 70*e* of the peripheral surface cam 70 is in contact with the cam mount part 71, the rubber 78 is slightly compressed or not compressed at all. As the peripheral surface cam 70 is rotated, there occurs a phenomenon that the cam mount part 71 is pushed to compress and deform the rubber 78 and then the cam mount part 71 is pivoted to return by an elastic restoring force of the rubber 78 when a corner portion that is an intersection between adjacent cam surfaces passes over the cam mount part 71. In this way, a user can recognize by feel the fact that the cam surface in contact with the cam mount part 71 is switched and thus the magnitude of the resistance to the rocking changes. In other words, a user's hand can feel a click feeling owing to the changes in the rotation resistance when elasticity changes.

Then, upon rotation of the peripheral surface cam 70, the cam mount part 71 is pushed downward and therefore a spacing dimension between a lower surface of the cam mount part 71 and the support piece 52*c* of the posture holding member 52 is reduced to E4. However, since (E1+E2) is substantially the same at each stage, E4 is held substantially the same at any stage. Therefore, an amount of compressive deformation of the rubber 78 is substantially constant even in switching the elasticity to any stage. Accordingly, rotation resistance (or click feeling) is held substantially constant when the operation shaft 51 is rotationally operated.

(4). Lock Device

Figure 15A:
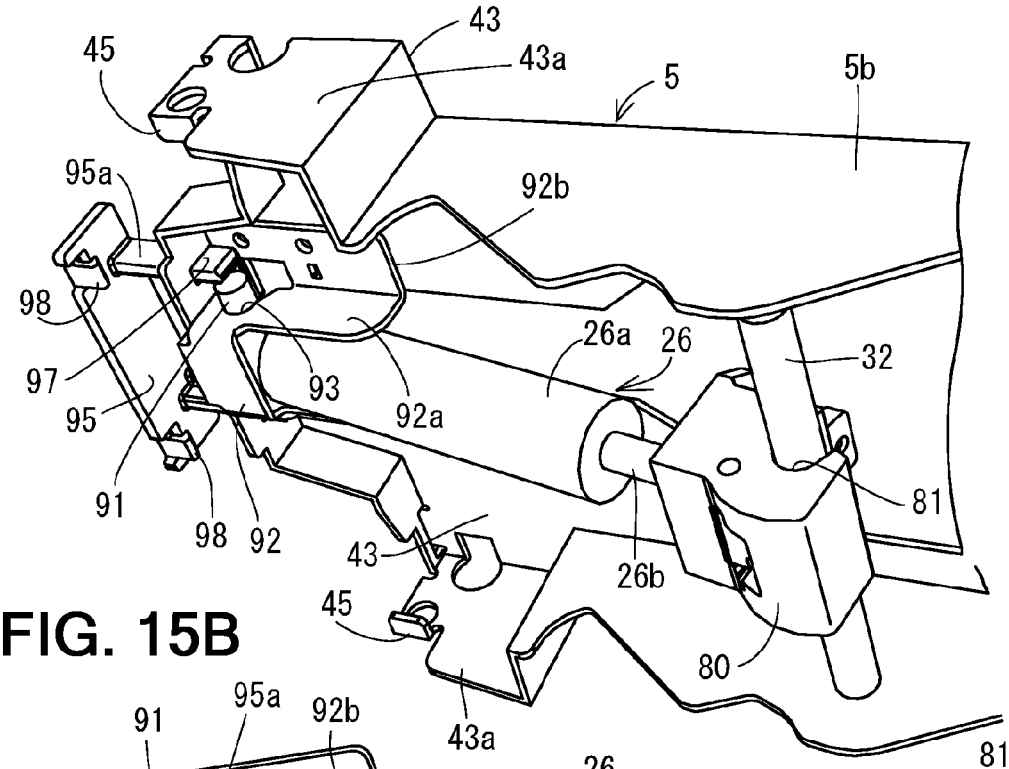
FIG. 15A is a bottom perspective view showing a mounted state of the lock device.

Next, a lock device for controlling the rocking of the backrest 4 will be described mainly with reference to FIG. 14 and FIG. 15. As described above, the lock device includes the locking gas cylinder 26. The locking gas cylinder 26 is commercially available and includes a cylindrical body 26*a* and a rod 26*b* that is slidably fitted into the cylindrical body. In the present embodiment, the rod 26*b* protrudes rearward and a support member 80 made of resin or the like is mounted to a leading end (rear end) of the rod 26*b*. The support member 80 is fitted into the third shaft 32.

Figure 15B:
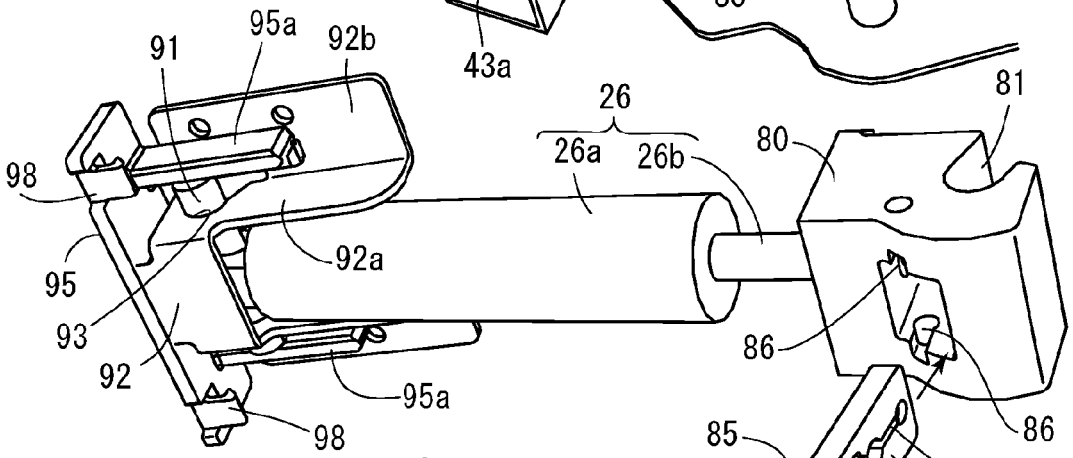
FIG. 15B is a perspective view of the lock device and FIG. 15C is a partially cutaway perspective view showing a retaining structure of the lock device.
Figure 15C:
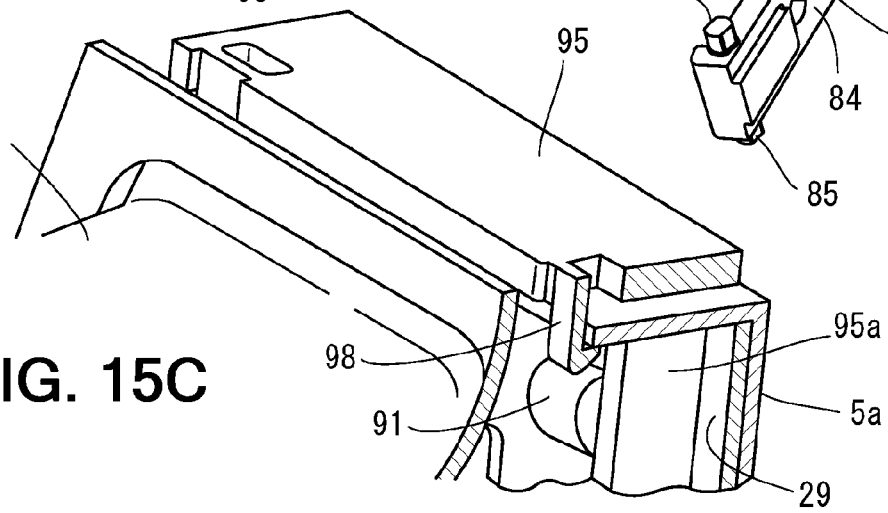

In the support member 80, a mounting groove 81 into which the third shaft 32 is fitted is formed in a state of being opened substantially upward. Accordingly, as shown in FIG. 15B, the locking gas cylinder 26 can be mounted to the third shaft 32 in one-touch type by causing the mounting groove 81 to have a posture of being opened substantially downward, fitting the support member 80 to the third shaft 32 and then changing the posture of the cylindrical body 26*a* to face forward. The mounting of the locking gas cylinder 26 is performed in a state where the intermediate bracket 5 is mounted to the base 2. For this reason, the base 2 is provided with a hole 82 into which the locking gas cylinder 26 can be fitted from the above.

As shown in FIG. 9A, in a state where the locking gas cylinder 26 is set to a predetermined posture, the support member 80 is held by the base bracket 30 in such a way that the support member 80 cannot be dropped down. Accordingly, the locking gas cylinder 26 is inseparably held. As shown in FIG. 15B, a lever piece 84 for operating a push valve 83 of the locking gas cylinder 26 is fitted into the support member 80 from the below. A support shaft 85 is formed at a lower end of the lever piece 84. The support shaft 85 is fitted into a bearing groove 86 that is provided in the support member 80. As shown in FIG. 9A, one end of a cable conduit 87 is fixed to a front upper end portion of the support member 80 and a sphere 89 fixed to one end of a wire 88 inserted through the cable conduit 87 is latched to an upper end of the lever piece 84. As shown in FIG. 16B, the lever piece 84 is formed with an engaging groove 90 into which the sphere 89 is fitted. The sphere 89 can be moved upward along the engaging groove 90.

The other end of the cable conduit 87 is connected to a left portion or right portion of the fixed outer shell 9 and the other end of the wire 88 is connected to a manual operation lever (not shown). The operation lever is adapted to be selectively retained in one of a lock posture and a free posture. In FIG. 9A, the operation lever is in the lock posture. In this state, the backrest 4 is held so as not to be tiltable. When the operation lever is pivoted to the free posture from the state shown in FIG. 9, the lever piece 84 is pivoted so that an upper end thereof moves forward. Thereby, the push valve 83 is pushed and therefore the locking gas cylinder 26 is in an extendable free state. Accordingly, the backrest 4 can be tilted.

A fourth shaft 91 that is oblong in left and right directions is mounted to a front end portion of the locking gas cylinder 26. The fourth shaft 91 is fitted and held to a pin receiving member 92 from the above. The pin receiving member 92 includes left and right bottom plates, left and right side plates 92*a* and flap pieces 92*b*. In other words, the flap pieces 92*b* of the pin receiving member 92 protrude outward from an upper end of the side plates 92*a*. From the above, the fourth shaft 91 is fitted into pin receiving grooves 93 which are cut and formed in the flap pieces 92*b* and the side plates 92*a*. The flap pieces 92*b* of the pin receiving member 92 are fixed to a lower surface of the intermediate bracket 5 by a screw 94.

The fourth shaft 91 is held by a stopper 95 in such a way that the fourth shaft 91 cannot be shifted upward and shifted laterally. The stopper 95 is inserted and mounted to the intermediate bracket 5 from the front. The stopper 95 is made of resin and includes left and right foot members 95*a* extending rearward from the front side plate. As shown in FIG. 15A and FIG. 15B, the left and right foot members 95*a* have L-shapes (as seen in the rear view) so as to surround left and right end portions of the fourth shaft 91 from the outside and above. The fourth shaft 91 is held by the left and right foot members 95*a* in such a way that the fourth shaft 91 cannot be shifted upward and shifted laterally.

A front plate 5*c* is formed at the front end of the intermediate bracket 5. The front plate 5*c* is provided with mounting holes 97 through which the foot members 95*a* of the stopper 95 extend. The foot members 95*a* are overlapped with a lower surface of the intermediate bracket 5. Therefore, bending deformation does not occur even when an upward external force is applied to the fourth shaft 91. As can be clearly understood from FIG. 15C, two left and right engaging claws 98 are projected rearward at a lower end of the front plate of the stopper 95. A leading end (rear end) of the engaging claw 98 has an upward hook shape. The engaging claw 98 is hooked to the front plate 5*c* of the intermediate bracket 5 from the below. It goes without saying that the engaging claw 98 is deformed against elasticity thereof and then hooked to the front plate 5*c* of the intermediate bracket 5. Therefore, the stopper 95 is inseparably held.

Meanwhile, a technique using a gas cylinder as a control portion of a rocking posture is widely used conventionally (for example, Japanese Utility Model Registration No. 2555498). The gas cylinder includes a cylindrical body and a piston rod (plunger) that is fitted into the cylindrical body. Locking is released by pushing and operating a push valve protruding at one end of the piston rod. Generally, while a base end of the cylindrical body is pivotably connected to a base or the like by a pin, a leading end of the piston rod is fixed to a backrest side or the like by a nut. However, an operation such as insertion of the pin or fastening by the nut is troublesome.

The lock device of the present embodiment is intended to solve the above problem and the locking gas cylinder 26 can be simply mounted in one-touch operation by fitting the support member 80 to the third shaft 32 and then fitting the fourth shaft 91 to the pin receiving groove 93 of the flap piece 92*b* and the side plate 92*a*.

(5). Summary

Upon rocking, the pusher 62 moves forward and the second spring mount 55 is pushed so that resistance to the rocking is imparted. Further, the degree of resistance to the rocking can be switched in multiple steps (five steps) by rotationally operating the operation shaft 51 and thus rotating the peripheral surface cam 70. It goes without saying that the switching stage of resilience adjustment is not limited to five steps but can be set to any number of steps.

The pusher 62 may be molded integrally with the pushing shaft 18. However, in a case where the pusher 62 is configured separately from the pushing shaft 18, as in the present embodiment, there is an advantage of being able to improve the function of the pusher 62 by forming the pusher 62 with the material that is different from the first back frame 14 or there is an advantage of being able to simply exchange the pusher 62 when being worn, etc. More specifically, as a preferred aspect, the first back frame 14 and the pushing shaft 18 are configured as an integral molded product made of an aluminum die-cast, for example, and the pusher 62 is made of resin (for example, nylon-based resin or polyacetal, etc.) having excellent strength and wear resistance. Further, it is also possible to eliminate the need for mounting the lining material by forming the pusher 62 with the material having excellent strength and wear resistance.

Figures 10A, 10B, 10C:
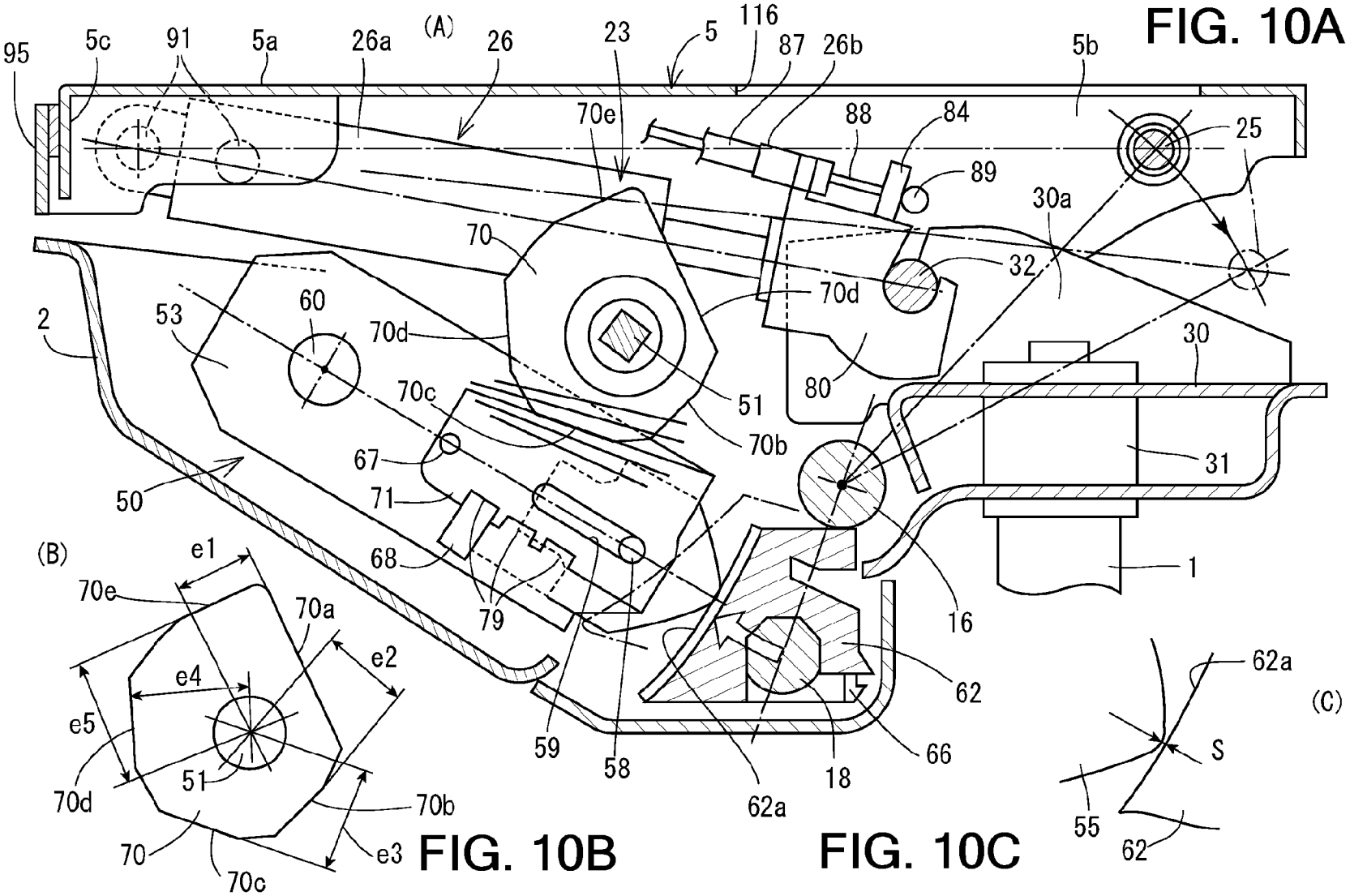
FIG. 10A is an explanatory sectional view taken along a line XI-XI shown in FIG. 7 and FIG. 10B and FIG. 10C are partial enlarged views of FIG. 10A.
Figure 11A:
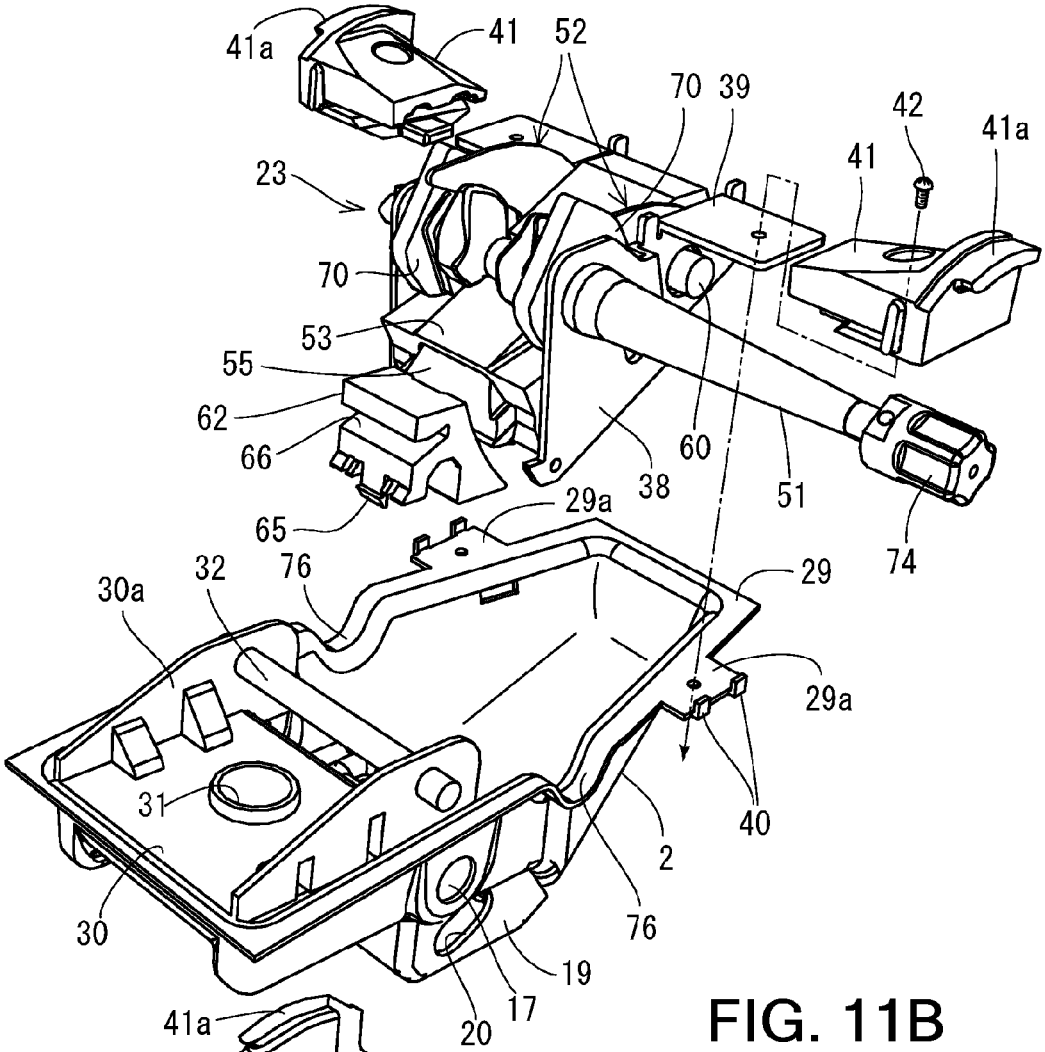
FIG. 11A is an exploded perspective view of a resilience adjustment unit and the base and FIG. 11B is a partial exploded perspective view of the resilience adjustment member.
Figure 11B:
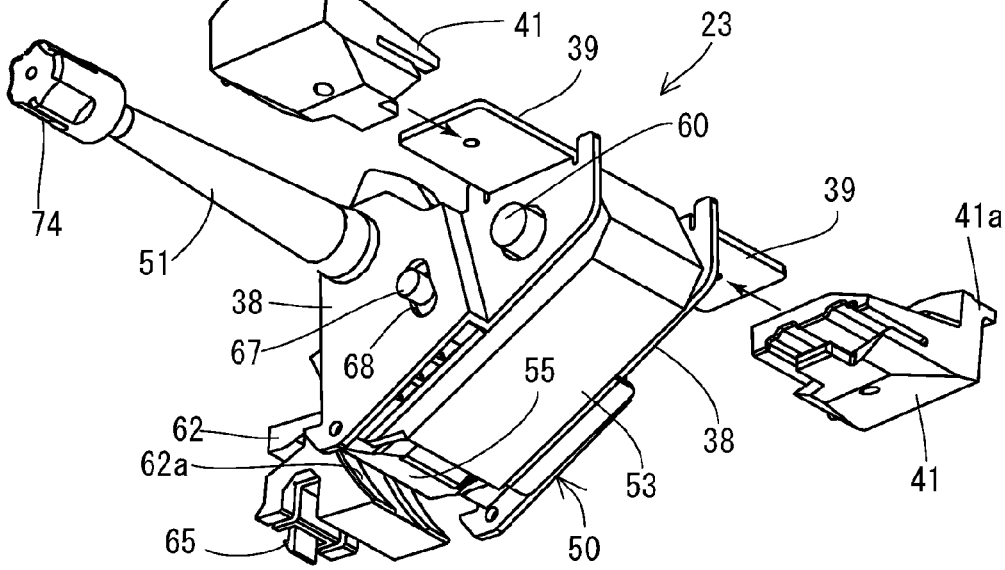

In the present embodiment, as can be appreciated from FIG. 10A, the third shaft 32 that is a support shaft of the locking gas cylinder 26 is disposed at a height position between the first shaft 16 and the second shaft 25 and the height of the fourth shaft 91 does not change significantly even in the case of rocking. Therefore, line of action of the load acting on the locking gas cylinder 26 due to the rocking is in a posture close to an axis of the locking gas cylinder 26. Therefore, it is possible to fully exhibit the ability (elastic restoring force) of the locking gas cylinder 26 as resistance to the rearward tiling of the backrest 4. Further, it is also possible to improve durability of the locking gas cylinder 26.

In the present embodiment, since the spring unit 50 or the support bracket 38 and the operation shaft 51 having the cam member 73 are configured as the resilience adjustment unit 23 of one mass, there is an advantage that it is possible to suppress the efforts of assembly or storage and it is possible to contribute to accuracy up by eliminating unevenness of assembly errors.

The assembly of the support mechanism part is performed in the following procedures. Specifically, the assembly is performed in the order of a step of fitting and mounting the pusher 62 to the pushing shaft 18 in advance and setting the first back frame 14 in the base 2, a step of setting the resilience adjustment unit 23 in the base 2, a step of mounting and fixing the slider 44, a step of inserting the front portion of the intermediate bracket 5 to the slider 44 from the rear, a step of connecting the intermediate bracket 5 and the first back frame 14 to each other by the second shaft 25, a step of setting the locking gas cylinder 26 and a step of setting the stopper 95 to the intermediate bracket 5. The pin receiving member 92 is fixed to the intermediate bracket 5, in advance. Since the number of the screw fastening sites is small in the present embodiment, there is an advantage that it is possible to perform the assembly of the chair more efficiently and more accurately.

(6). Second Embodiment

Figure 17A:
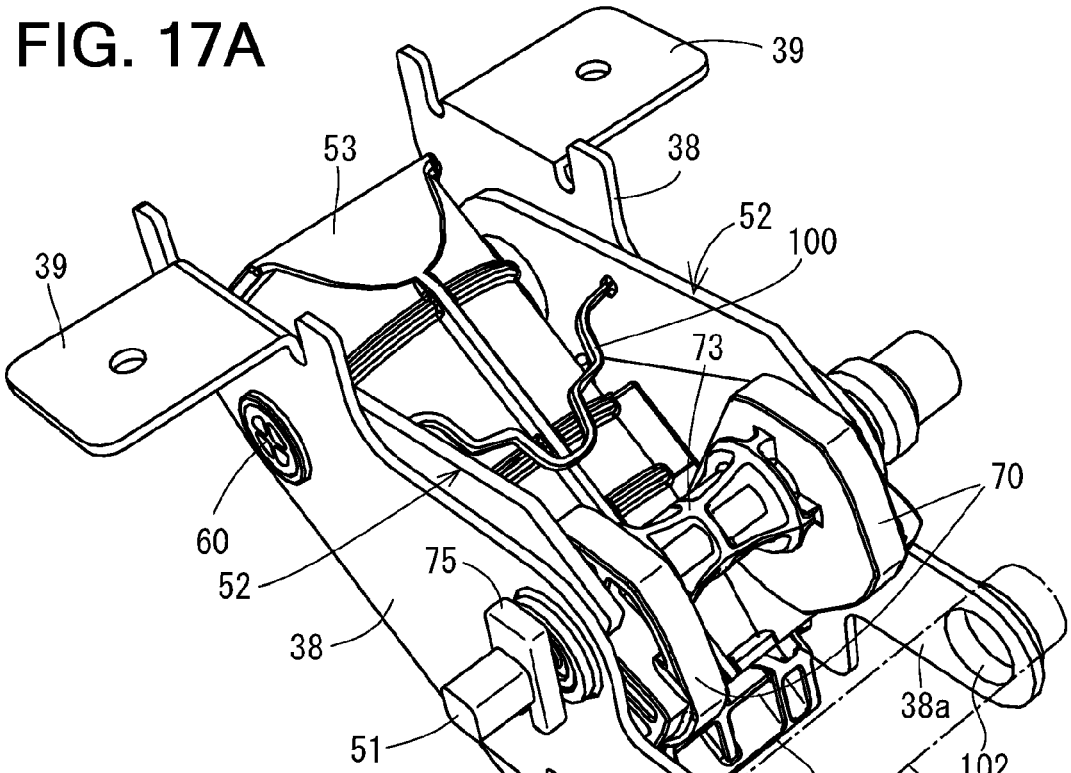
FIG. 17A is a perspective view of the resilience adjustment unit according to the second embodiment and FIG. 17B is an exploded side view showing a relationship between the resilience adjustment member and a base.
Figure 17B:
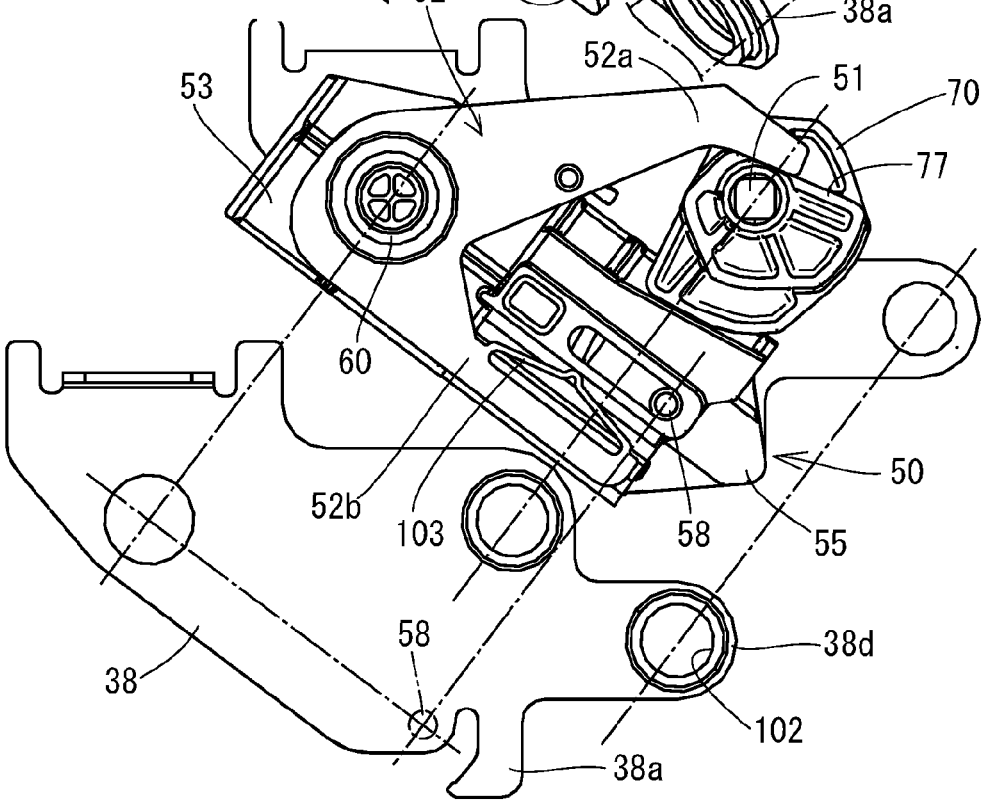

Next, a second embodiment shown in FIG. 16 and FIG. 17 is described. The present embodiment is a modification of the resilience adjustment unit 23 and is mainly different from the first embodiment in that a configuration of a posture holding portion for constantly holding the peripheral surface cam 70 and the spring unit 50 in an overlapped state is different from each other.

In the second embodiment, the posture holding members 52 are made of resin. The left and right posture holding members 52 are connected to each other by a joint 100. A spring part 101 as an example of an elastic part described in claim is provided integrally with the left and right posture holding members 52. From the below, the spring part 101 comes into contact with a guide ridge 71*a* that are projected at the cam mount part 71 of the cylindrical member 51. The spring part 101 is a thin linear form and has a mountain shape that is convex upward, as seen from the side. Accordingly, rotation of the peripheral surface cam 70 is allowed by the flexing deformation of the spring part 101. Since the spring part 101 is molded integrally with the posture holding member 52 in the present embodiment, it is possible to contribute to the assembly operability up or cost saving by reducing the number of parts.

The joint 100 is intended for integrally connecting the left and right posture holding members 52 and has a mountain shape that is convex forward, as seen in a plan view. Therefore, the spacing between the left and right posture holding members 52 can be widened by deforming the joint 100 so as to extend in the left and right directions. As a result, the left and right posture holding members 52 are integrally molded and can be fitted into the support shaft 60 of the first spring mount 53.

It goes without saying that the left and right posture holding members 52 may be separated from each other or may be connected to each other by a separate joint, instead of being integrally molded. The support bracket 38 is provided with a corner portion 38*a* protruding forward. The corner portion 38*a* is provided with a bearing hole 102 into which the first shaft 16 is fitted.

The spring unit 50 often exhibits a tendency to pivot upward when being pressed by the pusher 62. Therefore, the support bracket 38 also exhibits a tendency that a rear portion thereof is floated. However, when the corner portion 38*a* is fitted into the first shaft 16 as in the present embodiment, it is possible to securely prevent the floating of the support bracket 38 with a simple structure. As shown in FIG. 18B, a hook piece 38*a* is formed at a rear lower end of the support bracket 38 and fitted into an engaging hole (not shown) that is provided at the base 2. The floating of the support bracket 38 is also prevented by the hook piece 38*a*. As can be appreciated from FIG. 17B, the pin 58 connecting the second spring mount 55 and the first spring mount 53 is held by the posture holding members 52 in such a way that the pin 58 cannot be separated laterally.

In the first embodiment, as a pivot stroke restricting portion of the spring unit 50, the circular arc-shaped guide holes 68 are formed at the support brackets 38. However, in the present embodiment, the pivot stroke is restricted by the peripheral surface cam 70. Specifically, by referring also to FIG. 13B, when a corner portion between the first cam surface 70*a* and the fifth cam surface 70*e* is conveniently referred to as an end corner portion, the difference between the height (dimension from an axis of rotation) of the first cam surface 70*a* and the height of the end corner portion is set to a dimension larger than the dimension E3 and the difference between the height of the fifth cam surface 70*e* and the height of the end corner portion is set to a dimension larger than the dimension E3. By doing so, the end corner portion of the peripheral surface cam 70 is not able to rotate by being blocked by the cam mount part 71 even when transition from the first cam surface 70*a* to the fifth cam surface 70*e* or transition from the fifth cam surface 70*e* to the first cam surface 70*a* is performed. Therefore, the structure is simplified. Of course, a stroke restricting portion such as an elongated hole may be separately provided, similar to the first embodiment.

(7). Other Embodiments/Others

Figure 18A:
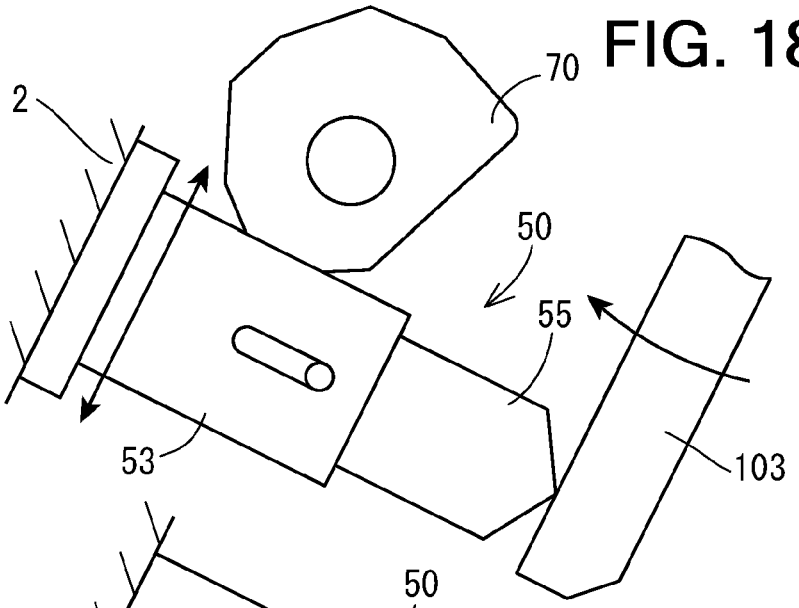
FIGS. 18A to 18C are schematic views showing third to fifth embodiments.
Figure 18B:
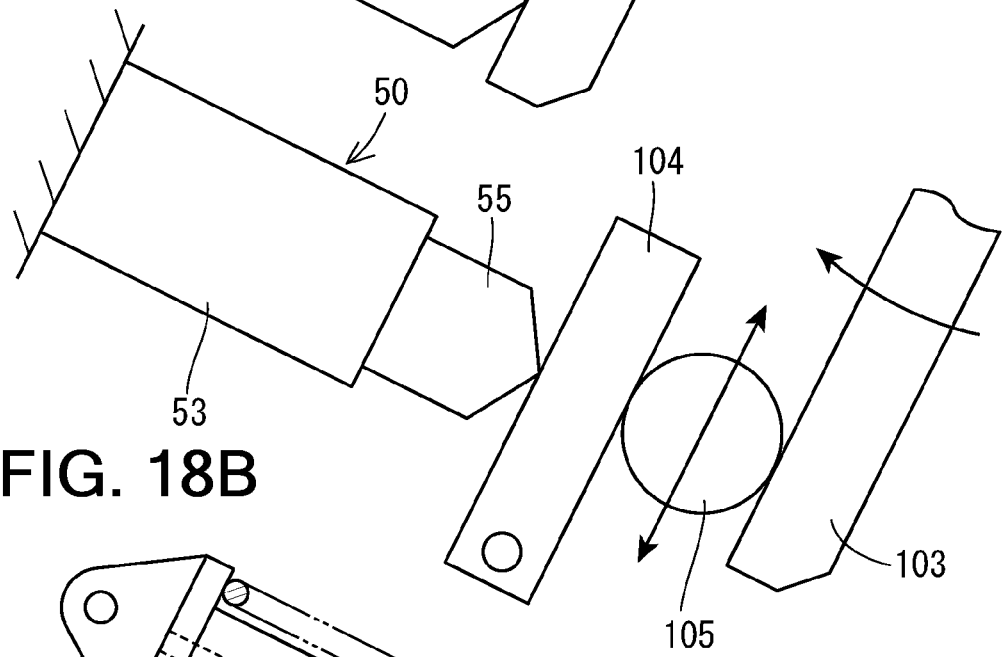

Other embodiments are schematically shown in FIG. 18. In a third embodiment shown in FIG. 18A, the moment from the pushing part 103 is changed by sliding the spring unit 50 in a direction perpendicular to an axis thereof. That is, in the present embodiment, the resilience adjustment is performed by transversely sliding the whole spring unit 50 by the peripheral surface cam 70.

In a fourth embodiment shown in FIG. 18B, the spring unit 50 has a fixed position and posture whereby the spring unit can be just stretchable. Further, an intermediate pivoting member 104 and a sliding member 105 are disposed between the second spring mount 55 and the pushing part 103. The intermediate pivoting member 104 comes into contact with the second spring mount 55 and the sliding member 105 transmits the load of the pushing part 103 to the intermediate pivoting member 104. Moment is changed by sliding the sliding member 105 in a direction perpendicular to an axis of the spring unit 50. Although not shown, the sliding member 105 is moved by the peripheral surface cam. The present invention may be applied to these types. In the case of this embodiment, a leaf spring, a torsion bar or the like may be used as the locking spring portion.

Figure 18C:
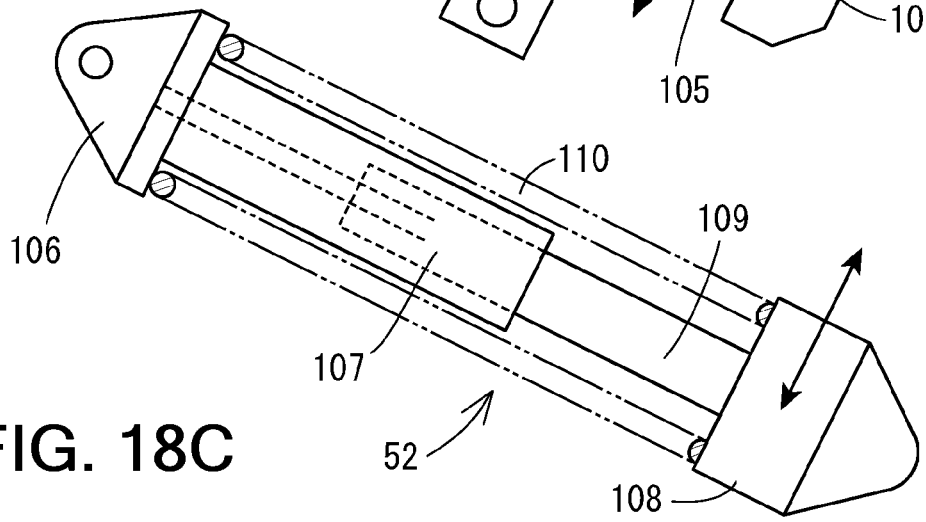

A fifth embodiment shown in FIG. 18C illustrates another example of a holding structure of a spring. In the present embodiment, while a cylindrical body 107 is provided in a fixed spring mount 106 which is pivotably connected to the base 2, an inner shaft 109 is provided in a movable spring mount 108 which receives the load of a pushing part (not shown). The inner shaft 109 is slidably fitted into the cylindrical body 107. A compression coil spring 110 is fitted into the cylindrical body 107 and the inner shaft 109 from the outside. Accordingly, the compression coil spring 110 is exposed. Further, in the present embodiment, the posture of the spring unit 50 is changed by causing the peripheral surface cam to push the movable spring mount 108. The fixed spring mount 106 and the movable spring mount 108 are held by a retaining portion such as a bolt so as not to be separated from each other.

The present invention can be embodiment in various ways, in addition to the above embodiments. For example, the present invention is not limited to a movable swivel chair but can be applied to a fixed chair such as a theater chair. Components such as the base can take various forms, as necessary. The cam is not necessarily limited to the peripheral surface cam but can employ an end surface cam or grooved cam, etc. As a portion for holding the cam and the spring portion so as not to be separated from each other, a method of pulling the cam and the spring portion just by a spring may be employed.

As a connection part of the spring unit, a pin hole may be provided in either of the first spring mount or the second spring mount. In the spring unit, it is essential that the first spring mount and the second spring mount are stretched. However, the spring may be exposed to the outside.

(8). Background Art of Seat and Features of Present Example

Next, details of a seat and a support mechanism part therefor will be described. Meanwhile, as a technique for adjusting a longitudinal length (depth of front end) of a seat in a chair, a method of winding a front portion of the seat downward has been suggested (for example, Japanese Examined Patent Publication No. Hei 07-77567). In this prior art, the front portion of the seat is configured as a deformation allowing part, a front end of the deformation allowing part is fixed to a front bar that is oblong in left and right directions and the front bar is longitudinally moved whereby the deformation allowing part is wound or stretched. A side bar extending rearward is fixed to both left and right end portions of the front bar. The side bar is supported by a mount member so as to be slidable longitudinally.

As an operation method for adjusting the longitudinal length of the seat, a person grabs a front end portion of the seat by hand and pulls or pushes the grabbed portion longitudinally or the side bar is longitudinally moved by an operation tool that is provided separately. However, since a body pressure of a person is applied to the side bar in a state where a person is seated on the chair, it is difficult to adjust the longitudinal length of the seat by a person seated. Therefore, in some cases, an operation of changing the longitudinal length of the seat should be performed in a state where a seated person lifts his waist. Accordingly, there is a problem that the longitudinal length adjustment (depth adjustment) of the seat is troublesome. The present application provides a chair having improved such a situation.

A basic configuration of the chair disclosed herein is as follows. The chair includes a seat part and a chair. The seat part includes a seat inner shell having a cushion function and a seat outer shell that supports the seat inner shell from the below. A front portion of the seat inner shell is configured as a deformation allowing part that can be wound downward whereby the longitudinal length of the seat can be adjusted.

In the above basic configuration, the seat outer shell includes a fixed outer shell that configures at least a rear half of the seat outer shell and a slide outer shell that has a portion protruding to the front of the fixed outer shell. The slide outer shell is mounted to the fixed outer shell in such a way that the slide outer shell is movable longitudinally. The front portion of the seat inner shell can be wound downward by connecting the front end portion of the seat inner shell to the front end portion of the slide outer shell.

Furthermore, the slide outer shell has a wide spread surface so as to support the seat inner shell over a wide range, a body pressure of a seated person is mainly supported by the fixed outer shell and a downward pressing force of the seat inner shell is hardly applied to the slide outer shell.

In the present invention disclosed herein, the longitudinal length of the seat is changed by moving the slide outer in a longitudinal direction. However, since the fixed outer shell configures at least the rear half of the seat outer shell, most of the body pressure of a seated person can be supported by the fixed outer shell in a normal seating state where a back of a person abuts against the backrest, for example. Further, since the slide outer shell is not pressed by the seat inner shell from the above in a state where the body pressure of the seated person is mainly supported by the fixed outer shell, little or no load is applied to the slide outer shell in a normal seating state. As a result, it is possible to adjust the longitudinal length of the seat by a person seated. Therefore, the chair has excellent operability and is user-friendly.

Further, in the present invention, since the slide outer shell has a wide spread surface, the seat inner shell is not excessively deformed and securely supported by the outer shell even when the body pressure of the seated person is applied to the front portion of the seat. Therefore, the support strength is excellent. Further, since the seat inner shell is supported by the slide outer shell over a wide area when the seat inner shell sinks or comes into contact with the slide outer shell by the body pressure of the seated person, there is no problem that the seat inner shell is largely deformed over a local range and thus gives a push-up feeling to the thigh of the person. Accordingly, the comfortable feeling is excellent. In other words, it is possible to adjust the longitudinal length of the seat without sacrificing the comfortable feeling or strength.

(9). Seat Inner Shell

The seat inner shell 7 is a molded product made of resin such as PP. For example, as clearly shown in FIG. 20 and FIG. 21, the seat inner shell 7 includes a main support part 7*a* to which the body pressure of the seated person is strongly applied, a rear support part 7*b* which is located behind the main support part 7*a* and the deformation allowing part 7*c* which is located in front of the main support part 7*a*, as described above. Schematically, the main support part 7*a* occupies a range slightly smaller than a half of the longitudinal length and the rear support part 7*b* and the deformation allowing part 7*c* occupy a range slightly greater than a quarter of the longitudinal length.

A plurality of intermediate slits 112 is formed at the main support part 7*a* of the seat inner shell 7. Further, the main support part 7*a* and the rear support part 7*b* are connected only at left and right sides. A releasing groove 113 that is oblong in left and right directions is formed between the main support part 7*a* and the rear support part 7*b*. Therefore, the downward stretching deformation of the main support part 7*a* by the body pressure of the seated person is allowed.

Horizontally long front slits 114 are formed at the deformation allowing part 7*c* of the seat inner shell 7 by three rows in a lateral direction and multiple rows (multiple steps) in a longitudinal direction. With the presence of the group of these front slits 114, the deformation allowing part 7*c* is allowed to be wound downward in a posture of being extended linearly, as seen from the side.

Bridge portions 115 are formed at an intermediate portion and left and right ends in a lateral direction of the deformation allowing part 7*c*. The bridge portion 115 has an inverted U shape, as seen from the side. Strip-like portions that are longitudinally divided across the front slit 114 are connected to each other by the bridge portions 115. With the presence of the inverted U-shaped bridge portions 115, the deformation allowing part 7*c* can be largely stretched in a longitudinal direction and therefore the wound deformation can be securely performed without resistance.

(10). Seat Outer Shell

The fixed outer shell 9 and the slide outer shell 10 to configure the seat outer shell 6 are molded products made of resin such as PP. For example, as can be appreciated from FIG. 21A, a front end of the fixed outer shell 9 is extended to a rear portion of the deformation allowing part 7*c* of the seat inner shell 7 (here, the slits are omitted in FIG. 21A). A plurality of ribs is formed at an upper surface of the fixed outer shell 9 in order to increase the rigidity. A through hole 116 is formed at the fixed outer shell 9 and allows the main support part 7*a* of the seat inner shell 7 to be largely sunk.

For example, as shown in FIG. 6, the slide outer shell 10 includes a base part 10*a* having a wide spread surface whose lateral width is substantially the same as the fixed outer shell 9 and arm parts 10*b* which are projected rearward from both left and right sides of the base part 10*a*. The base part 10*a* is configured in such a way that a rear portion thereof is always overlapped with the fixed outer shell 9 from the above even in a state of being fully advanced. When the base part 10*a* fully retreats, almost the whole of the base 10*a* is overlapped with the fixed outer shell 9. The arm part 10*b* is always overlapped with the fixed outer shell 9 from the above.

Figure 19:
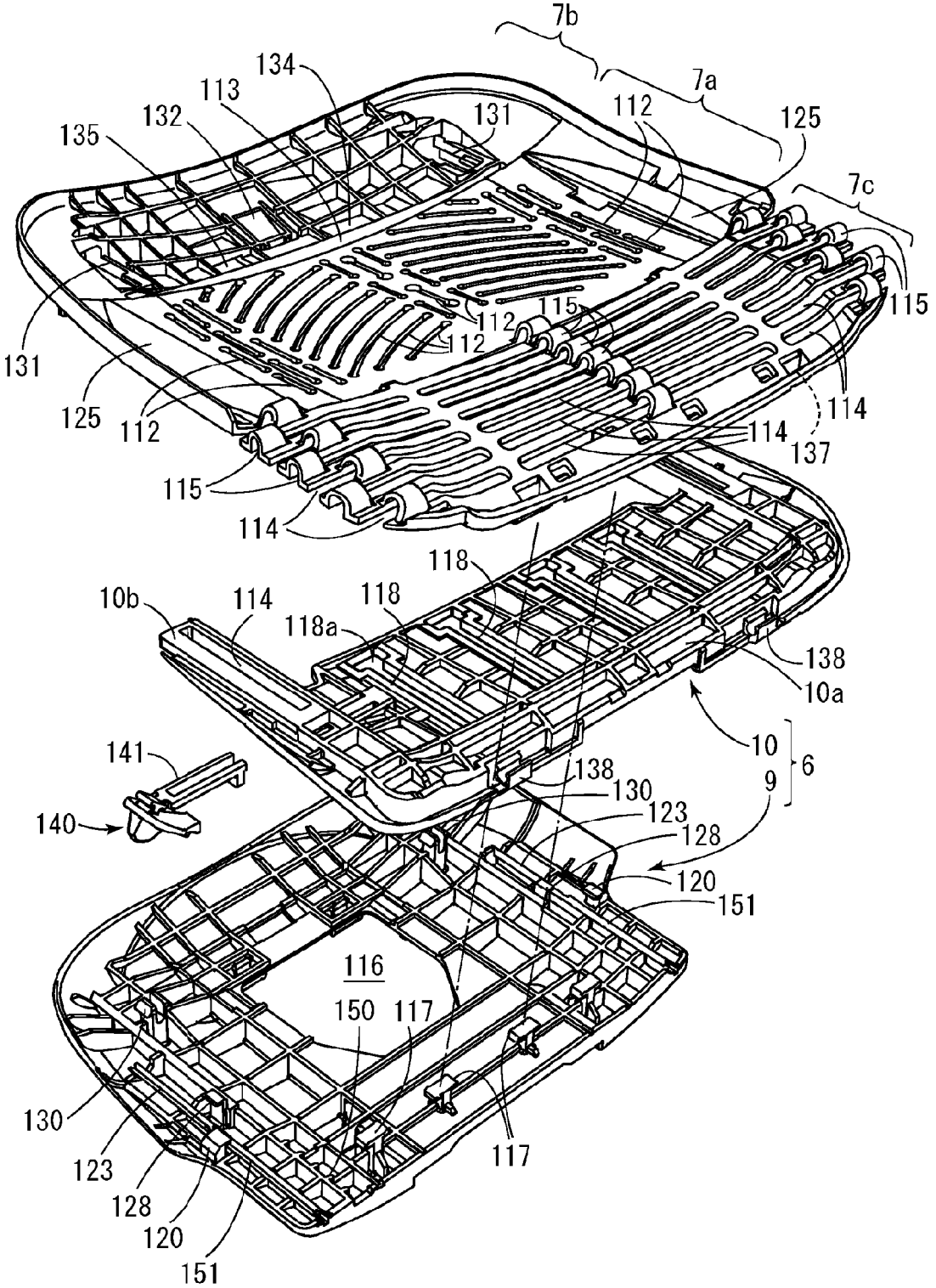
FIG. 19 is an exploded perspective view of a seat.
Figures 22A, 22B:
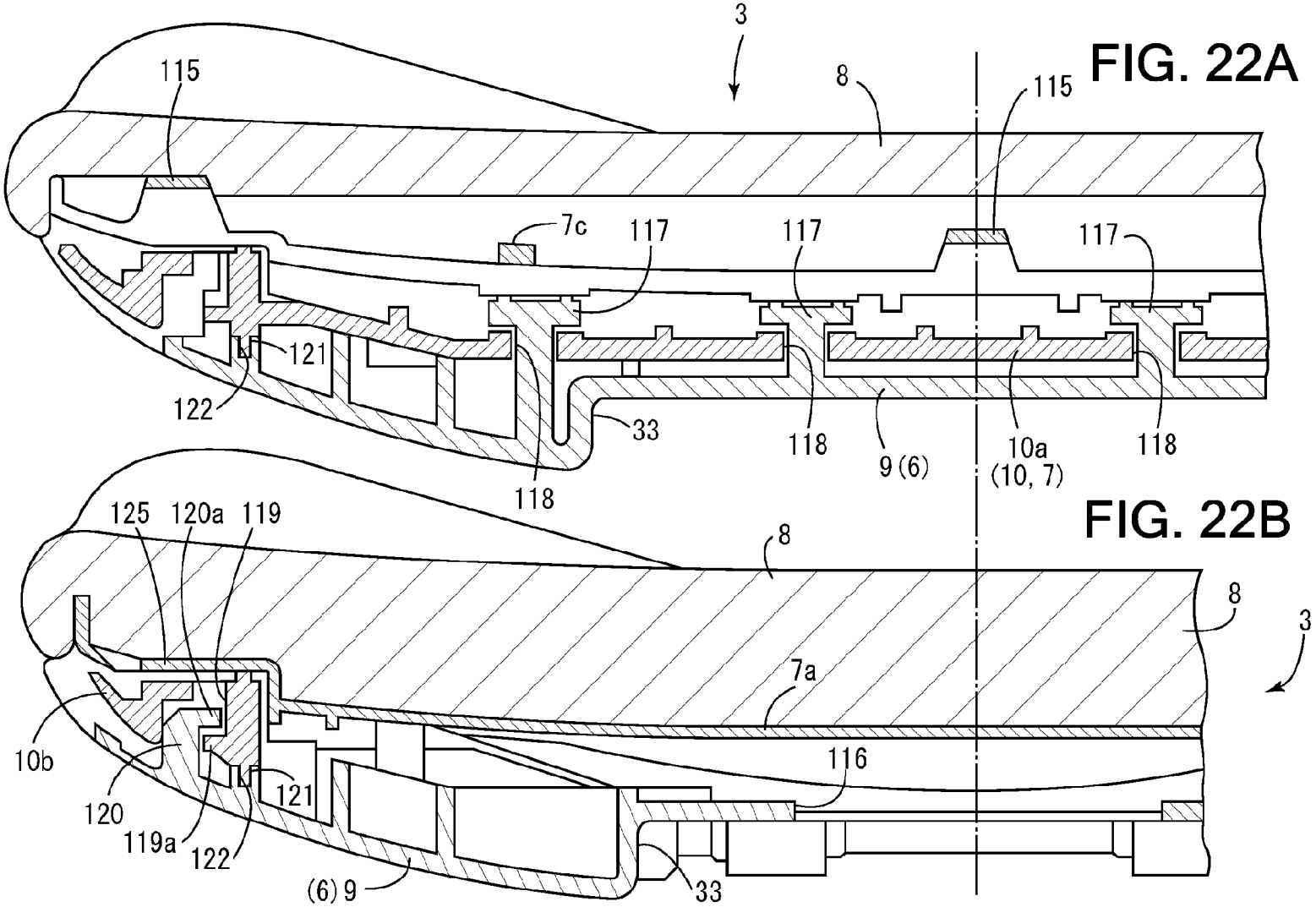
FIG. 22A is a sectional view taken along a line IIA-IIA shown in FIG. 20A
FIG. 22B is a sectional view taken along a line IIB-IIB shown in FIG. 20A.

Basically, the base part 10*a* of the slide outer shell 10 is plate-shaped (may be grid-shaped). Reinforcing ribs are formed on an upper surface of the base part 10*a* so as to extend vertically and horizontally. As shown in FIG. 19 or FIG. 22A, etc., while a plurality of first guide protrusions 117 including a head portion is projected at front-side regions of the fixed outer shell 9, elongated guide holes 118 that are long longitudinally are formed at the base part 10*a* of the slide outer shell 10. The guide protrusion 117 has a T shape, as seen from the front. The first guide protrusion 117 is fitted into the elongated guide hole 118 in such a way that the first guide protrusion cannot be separated but can be moved longitudinally. A first guide portion is configured by the first guide protrusion 117 and the elongated guide hole 118. Although the first guide protrusion 117 and the elongated guide hole 118 are formed in four-by-four at intervals in a lateral direction, the number or position thereof can be selected arbitrarily.

As can be appreciated from FIG. 19, a rear end portion of each elongated guide hole 118 is configured as a wide portion 118*a* to or from which the head portion of the first guide protrusion 117 is fitted or separated. Therefore, the fixed outer shell is inseparably held in the base part 10*a* of the slide outer shell 10 by fitting the elongated guide hole 118 to the first guide protrusion 117 from the sites of the wide portion 118*a* and then sliding the slide outer shell 10 to the rear.

As shown in FIG. 22B (see also FIG. 6), while a guide groove 119 that is long in a longitudinal direction is formed at the arm part 10*b* of the slide outer shell 10, a second guide protrusion 120 is formed integrally with the fixed outer shell 9. The guide groove 119 has a crank shape that opens downward and upward, as seen in a front section view. The guide protrusion 120 has a substantially inverted L shape and is inseparably fitted into the guide groove 119. The second guide protrusion 120 and the guide groove 119 configure an example of a second guide portion. While the guide groove 119 is formed with a support portion 119*a* that is projected outward in a lateral direction by laterally shifting a downward opening position and an upward opening position, an inward hooked portion 120*a* is formed at the second guide protrusion 120 and positioned over the support portion 119*a*. As shown in FIG. 25, a rear end portion of the guide groove 119 is configured as a wide portion 119*b* for allowing the fitting of the second guide protrusion 120.

As shown in FIG. 22, while a convex rail part 121 having a thin width is formed at a lower end of the arm part 10*b*, a concave rail part 122 is formed at the fixed outer shell 9. The convex rail part 121 is slidably fitted into the concave rail part 122. The left and right positions of the slide outer shell 10 are restricted by fitting these rail parts 121, 122 to each other. The convex rail part 121 is extended to the vicinity of the front end of the fixed outer shell 9 and the concave rail part 122 is extended to the vicinity of the front end of the slide outer shell 10.

(11). Relationship Between Seat Inner Shell and Seat Outer Shell

The seat inner shell 7 is connected to both the fixed outer shell 9 and the slide outer shell 10 of the seat outer shell 6. This point will be described below.

As shown in FIG. 19 or FIG. 23B, rail-like side support portions (side ridges) 123 that are long longitudinally are formed at sites of the fixed outer shell 9 that are offset to both left and right side edges and located at a substantially rear haft. Support ribs 124 of the seat inner shell 7 are placed on the side support portions 123. Further, as shown in FIG. 23B, horizontal stepped parts 125 are formed at sites of the main support part 7*a* of the seat inner shell 7 that is located outside the support rib 124. The arm part 10*b* of the slide outer shell 10 is disposed below the stepped part 125. An inward stopper piece 126 is formed at a site of an inner wall of the stepped part 125. The stopper piece 126 is surrounded, from three directions, by a through hole 127 that is opened vertically.

Further, a deterrence piece 128 is provided integrally with the side support portion 123 of the fixed outer shell 9 and adapted to surround the stopper piece 126 from the above. Specifically, both left and right ends of the main support part 7*a* of the seat inner shell 7 are held so as not to be movable inward. Therefore, the main support part 7*a* is deformed to sink downward by the load of the seated person. Further, since both left and right sides of the main support part 7*a* are held by the side support portion 123 so as not to sink, the arm part 10*b* of the slide outer shell 10 is not pushed downward by the main support part 7*a* of the seat inner shell 7 even when a person seats. Accordingly, it is possible to easily slide the arm part 10*b* of the slide outer shell 10 in a longitudinal direction even in a state where a person remains seated.

The through hole 127 protrudes rearward of the stopper piece 126. Therefore, the deterrence piece 128 can be fitted into a rear portion of the through hole 127 by positioning the seat inner shell 7 slightly in front of a predetermined position and then overlapping the seat inner shell 7 with the fixed outer shell 9. When the seat inner shell 7 is shifted rearward in that state, the deterrence piece 128 is positioned on the stopper piece 126.

As shown in FIG. 22C, a plurality of support pieces 129 is formed at both left and right end portions of the main support part 7*a* of the seat inner shell 7. The support pieces 129 are projected inwardly to face the arm part 10*b* of the slide outer shell 10 and provided at intervals in a longitudinal direction. The support pieces 129 are intended for attaching a skin material thereto.

As shown in FIG. 23A, while hook-like rear engaging claws 130 are provided at left and right rear portions of the fixed outer shell 9, rear engaging holes 131 are formed at the rear support part 7*b* of the seat inner shell 7. An upper portion of the rear engaging claw 130 is bifurcated. The rear engaging holes 131 are fitted and engaged with the rear engaging claws 130 from the above. The rear engaging holes 131 are also engaged with the rear engaging claws 130 by overlapping the seat inner shell 7 with the fixed outer shell 9 and then shifting the seat inner shell 7 from the fixed outer shell 9.

Figures 21A, 21B, 21C, 21D:
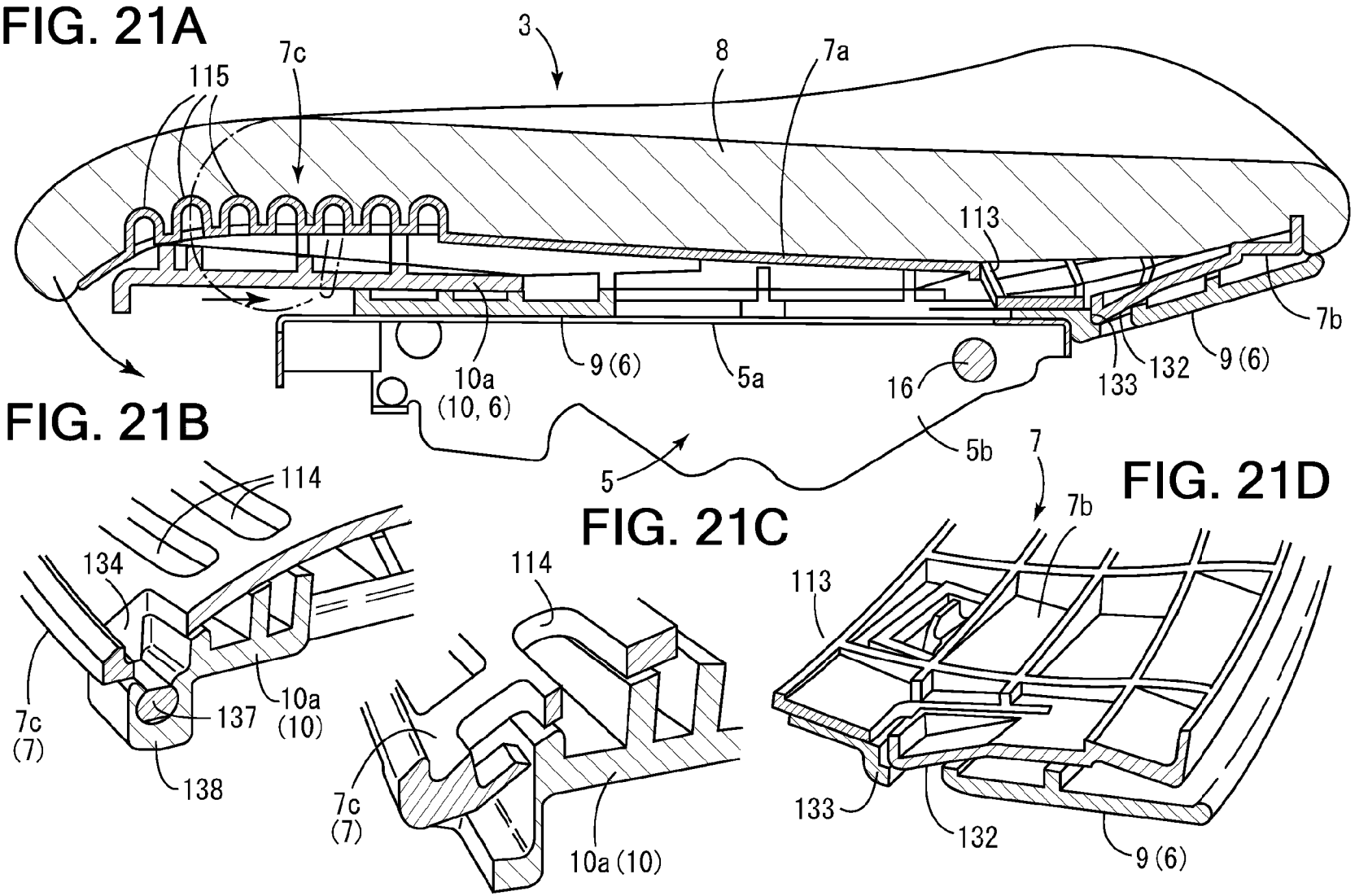
FIG. 21A is a sectional view taken along a line IA-IA shown in FIG. 20A.
FIG. 21B is a sectional perspective view taken along a line B-B shown in FIG. 20A.
FIG. 21C is a sectional perspective view taken along a line C-C shown in FIG. 20A
FIG. 21D is a perspective view of an outer shell 9, a center engaging piece 132 and a center mount part 133 shown in FIG. 21A.

As shown in FIG. 21D, while a center engaging piece 132 is provided at an intermediate portion in a lateral direction of the rear support part 7*b* of the seat inner shell 7, a center mount part 133 is concavely formed at the fixed outer shell 9. A front end of the center engaging piece 132 is a free end and projected downward. The center engaging piece 132 is fitted into the center mount part 133 so as not to be movable forward. Since three directions of the center engaging piece 132 except for a direction of a base are surrounded by slits, the center engaging piece 132 can be pivoted vertically about the base.

As shown in FIG. 20, a side engaging portion 134 is formed at sites of the fixed outer shell 9 that is located outside the center mount part 133 in a lateral direction. The side engaging portion 134 has a rectangular shape, as seen in a plan view. A side engaging hole 135 is provided at the rear support part 7*b* of the seat inner shell 7 and fitted into the side engaging portion 134. In this way, the rearward movement of the seat inner shell 7 is restricted.

A connection structure of the front end portion of the seat inner shell 7 is shown in FIG. 21B. Specifically, while support shafts 137 are formed integrally, via left and right downward bracket pieces 136, with two sites of the deformation allowing part 7*c* of the seat inner shell 7 that are located at both left and right sides across a center line, a bearing part 138 is provided integrally with the front end of the slide outer shell 10. The support shaft 137 is fitted into the bearing part 1038 from the above. The support shaft 137 and the bearing part 138 can be rotated relative to each other.

Accordingly, since the front end of the deformation allowing part 7*c* is pulled rearward when the slide outer shell 10 retreats, the deformation allowing part 7*c* is wound downward in a state of being folded back. In this way, it is possible to adjust the longitudinal length (depth of the front end) by changing the front end position of the seat 3. Arrangement positions of the pair of the support shaft 137 and the bearing part 138 are not limited to two left and right sites but the number and arrangement position thereof can be selected arbitrarily. For example, the pair can be provided at three sites of an intermediated portion and both left and right sides. Further, the support shaft 138 may be provided at the slide outer shell 10 and the bearing part 138 may be provided at the deformation allowing part of the seat inner shell 6. Further, another connection portion may be employed.

(12). Depth Operating Mechanism of Seat

Figures 24A, 24B:
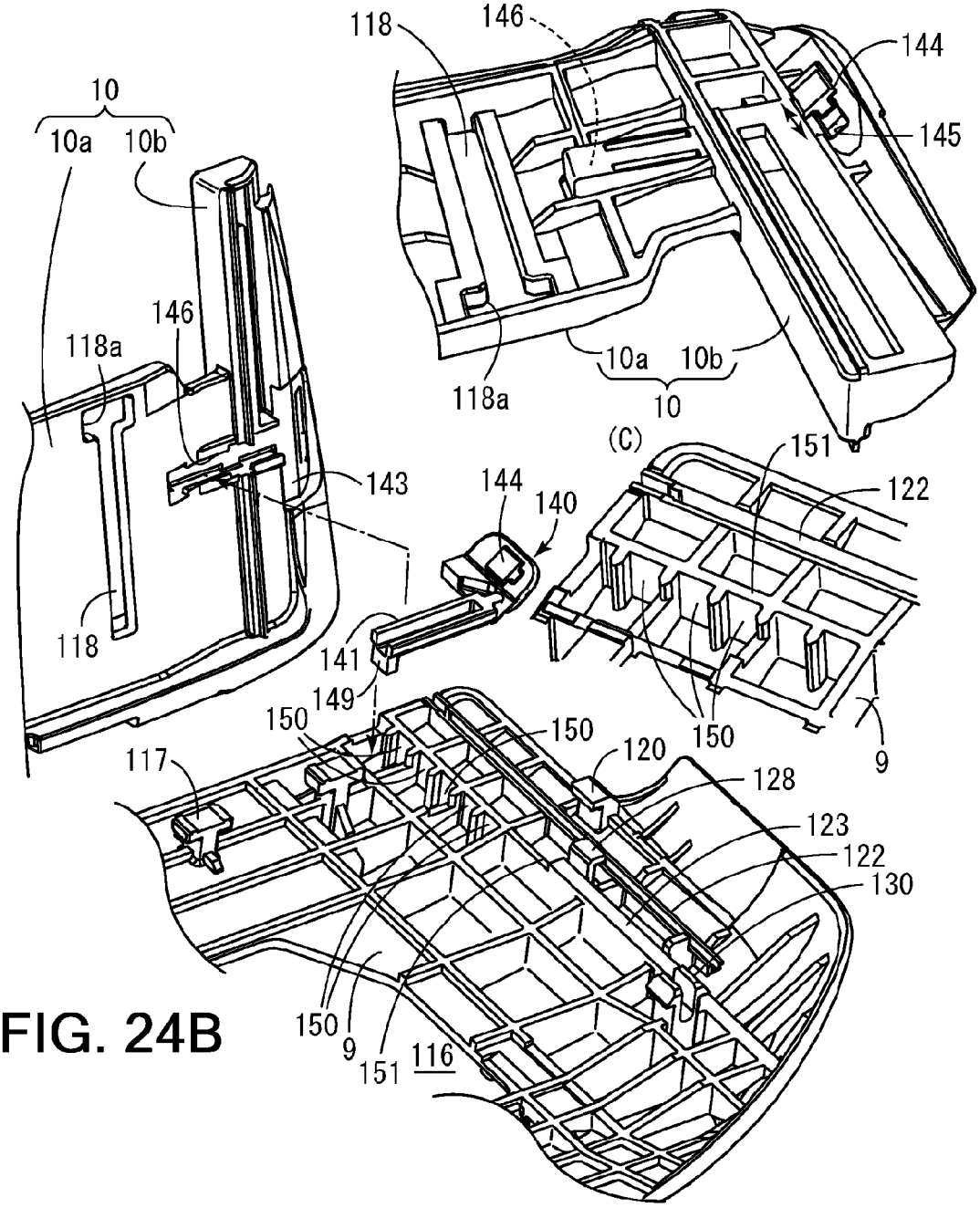
FIG. 24A is a perspective view of a portion to which a seat adjustment operating lever is mounted, as seen from the above.
FIG. 24B is an exploded perspective view of the seat adjustment operating lever and a seat outer shell.

Next, an operation device for adjusting a longitudinal length of the seat 3 will be described mainly with reference to FIG. 24 and FIG. 25. For example, as shown in FIG. 25B, the operation device includes a finger contact lever 140 that is mounted to a right portion of the slide outer shell 10 so as to be movable longitudinally, a lock member 141 that slides laterally by the forward and rearward movements of the finger contact lever 140 and a spring (compression coil spring) 142 that urges the lock member 141 to a lock posture.

As clearly shown in FIG. 25A and FIG. 25C, a lower surface of left and right side portions of the slide outer shell 10 is inclined to be lower toward the inside. A concave region 143 having a flat bottom surface is formed at the slanted lower surface. The finger contact lever 140 is disposed at the concave region 143 so as to be movable longitudinally. The finger contact lever 140 includes an upper plate 140*a* that is overlapped with the bottom surface of the concave region 143 and a grip part 140*b* that is projected downward from the upper plate 140*a*. An engaging protrusion 144 is formed integrally with the upper plate 140*a*. The engaging protrusion 144 is exposed on the slide outer shell 10 and has a T shape, as seen from the front. The slide outer shell 10 is formed with a mounting hole 145 that is long in a longitudinal direction. The engaging protrusion 144 is inseparably fitted into the mounting hole 145. A wide portion 145*a* is formed at a front end of the mounting hole 145. The engaging protrusion 144 can be fitted into or detached from the wide portion 145*a*.

The lock member 141 has a rod shape that is long in a lateral direction. The lock member 141 is slidably fitted into a guide groove 146 that is provided at the lower surface of the slide outer shell 10. The guide groove 146 is long in a lateral direction. The guide groove 146 is continuous integrally with the concave region 143. Further, the guide groove 146 is formed in a state of dividing the convex rail part 121.

As shown in FIG. 25B, while an outer end of the lock member 141 that faces the finger contact lever 140 is configured as a contact portion 141*a* that has a U shape, as seen from the bottom, a concave region 147 is formed at the finger contact lever 140 and covers the contact portion 141*a* of the lock member 141 from the below. An inner surface of the concave region 147 is configured as two front and rear slant surfaces 147*a*. The slant surfaces 147*a* are inclined in such a way that a spacing therebetween becomes wider.

A groove 168 is formed at an upper surface of the lock member 41. The spring 142 is fitted into the groove 168. One end of the spring 142 is in contact with an inner surface 146*a* of the guide groove 146. Accordingly, the lock member 141 is urged outward (in a direction toward the finger contact lever 140). Since the concave region 147 of the finger contact lever 140 has a V shape, the lock member 141 retreats outward and the contact portion 141*a* is fitted into a deep position of the concave region 147 when an external force is not applied to the finger contact lever 140. As a result, a stable state is held. On the other hand, upon sliding the finger contact lever 140 in one of the front and rear directions, the lock member 141 is advanced inwardly by the guide action of the slant surface 147*a*.

A stopper protrusion 149 is provided integrally with an inner end portion of the lock member 141 and projected downward toward the fixed outer shell 9. On the other hand, the fixed outer shell 9 is provided with a stopper mount part 150. The stopper protrusion 149 is fitted into or detached from the stopper mount part 150 when the lock member 141 moves laterally. The stopper mount part 150 is configured by providing inward ribs at intervals to a vertical rib 151 that is long in a longitudinal direction. In the present embodiment, five stopper mount parts 150 are formed side by side in a longitudinal direction. Accordingly, the longitudinal length of the seat 3 can be adjusted in five steps.

For example, as shown in FIG. 6, a finger contact protrusion 152 is formed integrally with a site of the slide outer shell 10 that is bilaterally symmetric with the slide-type finger contact lever 140. The finger contact protrusion 152 has the same shape as the slide-type finger contact lever 140. Therefore, it is possible to perform longitudinal adjustment of the seat 3 smoothly without being twisted. The slide-type finger contact levers 140 may be provided at both left and right sides of the slide outer shell 10. When slide-type finger contact levers 140 are provided at the left and right sides, the lock members 141 may be provided at the left and right sides. Alternatively, the lock member 141 may be provided only at one side and the other slide-type finger contact levers 140 may be configured as a dummy.

In the present embodiment, both left and right sides of the main support part 7*a* of the seat inner shell 7 are held in a state of being placed on the side support portions 123 and therefore the body pressure of the seated person is not or little applied to the arm part 10*a* of the slide outer shell 10. Accordingly, it is possible to perform the longitudinal adjustment of the seat 3 lightly in a state where a person remains seated. The thigh of the seated person may be brought into contact with the deformation allowing part 7*c* of the seat inner shell 7 from the above. However, since the deformation allowing part 7*c* is just stretched, wound or deformed but does not move in a longitudinal direction, the contact of the thigh of the seated person with the seat inner shell 7 does not affect the longitudinal adjustment of the seat 3.

Further, in the present embodiment, even though the finger contact lever 140 is moved in any direction of the longitudinal direction, the lock member 141 is detached from the stopper mount part 150 and unlocked, so that the slide outer shell 10 can be directly moved in a longitudinal direction. Accordingly, upon adjusting the depth of the seat 3, the locking is released by moving the finger contact lever 58 in a desired moving manner of the slide outer shell 10. As a result, the unlocking and the movement of the slide outer shell 10 can be performed in one-action. Accordingly, operability is good.

Since the slide outer shell 10 is overlapped with the fixed outer shell 9 from the above in the present embodiment, the slide outer shell 10 is operated to be close contact with the fixed outer shell 9 even when a body pressure is strongly applied to the front portion of the seat 3, for example. In other words, as the body pressure is strongly applied, there is a tendency that the integration of the slide outer shell 10 and the seat outer shell 9 becomes stronger. As a result, there is no case that the slide outer shell 10 is detached from the fixed outer shell due to the body pressure of a person. Accordingly, support strength/support stability is excellent.

Since the arm part 10*b* of the slide outer shell 10 is disposed on the outside of the side support portion 123 in the present embodiment, it is possible to accurately prevent the arm part 10*b* from being pressed by the seat inner shell 7. In other words, since the main support part 7*a* of the seat inner shell 7 is placed on the side support portion 123, the portion of the seat inner shell 7 that is located outside the side support portion 123 has a tendency to float upward by the body pressure of the seated person. Thereby, the slide outer shell 10 is prevented from being pressed by the seat inner shell 7 and therefore it is possible to lightly move the slide outer shell 10 in a longitudinal direction.

When the convex rail part 121 provided at a lower end of the arm part 10 and the concave rail part 122 provided at the fixed outer shell 9 are fitted into each other, as in the present embodiment, this is desirable since the backlash of the slide outer shell 10 is eliminated.

(13). Background Art of Backrest/Features of Present Example

In the chair disclosed herein, a mechanism for changing an initial posture (basic posture, initial angle) of a backrest is also improved. This point will be described below.

A chair has been suggested in which an initial posture of a backrest in a state of being non-tilted rearward can be changed (for example, Japanese Examined Patent Publication No. S47-49543, JP-A-2002-142897, Japanese Patent Application Publication No. 2010-516433, Japanese Utility Model Publication No. S46-8447, Japanese Patent Publication No. 4185754 and Japanese Patent Publication No. 4220191).

Meanwhile, importance of supporting a lumbar region (in particular, around the third lumbar vertebra) of a seated person is pointed out in a chair and therefore a chair has been widely spread, which is provided with a lumbar support part protruding forward, as seen in a side sectional view. In other words, when a person sits on a chair and works in the office or the like, a person can take a proper erecting posture by supporting a waist with the lumbar support part. In this way, it is possible to reduce the burden on the body.

On the other hand, although an initial posture of a backrest is changed in order to match the preference of a user, it is not preferable that hitting on the body is changed due to the changes in the initial posture. Specifically, it is not preferable that the body support position is shifted in a longitudinal direction or the hitting position on the body is shifted in a vertical direction, due to the changes in the initial posture of the backrest. In a chair including the lumbar support part, it is preferable that the initial posture of the backrest can be changed in a state of accurately holding a lumbar support function.

However, in Japanese Examined Patent Publication No. S47-49543, JP-A-2002-142897 and JP-A-2010-516433, an initial posture of a backrest is changed by tilting the backrest about a pivot supporting point of a back frame. Accordingly, the backrest generally moves back and forth in accordance with the adjustment of the initial posture. As a result, there is a possibility that the push-up feeling occurs in the body or the body support function is decreased.

Further, in Japanese Patent Publication No. 4185754 and Japanese Patent Publication No. 4220191, the lumbar support part is moved back and forth. Accordingly, it is difficult to meet the requirements of changing an initial posture of a backrest without changing the lumbar support function.

Since the backrest disclosed in Japanese Utility Model Publication No. S46-8447 is pivoted about a vertically middle portion thereof, it can be said that fitting property to the body is high. However, since the backrest does not include a lumbar support part, there is a possibility that a lower end protrudes forward and a push-up feeling is imparted to a person when the backrest is in a posture lying rearward. Further, since the posture is changed by operating a pin provided on an upper end of a bracket, there is also a problem that it is difficult to change the posture in a state where a person remains seated and therefore operability is poor.

The adjustment mechanism disclosed herein is intended to improve such a situation. In the adjustment mechanism, an initial posture of a backrest can be changed in a state of properly maintaining the body support function and the operability or the like of the posture change is taken into consideration.

The chair disclosed herein includes a seat and a backrest that is disposed behind the seat. The backrest is mounted to a back frame extending rearwardly from below the seat. The backrest includes a lumbar support part to support a lumbar portion of a seated person from the rear. The lumbar support part is projected forward, as seen in a side sectional view. The backrest is connected to the back frame in such a way that the backrest is pivoted about a site of a height position of the lumbar support part, as seen from the side. Further, an initial angle adjustment device is provided at the back frame or the backrest and changes the posture of the backrest, as seen from the side. The initial angle adjustment device can be operated by a person seated. The phrase, "the back frame or the backrest" portion that the initial angle adjustment device may be provided at either or both of the back frame and the backrest.

In the invention disclosed herein, the initial posture (initial angle) of the backrest is changed by pivoting the backrest about the lumbar support part and therefore the position of the lumbar support part is not largely changed by the changing of the initial posture. As a result, there is no problem that a push-up feeling occurs in the body or the support function is decreased, due to the changing of the initial posture. In other words, it is possible to adjust the initial posture of the backrest in accordance with the preference of a user while properly securing the lumbar support function. Further, since the initial angle adjustment device can be operated by a person seated, it is possible to adjust the initial posture while testing the feeling on the body. Accordingly, the chair is user-friendly.

(14). Specific Configuration of Backrest

Figures 30A, 30B:
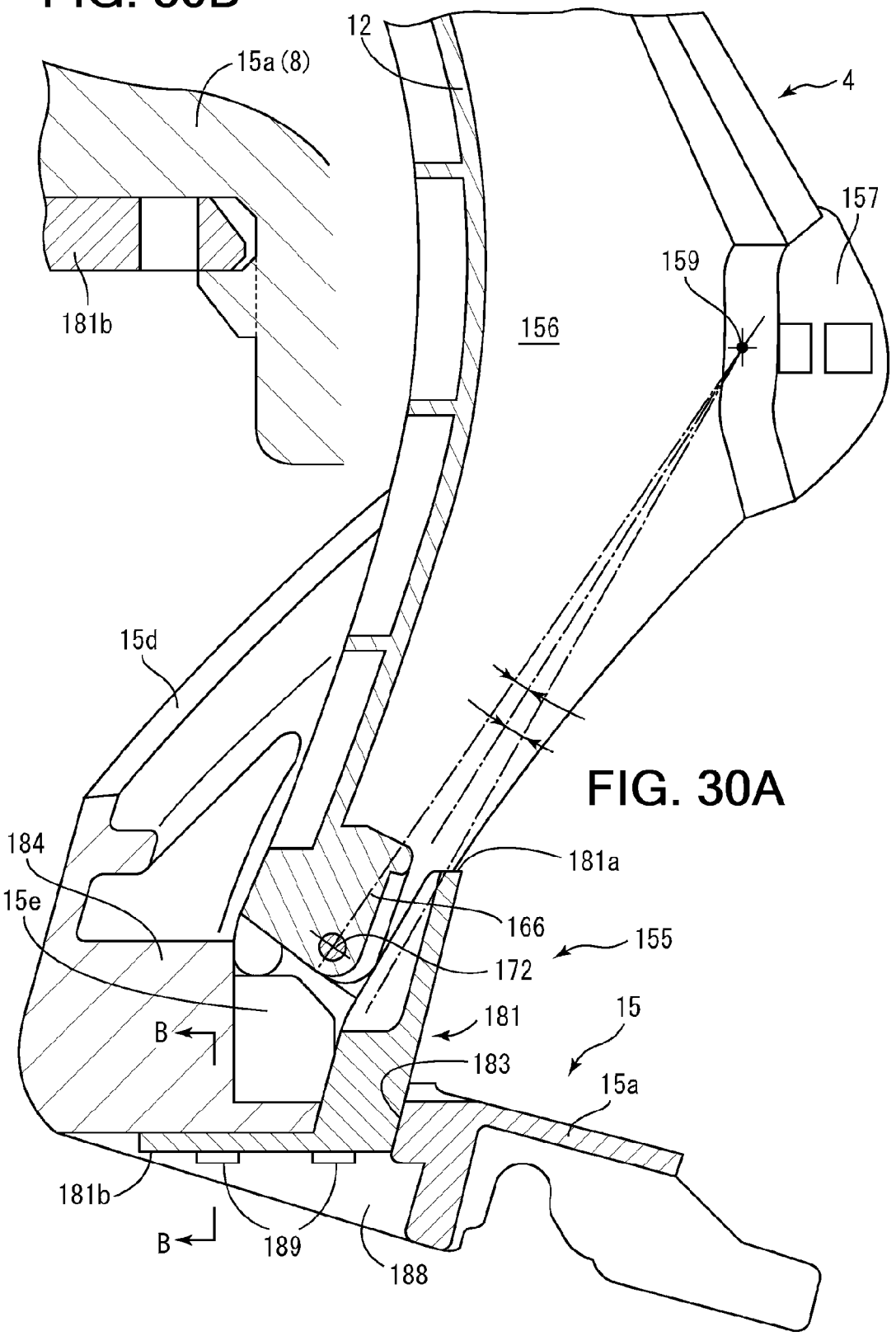
FIG. 30A is a longitudinal sectional side view of essential parts and FIG. 30B is a sectional view taken along a line B-B shown in FIG. 30A.

Next, a specific configuration of the backrest will be described mainly with reference to FIG. 26 and later. For example, as shown in FIG. 1, FIG. 3 and FIG. 30A, the backrest 4 includes a lumbar support part 156 with which a lumbar portion of a seated person comes into contact. For this reason, the lumbar support part 156 has a shape protruding forward, as seen in a side view and a longitudinal sectional view. To be described accurately, the back inner shell 12 is curved in such a way that the lumbar support part 156 is positioned at the foremost place, as seen in a longitudinal sectional view. Further, although the back inner shell 12 is smoothly curved in a forward concave shape, as seen in a plan view, the degree of curvature is largest in the lumbar support part 156, is made smaller toward the upper end and is substantially flat in the upper end.

As shown in FIG. 1 and FIG. 3, the backrest 4 is set in such a way that a lateral width thereof is largest in a site of the lumbar support part 156 and made smaller as being vertically away from the lumbar support part 156. Accordingly, the backrest 4 (back inner shell 12) has a shape close to a substantially hexagonal shape, as seen from the front. Since the lumbar support part 156 is offset to a lower side of the back inner shell 12, the backrest 4 has a hexagonal shape whose lower side is convex, accurately. Left and right ends of the lumbar support part 156 have a mountain shape that is projected laterally, as seen from the front.

Further, side connection parts 157 are provided at both left and right ends of the lumbar support part 156 of the back inner shell 12 and intended to connect the lumbar support part 156 to the head parts 15*c* of the back struts 15*b*. The side connection parts 157 are projected forward from the surroundings thereof.

Figure 26A:
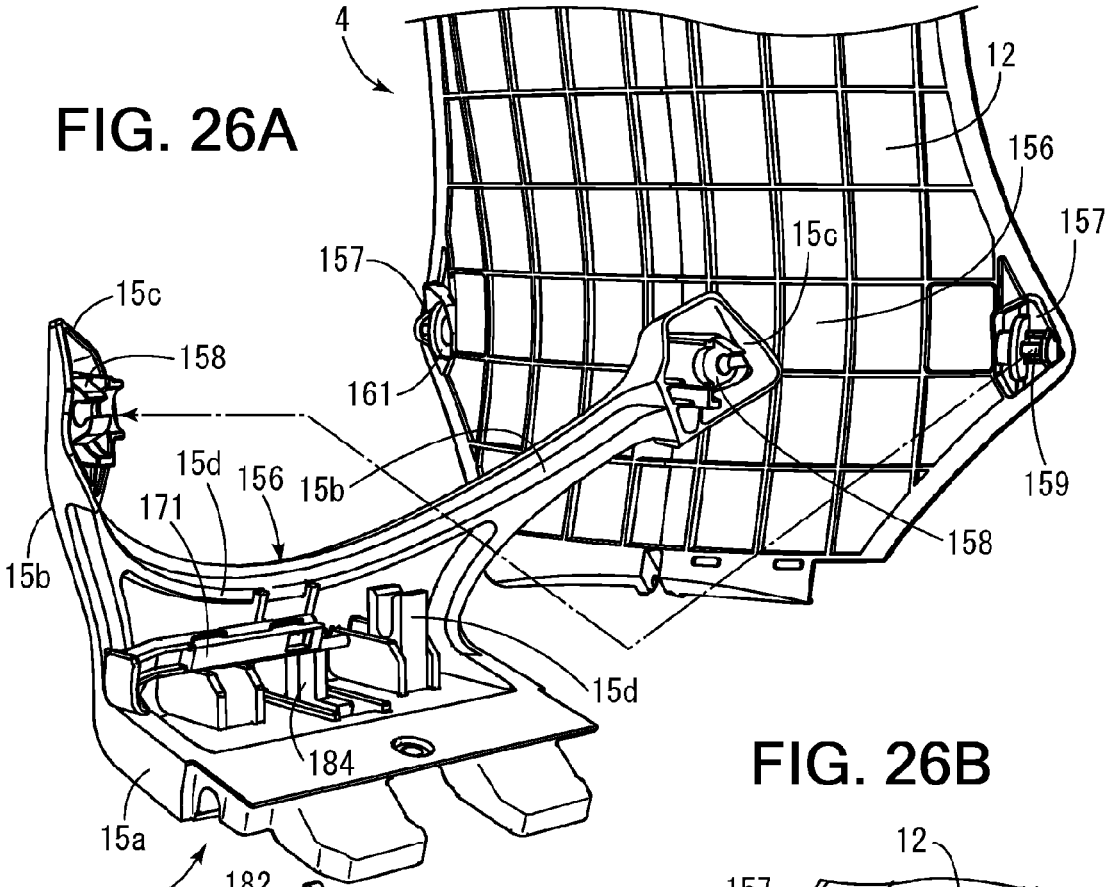
FIG. 26A and FIG. 26B are exploded perspective views of a backrest and a second back frame.
Figure 26B:
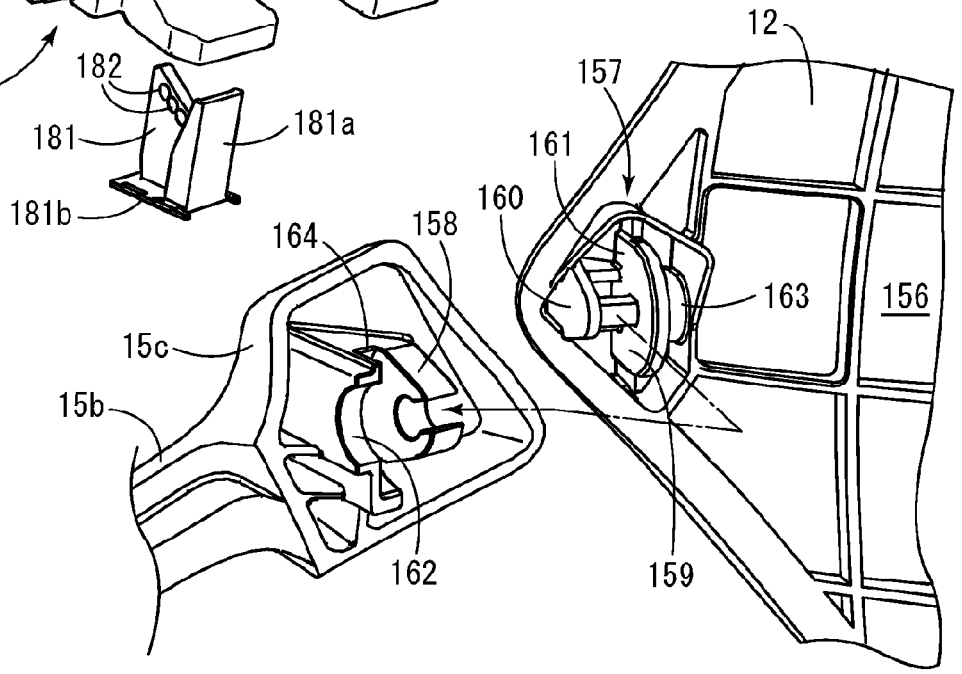

For example, as shown in FIG. 26, fist-like head parts 15*c* are formed at an upper end of the back struts 15*b* of the second back frame 15 and projected forward. Bearing parts 158 are formed integrally with the head part 15*c* and projected forward. On the other hand, boss parts 159 are formed integrally with the side connection parts 157 of the back inner shell 12 and fitted into the bearing parts 158. By fitting the bearing parts 158 and the boss parts 159 to each other, the side connection parts 157 of the back inner shell 12 are inseparably connected to the head parts 15*c* of the back strut 15*b*. The boss part 159 is connected integrally with a rib 160 that is provided on the outside of the boss part and a restriction plate 161 that is provided on the inside of the boss part.

Figure 31B:
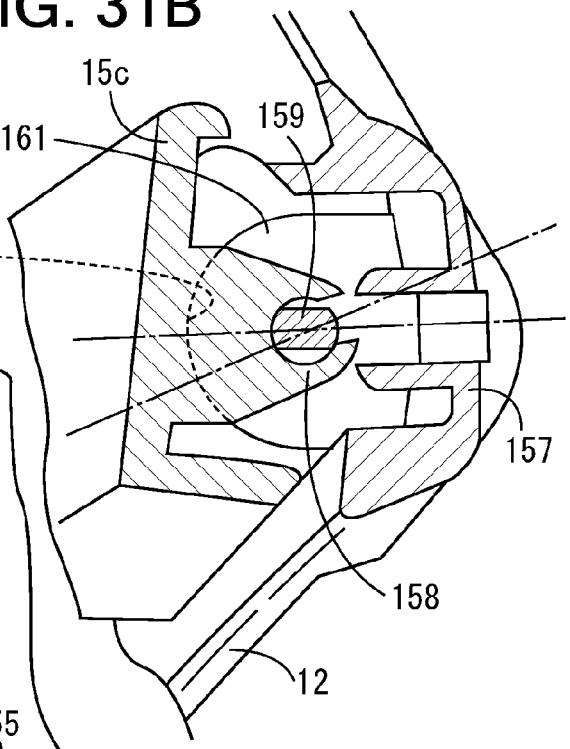
FIG. 31A is a sectional perspective view showing the initial angle adjustment device and FIG. 31B is a sectional view taken along a line XXXIB-XXXIB shown in FIG. 29.
Figure 31A:
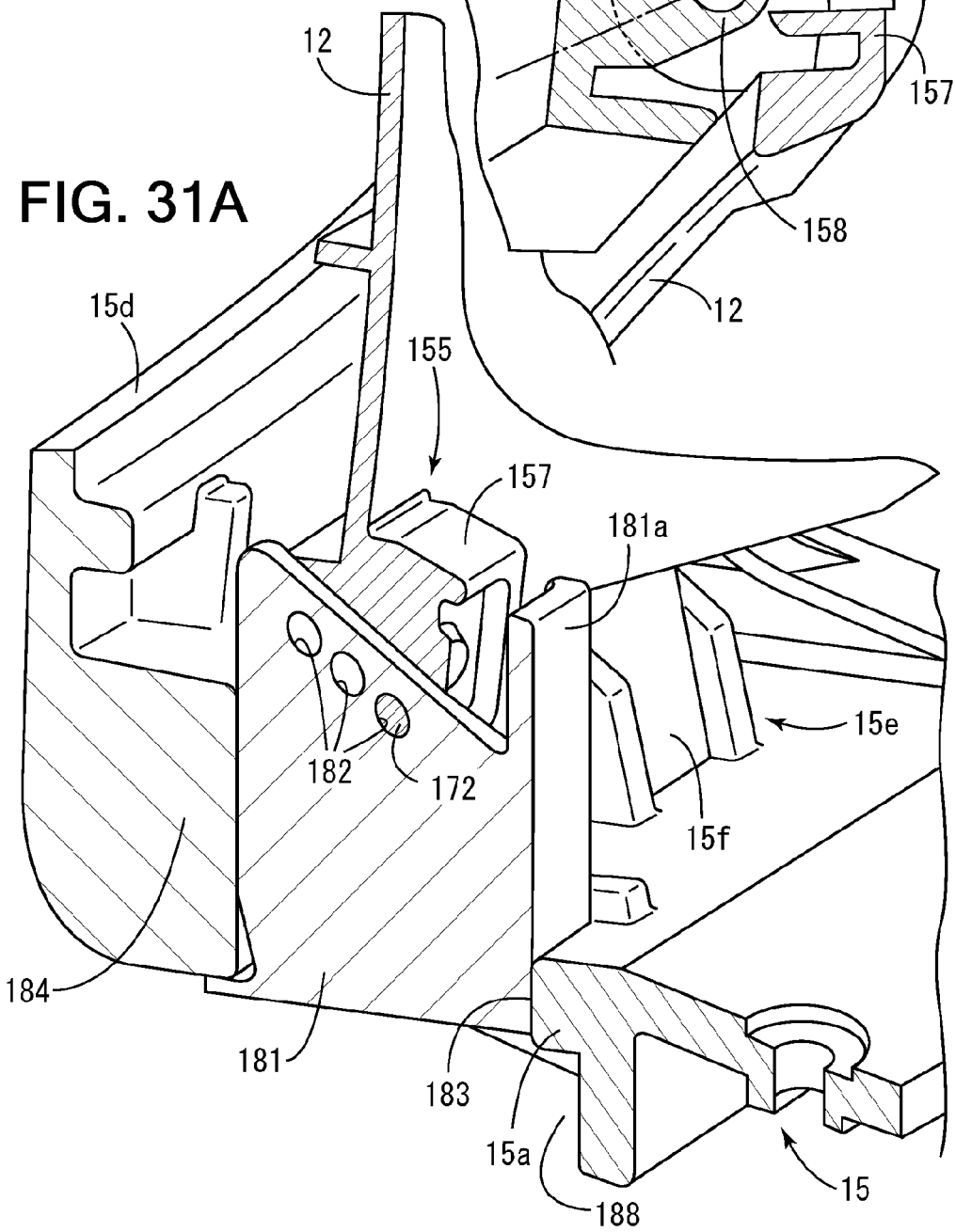

As clearly shown in FIG. 31B, while the bearing part 158 includes a necking portion, the boss part 159 has a cross-sectional shape of a crushed circle. In a state where the backrest 4 is set to a predetermined posture, the boss part 159 is set to a substantially horizontal posture and an opening direction of the bearing part 158 is set so as to be opened obliquely upward relative to the horizontal. Therefore, by causing the backrest 4 to have a posture inclined rearward relative to a predetermined posture, the boss part 159 can be fitted into the bearing part 158. Further, upon connecting a lower end of the back inner shell 12 to the second back frame 15, the boss part 159 is held so as not to be detached from the bearing part 158 even when a forward external force is applied to the backrest 4. Accordingly, it is possible to simply perform the mounting of the backrest 4.

Figure 29:
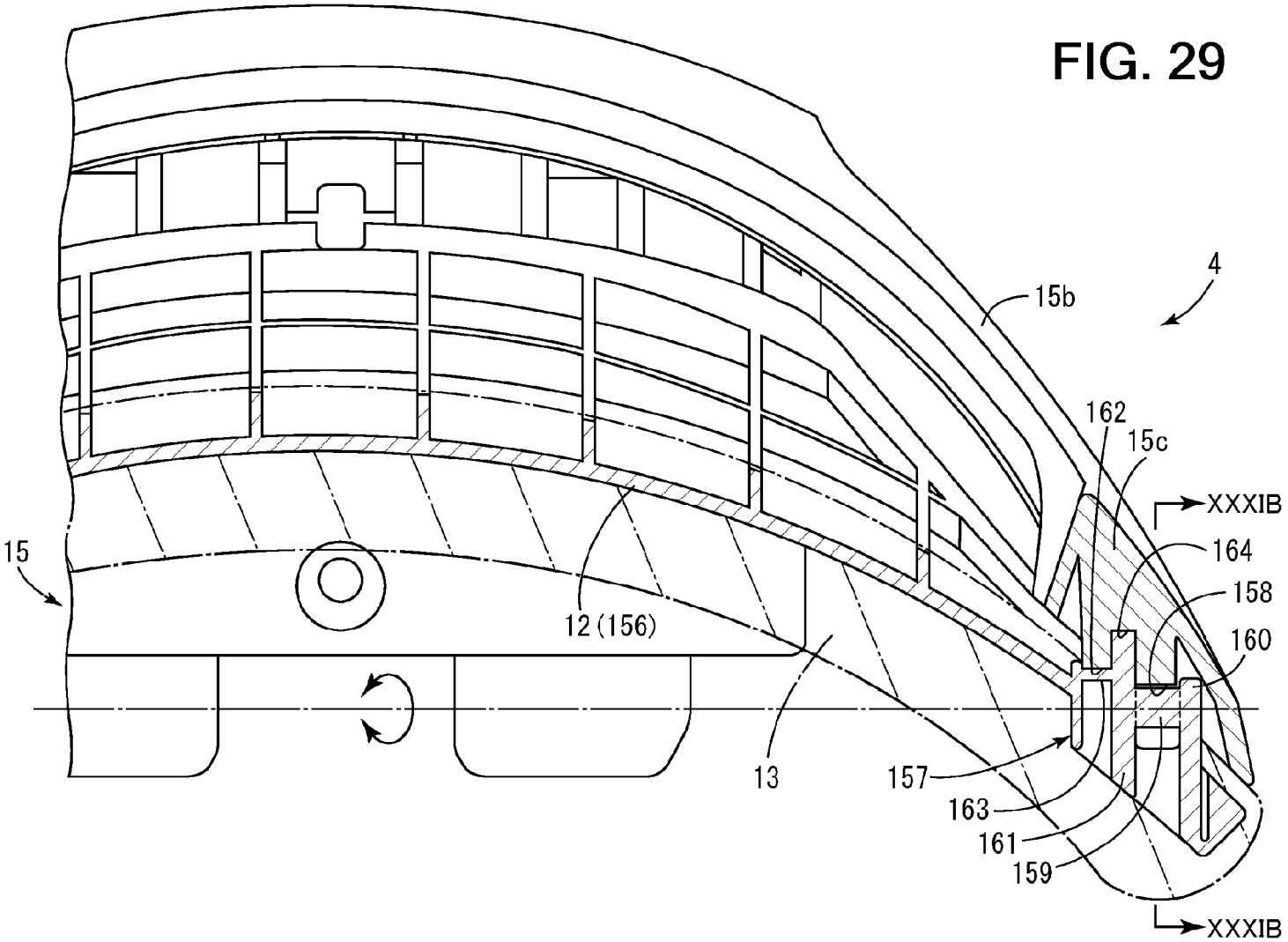
FIG. 29 is a sectional view taken along a line XXIX-XXIX shown in FIG. 1A.

As shown in FIG. 26 and FIG. 29, a load receiving part 162 is formed at a site of the head part 15*c* of the back strut 15*b* that is located inside the bearing part 158. The load receiving part 162 has a circular arc-shaped surface whose curvature is much larger than the radius of the boss part 159. On the other hand, a circular arc-shaped load support part 163 is provided integrally with the side connection part 157 of the back inner shell 12 and fitted into the load receiving part 162. Since the load support part 163 is brought into contact (surface contact) with the load receiving part 162 over a wide area, the back inner shell 12 is stably supported by the left and right back struts 15*b* while longitudinal pivoting thereof is not inhibited.

Further, a groove 164 is provided between the load support part 162 and the bearing part 158 of the head part 15*c* of the back strut 15*b*. The restriction plate 161 of the back inner shell 12 is closely fitted into the groove 164 so as not to be shifted laterally. In this way, since the back inner shell 12 is held by the fitting of the groove 164 and the restriction plate 161 so as not to be shifted laterally, the side connection part 157 is not displaced inwardly even when a rearward load is applied to the lumbar support part 156 and therefore the side connection part 157 is pulled inward. Therefore, the mounting strength is high. A bottom surface of the groove 164 and an outer periphery of the restriction plate 161 are formed in a circular arc shape of curvature around an axis of the boss part 159, as seen from the side. Accordingly, the pivoting of the back inner shell 12 around an axis of the boss part 159 is allowed.

As described above, in the mounting structure of an upper end of the back strut 15*b* and the back inner shell 12, longitudinal retention, support of load applied to the back and lateral shifting prevention are respectively performed at a separate specific site. Specifically, the longitudinal retention is performed by the boss part 159 and the bearing part 158. In order that the boss part 159 and the bearing part 158 do not have the other functions (the support of load applied to the back and the lateral shifting prevention), the boss part 159 is loosely fitted into the bearing part 158 in a state where a slight clearance is provided between an outer periphery of the boss part 159 and an inner periphery of the bearing part 158. Further, by setting the lateral width dimension of the boss part 159 to be slightly wider than that of the bearing part 158, the rib plate 160 does not come into contact with the side surface of the bearing part 158. Further, a rear end surface of the restriction plate 161 is set so as not to come into contact with the bottom surface of the groove 164 of the back strut 15*b*.

(15). Initial Angle Adjustment Device

A lower end portion of the back inner shell 12 is such that an intermediate portion in a lateral direction is connected to the second back frame 15 via an initial angle adjustment device 155. This point will be described below.

For example, as shown in FIG. 28A and FIG. 28C, a lower connection part 166 is provided at the intermediate portion in a lateral direction of the lower end portion of the back inner shell 12 and projected forward. The lower connection part 166 is formed with a center groove 167 that is projected downward. Further, the lower connection part 166 is formed with a pin hole 168 that traverses the center groove 167. Furthermore, upper and lower ribs 169, 170 are provided at a right region of the lower connection part 166 of the lower end portion of the back inner shell 12 and connected to the lower connection part 166. An operation tool (slide type lever) 171 is mounted between the upper and lower ribs 169, 170 so as to be slidable laterally. The lower connection part 166 and the operation tool 171 are constituent components of the initial angle adjustment device 155. The operation tool 171 is provided with a finger grip 171*a* that can be grasped by a hand.

A pin-shaped locking pin 172 is formed integrally with the operation tool 171 and fitted into the pin hole 168 of the lower connection part 166. Accordingly, as the operation tool 171 is laterally slid, the locking pin 172 can appear and disappear in the center groove 166 of the lower connection part 166. The locking pin 172 is an example of the stopper. Claws 173 are provided at the upper rib 169 and intended to hold the operation tool 171 so as not to be detached from the back inner shell 12.

Further, the operation tool 171 is provided with a spring arrangement void 174 that is opened toward the back inner shell 12 and a stroke restriction void 175. The spring arrangement void 174 is located on the side of the locking pin 172 and the stroke restriction void 175 is located on the side of the finger grip 171. On the other hand, the back inner shell 12 is provided with a spring mount protrusion 176 that enters the spring arrangement void 174 and a stroke restriction protrusion 177 that enters the stroke restriction void 175. A compression coil spring 178 is disposed between the spring mount protrusion 176 and an inner surface 174*ee* of the spring arrangement void 174. Therefore, the operation tool 171 is urged so that the locking pin 172 can be easily fitted into the lower connection part 166 (locking position is held). The spring 178 is placed in the spring arrangement void 174 by being pushed through a window hole 179 provided at a front surface of the operation tool 171.

Restriction of the retreating position when the operation tool 171 is pulled outward by hand is performed by bringing an inner surface of the stroke restriction void 175 into contact with the stroke restriction protrusion 180. Further, restriction of the advancing position when the operation tool 171 is pressed by the spring may be performed by bringing an inner surface of the spring arrangement void 174 into contact with the stroke restriction protrusion 180 or by bringing an end of the operation tool 171 into contact with a side surface of the lower connection part 166.

As shown in FIG. 28B, a rear wall 15*d* is formed at a rear end of the base part 15*a* of the second back frame 15. A block-shaped lock body 181 is provided at the rear wall 15*d* and fitted into the center groove 167 of the lower connection part 166 of the seat inner shell 12 from the below. The lock body 181 is provided with three lock holes 182 into which the locking pin of the operation tool 171 is fitted. Accordingly, the lock body 181 is also a component of the initial angle adjustment device 155. The three lock holes 182 are present on a circular arc around a pivot supporting point of the back inner shell 12. The initial posture of the backrest 4 can be changed in three steps by selectively fitting the locking pin into any one of the lock holes 182. It goes without saying that the number of the lock holes 182 is not limited to three but may be two or four or more. The lock hole 182 is an example of the lock part.

Figure 27A:
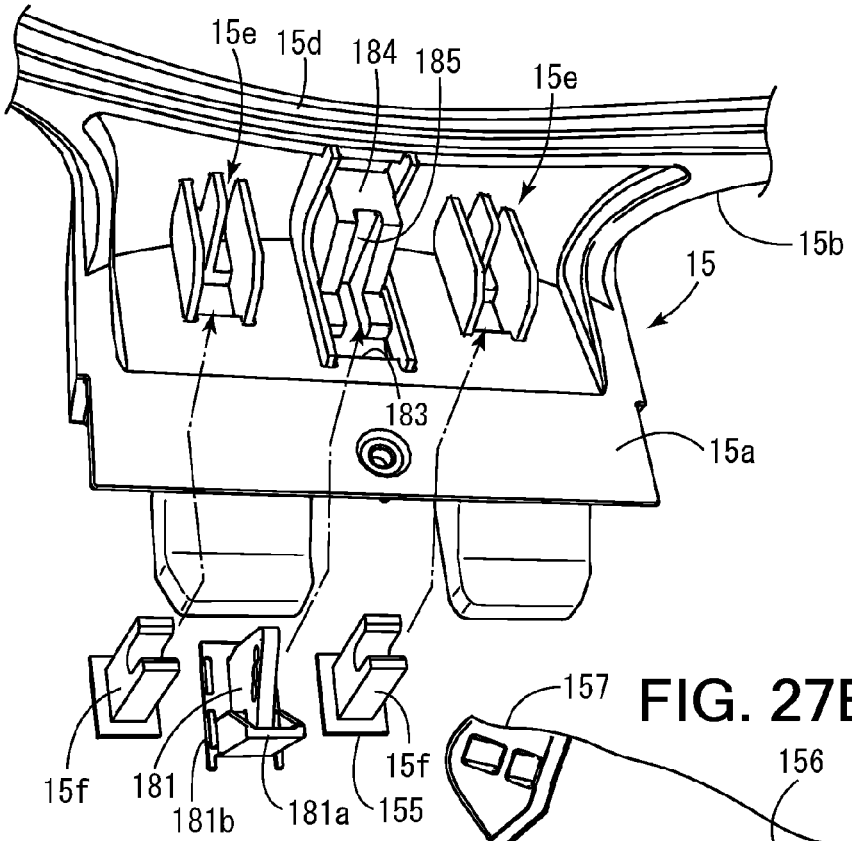
FIG. 27A and FIG. 27B are exploded perspective views for explaining an initial angle adjustment device.
Figure 27B:
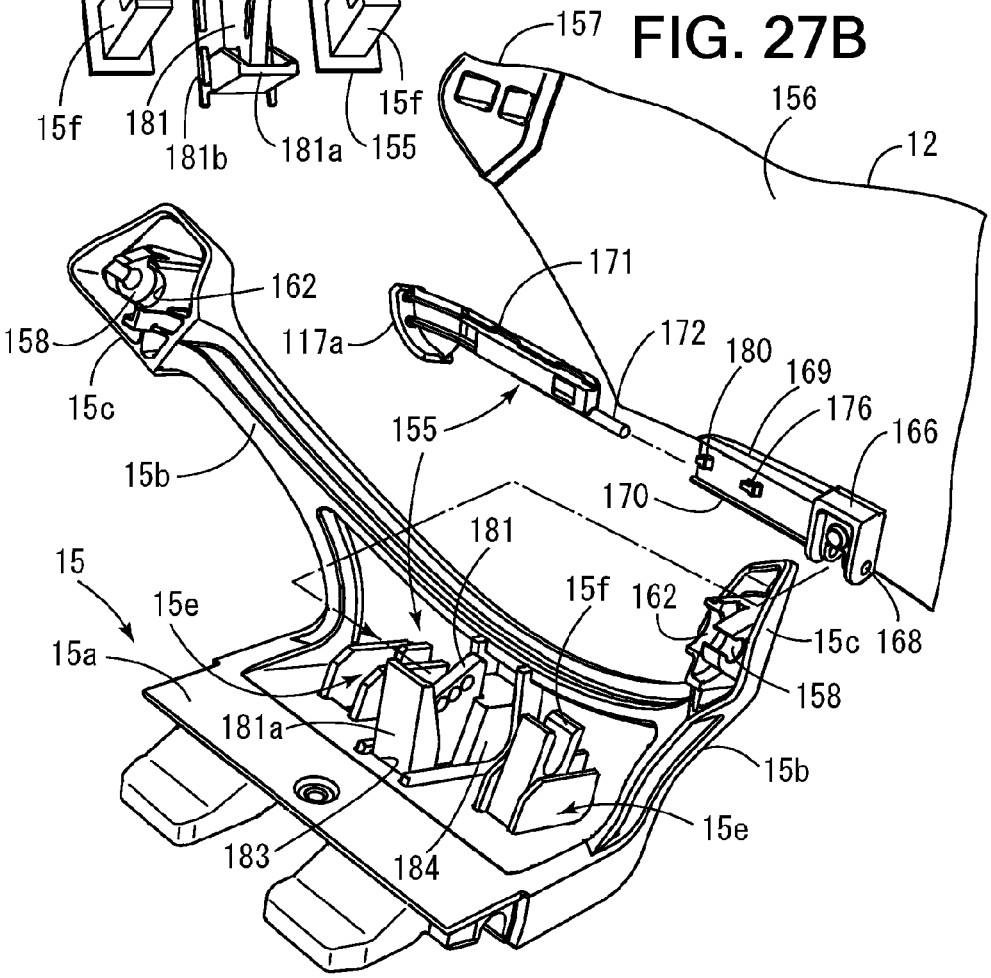

The lock body 181 is made of resin, separately from the second back frame 15 and fitted and mounted to the base part 15*a* of the second back frame 15 from the below. For this purpose, for example, as shown in FIG. 27, the base part 15*a* of the second back frame 15 is provided with a hole 183 into which the lock body 181 is fitted from the below and a center guard part 184 supporting the lock body 181 from the rear. The center guard part 184 is provided with a forward opening groove 185 into which the lock body 181 is fitted. The lock body 181 is provided with a front wall 181*a* regulating that a lower end of the back inner shell 12 largely advances forward.

As shown in FIG. 30, a concave region 188 in which the lock body 181 enters is formed at a lower surface of the second back frame 15 and a lower flange 181*b* provided at the lock body 181 is overlapped with a bottom surface of the concave region 188. Further, support claws 189 are provided at an inner surface of the concave region 188. As the lower flange 181*b* rides over the support claws 189 from the rear, the lock body 181 is held so as not to be dropped down. The lock body 181 may be provided integrally with the second back frame 15.

Figure 7:
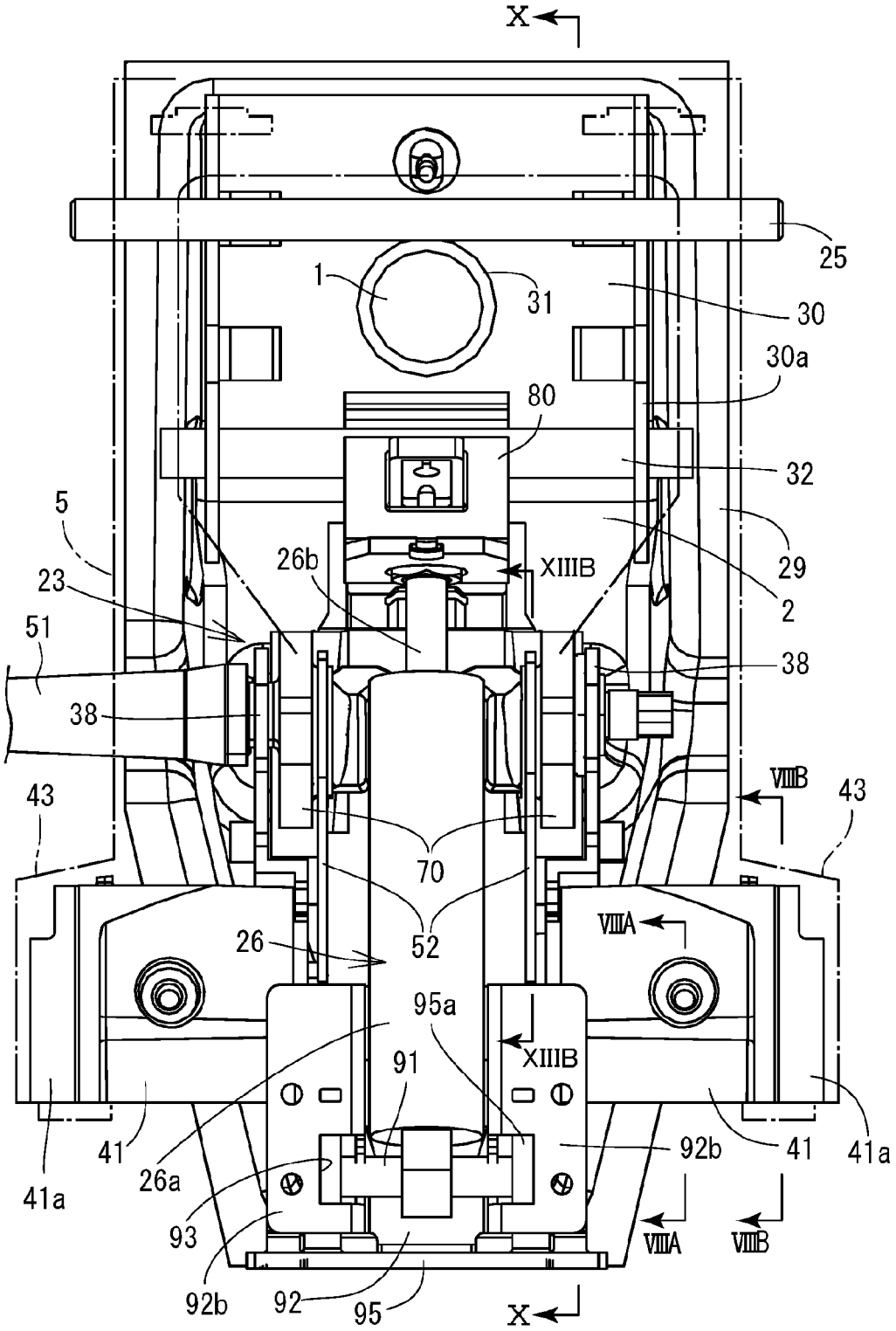
FIG. 7 is a plan view of the supporting mechanism part that centers a base.

Depending on the user, an initial posture adjustment function of the backrest 4 may not be required. Accordingly, for example, as shown in FIG. 7, the back inner shell 12 is non-pivotably held by mounting a restricting member 15*f* to a mount bracket 15*e* provided at a rear end portion of the second back frame 15 and fitting a restricting shaft (not shown) provided at a lower end of the back inner shell 12 into the restricting member 15*f*. Details are omitted.

For example, as is apparent from FIG. 1C, a lower end of the backrest 4 is located below a seat surface and therefore the initial angle adjustment device 155 is also located below the seat surface. For this reason, the initial angle adjustment device 155 does not come into contact with the body. Further, since the seated person can manipulate the operation tool 171 by extending his hand rearward, adjustment of the initial angle can be performed very simply.

(16). Other Initial Angle Adjustment Device

Figure 32:
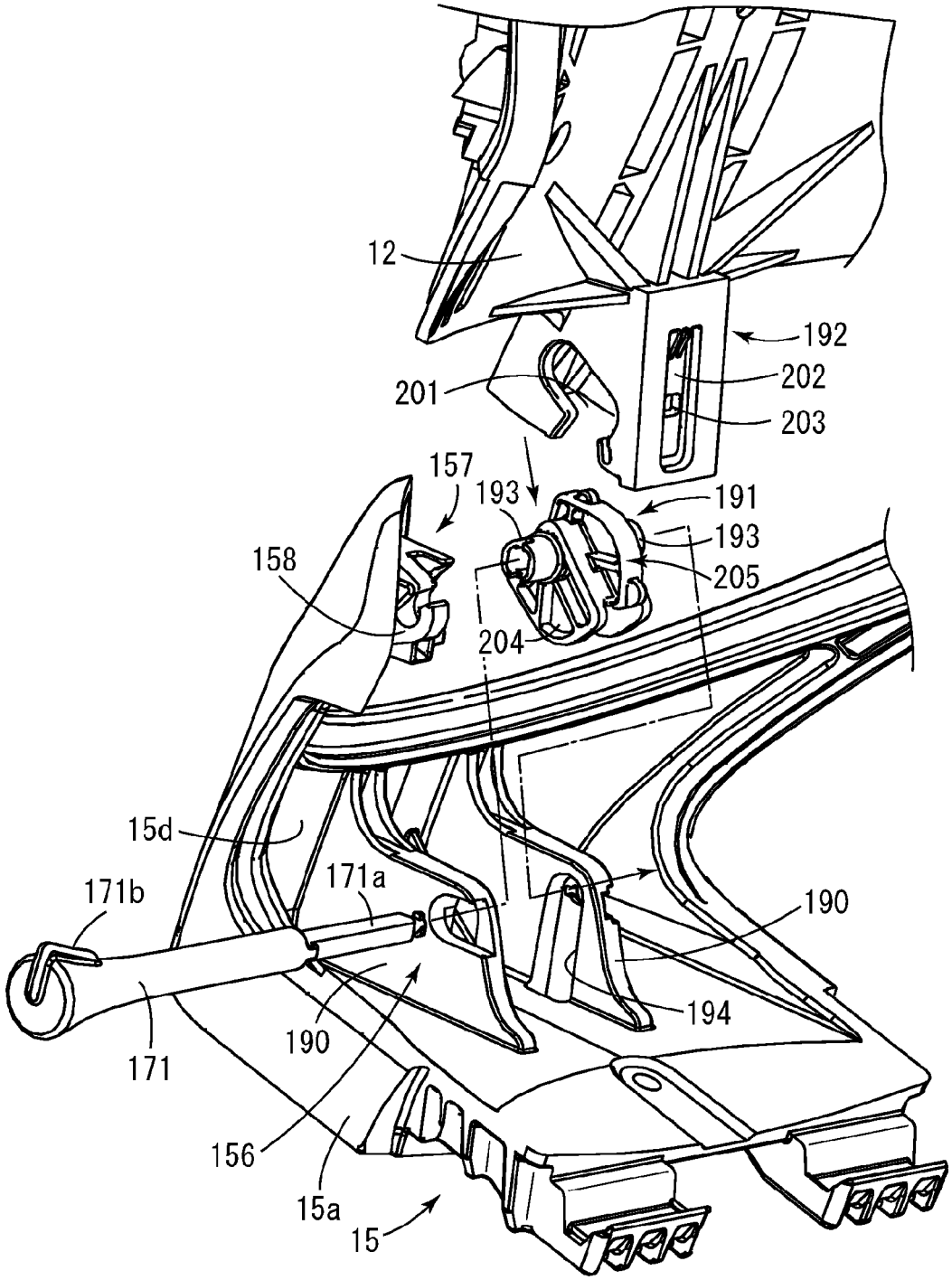
FIG. 32 is an exploded perspective view of other backrest initial angle adjustment device.

Next, another example of an initial angle adjustment device shown in FIG. 32 to FIG. 35 will be described. In this example, as shown in FIG. 32, a pair of left and right bearing ribs 190 is provided and a peripheral surface cam 191 is rotatably held by the left and right bearing ribs 190 via the operation tool 171. On the other hand, a box-shaped lower connection part 192 surrounding the peripheral surface cam 191 is provided integrally with a lower end portion of the back inner shell 12 and projected downward. Here, when the peripheral surface cam 191 is rotated by the operation tool 171, a support position in a longitudinal direction of the lower connection part 192 by the peripheral surface cam 191 changes and therefore the initial angle of the backrest 4 changes. Accordingly, the operation tool 171 is a rotary type.

As shown in FIG. 32, in this example, while cylindrical bearing parts 193 are formed integrally with both left and right ends of the peripheral surface cam 191, a groove 194 that is long in a vertical direction is formed at an inner surface of the bearing rib 190. The left and right cylindrical parts 193 provided at the peripheral surface cam 191 are fitted into the groove 194. A square-like part 171*a* of the operation tool 171 penetrates the cylindrical part 194 of the peripheral surface cam 191. However, as clearly shown in FIG. 34B, while a pair of protrusions 195 is provided at a base portion of the square-like part 171 of the operation tool 171, a pair of cutout portions 196 is formed at one of the cylindrical parts 193 of the peripheral surface cam 191. The protrusion 195 is fitted into the cutout portion 196. Therefore, integrity of the peripheral surface cam 191 and the operation tool 171 is increased.

A small-diameter portion 197 is formed at a leading end of the operation tool 171. The small-diameter portion 197 is rotatably fitted into a bearing hole 198 that is provided at the other bearing rib 190. While a pair of stopper pieces 199 is provided at a leading end of the small-diameter portion 197 of the operation tool 171 and projected in a direction perpendicular to an axis, a stepped part 200 is formed at an outer surface of the other bearing rib 190. The stopper piece 199 is inseparably fitted into the stepped part 200. The bearing hole 198 of the other bearing rib 190 is formed as an elongated hole that is long in a longitudinal direction. Accordingly, the stopper piece 179 is formed transversely and fitted into the bearing hole 198. When the stopper piece 199 is fitted into the bearing hole 198 and then the operation tool 171 is rotated, the operation tool 171 is inseparably held.

Insertion of the operation tool 171 is performed after the peripheral surface cam 191 is set between the left and right bearing ribs 190. As shown in FIG. 34B, a projection direction 83 of the protrusion 77 is perpendicular to a projection direction 84 of the stopper piece 81. As shown in FIG. 19, a rib 171*b* for displaying a posture of the backrest 5 is provided at a base end of a grip of the operation tool 171.

Figure 34A:
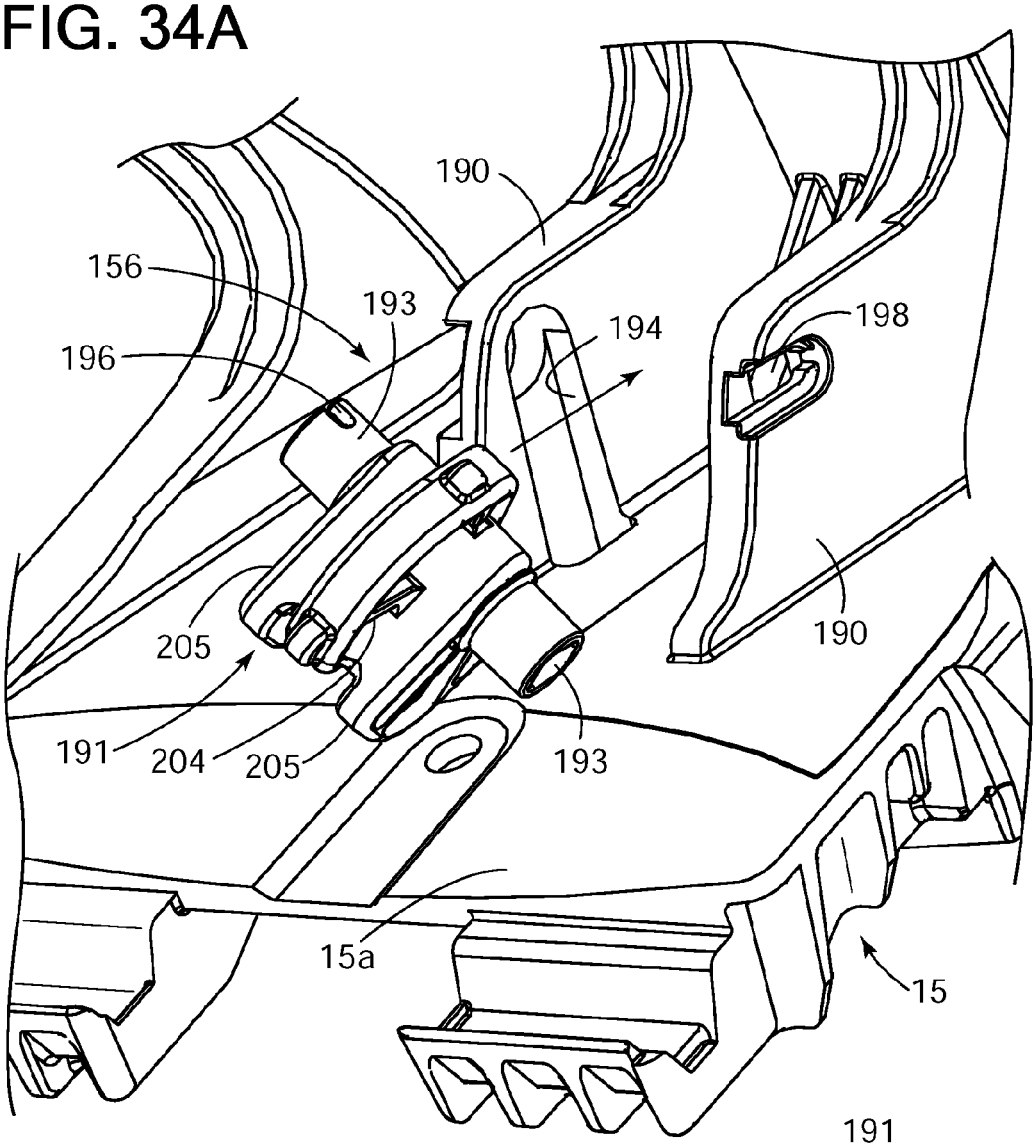
FIG. 34A is a perspective view showing a fitting state of a peripheral surface cam and FIG. 34B is an exploded perspective view of the operation tool and the peripheral surface cam.
Figure 34B:
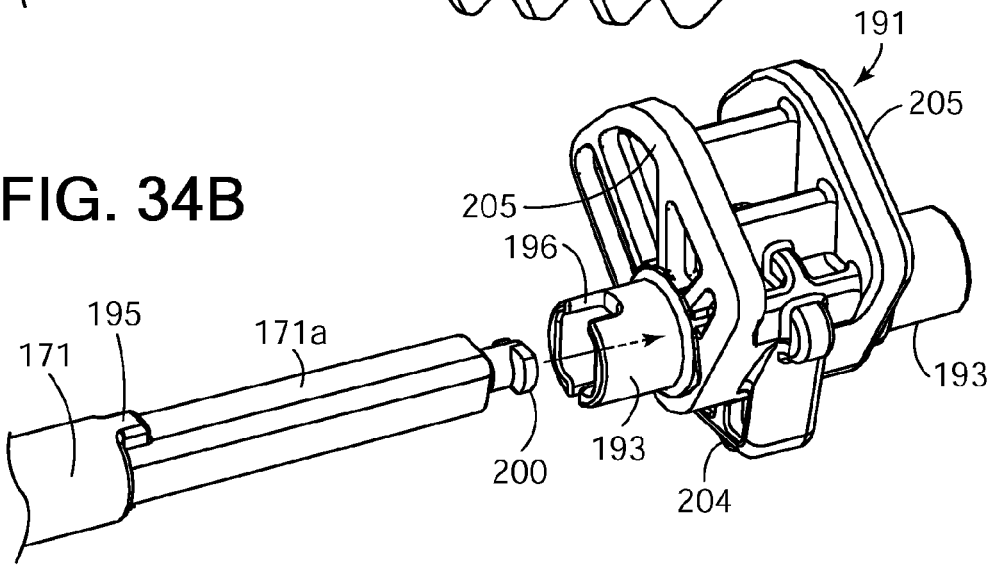
Figure 35A:
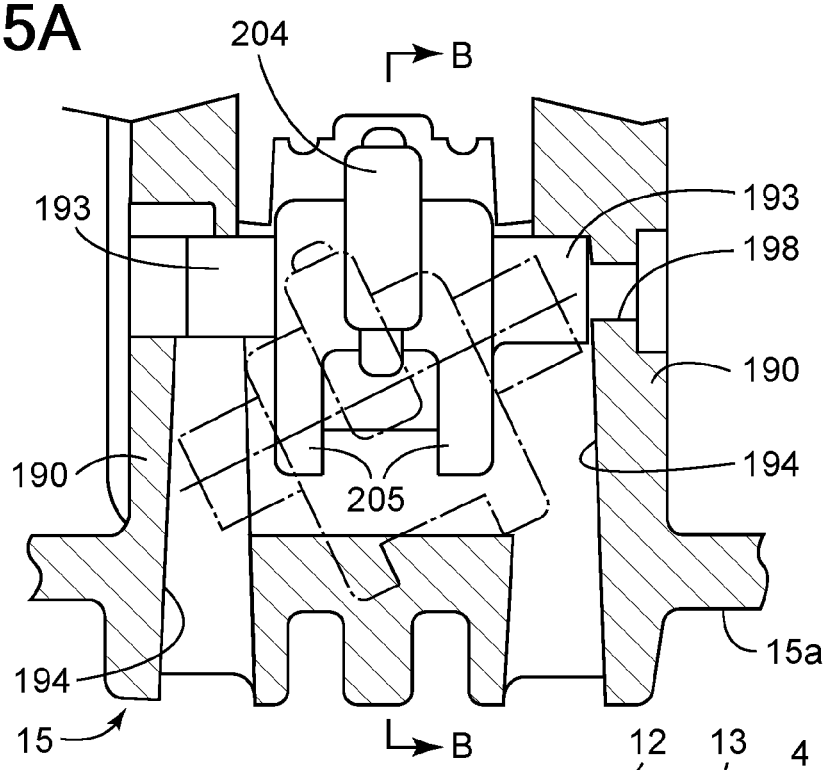
FIG. 35A is a longitudinal sectional front view of essential parts and FIG. 35B is a sectional view taken along a line B-B shown in FIG. 35A.
Figure 35B:
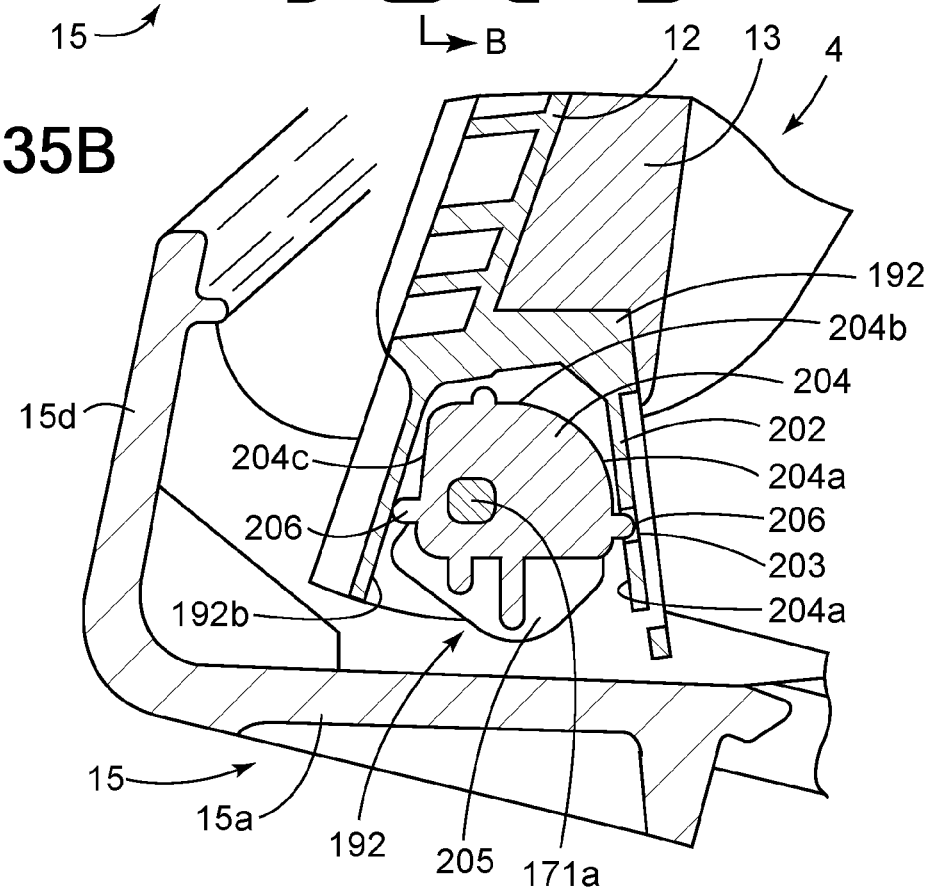

As shown in FIG. 34 and FIG. 35, fitting of the peripheral surface cam 191 is performed in order of fitting the peripheral surface cam 191 between the left and right bearing ribs 190 in a posture where an axis of rotation is inclined to the horizontal and then returning the peripheral surface cam 191 to the horizontal posture. Since the elongated groove 194 is long in a vertical direction, the left and right cylindrical parts 75 can be fitted into the left and right elongated grooves 76 by tilting the peripheral surface cam 191, as seen from the front. As the posture of the peripheral surface cam 191 returns to a posture in which an axis of rotation is horizontal. the peripheral surface cam 191 is held so as not to be movable in a longitudinal direction.

Figure 33A:
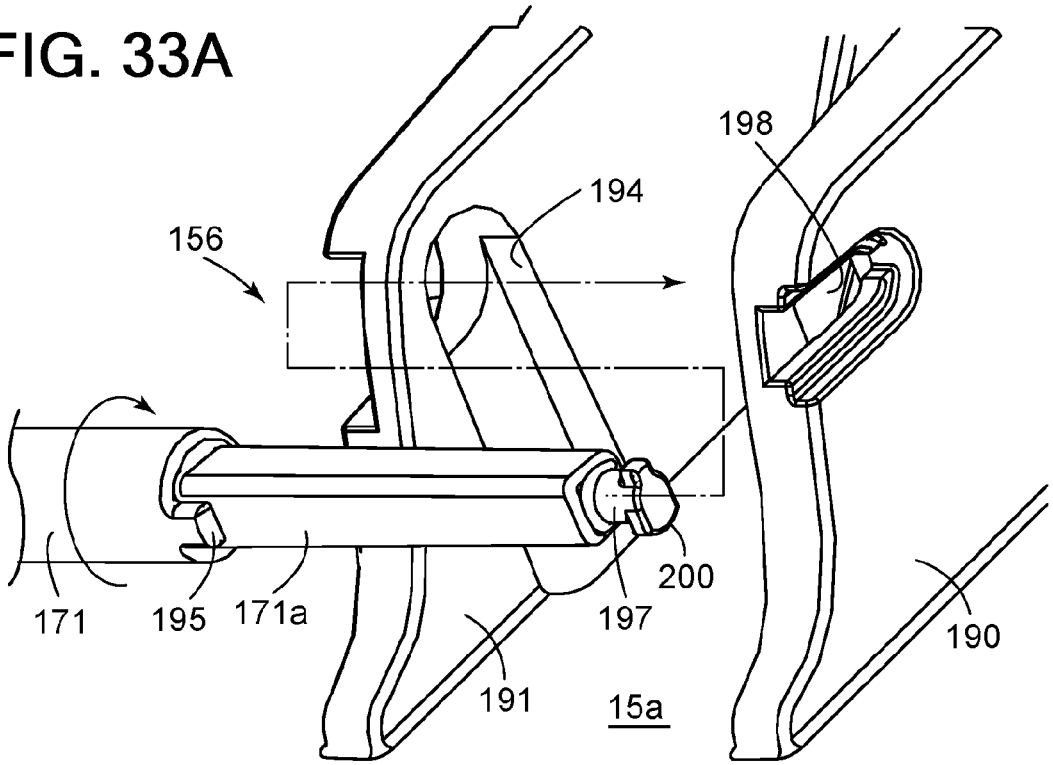
FIG. 33A and FIG. 33B are exploded perspective views.
Figure 33B:
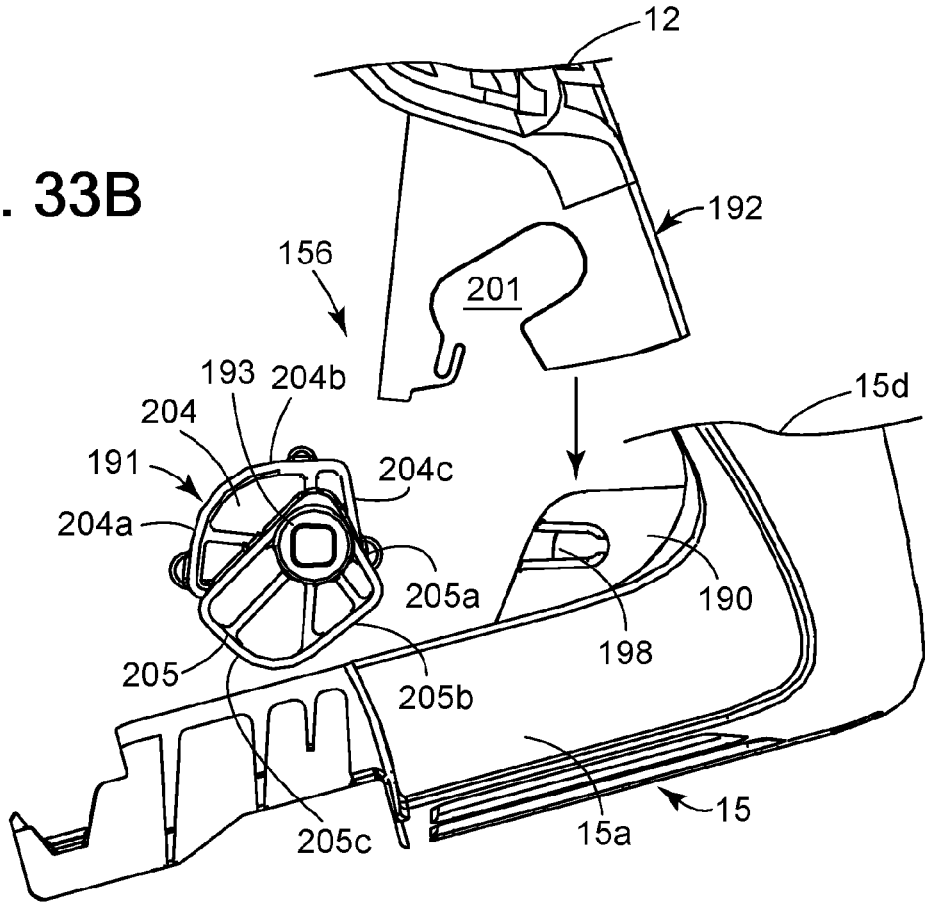

For example, as clearly shown in FIG. 33B, an elongated hole 201 for insertion of the operation tool is opened downward in the lower connection part 192 of the back inner shell 12.

A leading end portion of the operation tool 171 that is located between the left and right bearing ribs 190 is configured as a rectangular column portion 171*b*. The peripheral surface cam 191 is fitted into the rectangular column portion 171*b* so as not to rotate relative to each other (i.e., to rotate together with the operation tool 171). The peripheral surface cam 191 includes one center cam part 204 and a pair of left and right side cam parts 205 that are located at both left and right sides of the center cam part 204.

Outer peripheral surfaces of the center cam part 204 and the side cam parts 205 are configured as a cam surface, a front inner surface of the lower connection part 192 is configured as a front restricting surface 192*a* with which the center cam part 204 comes into contact, a rear inner surface of the lower connection part 192 is configured as a rear restricting surface 192*b* with which the side cam parts 205 come into contact. First to third cam surfaces 204*a* to 63*c* are formed at an outer periphery of the center cam part 204 and the heights of the first to third cam surfaces from an axis are different. Further, first to third cam surfaces 205*a* to 205*c* are formed at an outer periphery of the side cam parts 205 and the heights of the first to third cam surfaces from an axis are different. The lower connection part 192 is opened downward, as described above. However, a longitudinal spacing between the front restricting surface 192*a* and the rear restricting surface 192*b* is set to be larger toward the lower.

Both cam parts 204, 205 are configured as follows. The first cam surface 205*a* of the side cam part 205 comes into contact with the rear restricting surface 192*b* when the first cam surface 204*a* of the center cam part 204 is in contact with the front restricting surface 192*a*. The second cam surface 205*b* of the side cam part 205 comes into contact with the rear restricting surface 192*b* when the second cam surface 204*b* of the center cam part 204 is in contact with the front restricting surface 192*a*. The third cam surface 205*c* of the side cam part 205 comes into contact with the rear restricting surface 192*b* when the third cam surface 204*c* of the center cam part 204 is in contact with the front restricting surface 192*a*.

In the present example, the initial angle of the backrest 4 can be adjusted in three steps by rotationally operating the operation tool 171 and the backrest 4 is held so as not to be rattled in a longitudinal direction. Although resistance to the rotation of the peripheral surface cam 191 occurs, it is possible to rotate the peripheral surface cam 191 by elastically deforming the lower connection part 192. In order to allow the lower connection part 192 to be pivoted, elongated holes 201 are provided at left and right side plates of the lower connection part 192. The operation tool 171 is loosely fitted into the elongated hole 201.

For example, as shown in FIG. 35 (see also FIG. 32), an elastic piece 202 having an opening shape is formed integrally with a front surface portion of the bearing rib 190. A lower end of the elastic piece 202 is a free end. While an engaging hole 203 is provided at the elastic piece 202, a protrusion 206 is respectively provided at each of the cam surfaces 204*a*, 204*b*, 204*c* of the center cam part 204 of the peripheral surface cam 191 and fitted into the engaging hole 203. As a result, since any one of the protrusions 88 is fitted into the engaging hole 88, a user can grasp, from the spacing, that the peripheral surface cam 191 is rotated to a predetermined state. In other words, the operation tool 171 can accurately rotate the peripheral surface cam 191 with a click feeling.

The initial angle adjustment device can be variously embodied. The operation tool is not limited to a slide type or a rotary type but may be a pivot type. The initial angle adjustment device can be configured in such a way that the backrest is pivoted by providing an operation tool including a push button at a lower end of the backrest and moving the operation tool in a longitudinal direction while maintaining a state where the push button is pushed down and thus the locking is released. In a case where a cam is used in the initial angle adjustment device, various cams such as an end surface cam can be employed. The initial angle of the backrest may be steplessly adjusted by providing a screwed handle in the initial angle adjustment device. A lock mechanism other than a pin or cam may be employed.

INDUSTRIAL APPLICABILITY

The present invention and each invention disclosed in the present application can be embodied in the chair. Accordingly, the present invention has an industrial applicability.

REFERENCE NUMERALS LIST

1 Leg strut (Gas cylinder)
2 Base
3 Seat
4 Backrest
5 Intermediate bracket
14, 15 Back frame
16 First shaft (Shaft serving as a tilting support of a backrest)
18 Pushing shaft
23 Resilience adjustment unit
25 Second shaft
26 Locking gas cylinder
32 Third shaft
38 Support bracket
50 Spring unit
51 Operation shaft
52 Posture holding member
53 Cylindrical member (Fixed spring mount) to configure a spring holder
54 Compression coil spring as an example of a locking spring portion
55 Movable spring mount to configure a spring holder
60 Support shaft (Connection part)
62 Pusher as an example of a pushing part
70 Peripheral surface cam as an example of a cam
71 Cam mount part
72 Cam surface
73 Cam member
78 Rubber as an example of an elastic part

What is claimed is:

1. A rocking chair comprising:
a seat;
a backrest that is tiltable rearward;
a locking spring portion that imparts resistance to the rearward tilting of the backrest;
a resilience adjustment member that changes the degree of resistance of the spring portion to the rearward tilting of the backrest,
a base that is provided at an upper end of a leg; and
a back frame that is connected to the base so as to be tiltable rearward,
wherein the resilience adjustment member is a cam that is rotationally operable by a person seated on the seat,
wherein the position in which rocking load due to the rearward tilting of the backrest is applied to the spring portion is changed by the cam, so that moment applied to the spring portion changes and the degree of resistance of the spring portion is adjusted,
wherein a pushing part is provided at a front end portion of the back frame that is located across a tilting center and on the opposite side of the backrest, the pushing part configured to be brought into contact with the spring portion,
wherein the spring portion is a compression coil spring that is long in a longitudinal direction and wound around an axis thereof and attached to the base so as to be pivotable vertically about a front portion thereof and a rear end thereof is configured as a load support part that is pressed by the pushing part of the back frame, and
wherein the load support part moves on a contact face of the pushing part in accordance with the pivot movement of the spring portion,
wherein the pushing part of the back frame has a circular arc shape that is concave forward, as seen from the side, so as to allow the pivoting of the spring portion.

2. The rocking chair according to claim 1, wherein the compression coil spring is incorporated in a spring holder that is stretched in a longitudinal direction,
wherein the cam is a peripheral surface cam, a plurality of cam surfaces are formed at an outer peripheral surface of the cam and distances of the cam surfaces from an axis are different from each other and,
wherein the spring holder is provided with cam mount parts with which a plurality of cam surfaces of the peripheral surface cam is selectively brought into contact.

3. The rocking chair according to claim 2, wherein the spring holder comprises two spring mounts that are fitted to each other so as to be slidable in a longitudinal direction and support the spring from one end and the other end and,
wherein the two spring mounts are inseparably retained in a state where the compression coil spring is pre-compressed.

4. The rocking chair according to claim 1, further comprising a separation prevention portion that holds the spring portion in a state of being close contact with the cam,
wherein the separation prevention portion comprises an elastic part that allows the rotation of the cam.

5. A rocking chair comprising:
a seat;
a backrest that is tiltable rearward;
a locking spring portion that imparts resistance to the rearward tilting of the backrest; and
a resilience adjustment member that changes the degree of resistance of the spring portion to the rearward tilting of the backrest,
wherein the resilience adjustment member is a cam that is rotationally operable by a person seated on the seat, and the position in which rocking load due to the rearward tilting of the backrest is applied to the spring portion is changed by the cam, so that moment applied to the spring portion changes and the degree of resistance of the spring portion is adjusted,
wherein the spring portion is a compression coil spring that is long in a longitudinal direction and wound around an axis thereof,
wherein the compression coil spring is housed in a spring holder that is stretchable in the longitudinal direction,
wherein the spring holder includes two spring mounts that are fitted to each other so as to be slidable in the longitudinal direction and support the spring from one end and the other end, and
wherein the two spring mounts are inseparably retained in a state where the compression coil spring is pre-compressed.

6. A rocking chair comprising:
a seat;
a backrest that is tiltable rearward;
a locking spring portion that imparts resistance to the rearward tilting of the backrest;
a resilience adjustment member that changes the degree of resistance of the spring portion to the rearward tilting of the backrest; and a separation prevention portion that holds the spring portion in a state of being close contact with the cam, wherein the resilience adjustment member is a cam that is rotationally operable by a person seated on the seat, and the position in which rocking load due to the rearward tilting of the backrest is applied to the spring portion is changed by the cam, so that moment applied to the spring portion changes and the degree of resistance of the spring portion is adjusted, and wherein the separation prevention portion includes an elastic part that allows the rotation of the cam.

* * * * *